US005247129A

United States Patent [19]

Nozaki et al.

[11] Patent Number: 5,247,129

[45] Date of Patent: Sep. 21, 1993

[54] STRINGLESS PIANO-TOUCH ELECTRIC SOUND PRODUCER FOR DIRECTLY DRIVING A SOUND BOARD ON THE BASIS OF KEY ACTIONS

[75] Inventors: Kinya Nozaki; Kiyoshi Kawamura; Shigeru Muramatsu, all of Shizuoka, Japan

[73] Assignee: Yamaha Corporation, Hamamatsu, Japan

[21] Appl. No.: 895,591

[22] Filed: Jun. 8, 1992

[30] Foreign Application Priority Data

| | | | |
|---|---|---|---|
| Jun. 10, 1991 | [JP] | Japan | 3-165096 |
| Sep. 12, 1991 | [JP] | Japan | 3-261221 |
| Sep. 18, 1991 | [JP] | Japan | 3-267220 |
| Sep. 18, 1991 | [JP] | Japan | 3-267221 |
| Sep. 18, 1991 | [JP] | Japan | 3-267224 |
| Sep. 18, 1991 | [JP] | Japan | 3-267225 |

[51] Int. Cl.[5] ..... G10H 7/00; G10H 1/18

[52] U.S. Cl. ..... 84/615; 84/192; 84/645; 84/744

[58] Field of Search ..... 84/192, 404, 410, 615, 84/645, 723, 735, 736, 744, 743

[56] References Cited

U.S. PATENT DOCUMENTS

| | | | |
|---|---|---|---|
| 4,324,164 | 4/1982 | Monte et al. | 84/744 |
| 5,054,361 | 10/1991 | Usa | 84/743 X |
| 5,115,705 | 5/1992 | Monte et al. | 84/617 |

FOREIGN PATENT DOCUMENTS

| | | |
|---|---|---|
| 4-500735 | 2/1992 | Japan . |
| 8901068 | 9/1989 | PCT Int'l Appl. . |

*Primary Examiner*—William M. Shoop, Jr.
*Assistant Examiner*—Jeffrey W. Donels
*Attorney, Agent, or Firm*—Graham & James

[57] ABSTRACT

A wireless piano-touch electric sound producer comprises a keyboard assoicated with key action mechanisms and hammers driven for rotation upon depressing the assoicated keys, and a board accompanied with an absorber is shared between the hammer units for scaling down of the electric sound producer, wherein a memory unit stores pieces of vibratory information for reproducing sounds from vibrations on musical wires and board members of an acoustic piano so that a driver unit produces vibrations on a sound board of the electric sound producer on the basis of one of the pieces of vibratory information selected upon detecting actions of the keys to the hammers.

34 Claims, 42 Drawing Sheets

STRINGLESS PIANO-TOUCH ELECTRIC SOUND PRODUCER FOR DIRECTLY DRIVING A SOUND BOARD ON THE BASIS OF KEY ACTIONS

FIELD OF THE INVENTION

This invention relates to a piano-like electric musical instrument and, more particularly, to a stringless piano-like electric musical instrument for producing sounds.

DESCRIPTION OF THE RELATED ART

Musical instruments are largely broken down into two categories, i.e., an acoustic musical instrument and a synthesizer (or an electronic musical instrument). The acoustic musical instrument produces vibrations on component members on the basis of mechanical actions, and the vibrations on the component members originate audible sounds in association with a resonator. The synthesizer electronically produces synthetic sounds on the basis of physical factors such as harmonic constituents and characteristics of attach, decay and so forth given by a player, and the player designates notes in accordance with a musical score.

Japanese Patent Application laid-open (Kokai) No. 61-289393 discloses a compromise between the acoustic musical instrument and the synthesizer, and the compromised piano-like keyboard instrument is equipped with key action mechanisms associated with musical wires for producing acoustic sounds as well as with an electronic sound generator for synthetic sounds. However, the compromised piano-like keyboard instrument is as large in size as an acoustic piano, because a large number of music wires are stretched over a sound board enclosed in a side board. For this reason, the compromised piano-like keyboard instrument occupies wide area, and is not suitable for a small room. Another problem inherent in the compromised piano-like keyboard instrument is uncontrollable loudness of the acoustic sounds. A key action is transferred through the associated key action mechanism to the hammer unit, and the hammer unit strikes a set of musical wires. The hammer unit usually strikes at substantially constant force unless a player strongly or weakly depresses a key. Of course, a soft pedal is provided for decreasing the volume; however, the soft pedal is usually used for imparting expression to a music, and is never continuously operated. In other words, there is no way to control the standard loudness of acoustic sounds. This is inconvenient for a family living in a small house in a closely built-up area.

Another compromised keyboard musical instrument is also fabricated on the basis of a piano, and the piano is associated with electromagnetic pick-up units. When a music is played on the keyboard, vibrations on the key bed are detected by the electromagnetic pick-up units, and an audio signal is produced from the output signals of the electromagnetic pick-up units by an audio system, then being supplied to moving-coil speaker system attached to the sound board. The moving-coil speaker system drives the sound board, and the sound board serves as a sound reflecting board. However, the compromised keyboard musical instrument thus arranged is never free from the problems inherent in the compromised keyboard musical instrument disclosed in the Japanese Patent Application laid-open. Moreover, the response characteristics of the sound board is not uniform over the band width, and a simple equalizer is provided for compensating the non-linearity. However, the equalizer can not fully compensate the non-linearity, and sounds in the low frequency range are not fine. This is because of the fact that the periphery of the sound board under the musical wires is rigidly supported, and the resonance frequency f0 is around 150 Hz. Moreover, a diaphragm of a speaker system allows reciprocal motion to easily take place. However, the reciprocal motion hardly takes place on the sound board, and the vibrations on the sound board are of the crossover vibrations. For this reason, the frequency characteristics of the sound board cause extremely high peaks and extremely deep valleys to take place over the band width, and is not of the high fidelity acoustic radiating board. Thus, the sound board is not desirable for the low frequency range; however, the sound board is not desirable for radiation of high frequency range too. Namely, the sound board is as heavy as about 10 kilograms, and causes vibrations to decay from 1 kHz through 10 kHz. This results in that sounds in the high frequency range are less reproducible. Thus, the prior art compromised keyboard musical instruments have encountered various problems.

Yet another problem inherent in the prior art compromised keyboard musical instrument is to insufficiently impart effects of damper and soft pedals to electronically produced sounds. This problem is common to an electronic keyboard system. A damper pedal mechanism and a soft pedal mechanism are usually incorporated in a piano, and a player imparts predetermined effects to sounds through selective operation. If the piano is of the upright type, the damper pedal causes all the dampers to keep away from the associated musical wires, and the sound produced under the manipulation of the damper pedal are, accordingly, prolonged. However, the damper pedal not only prolongs the sounds produced from the struck musical wires but also allows non-struck musical wires to resonate. For example, assuming now that a player depresses the first key, the musical wires associated with the first key are struck and produce a sound with the fundamental wave at 27.5 Hz. If the damper pedal is depressed, the associated damper is never brought into contact with the struck musical wires, and the struck musical wires allows the musical wires with respective fundamental waves at multiples of the fundamental wave of the struck musical wires. Namely, the musical wires associated with the thirteen key for A tone, the twentieth key for E tone and the twenty fifth key for A tone strongly resonate, and the musical wires associated with the twenty ninth key for C# tone, the thirty second key for E tone and the thirty seventh key for A tone slightly resonate. However, the vibratory energy are transferred from the struck musical wires through the bridges and the sound board to the resonant musical wires, and time delay from hundreds milliseconds to several seconds is introduced between the strike and the resonance. Similarly, if the thirteen key is depressed under the manipulation of the damper pedal, the musical wires associated with the thirteen key produce a sound with the fundamental wave at 55 Hz, and the musical wires associated with the twenty fifth key, the thirty second key and the thirty seventh key can theoretically resonate. However, the musical wires for the first and twenty fifth keys strongly resonate, and the musical wires for the thirteen seventh key slightly resonate. Thus, the struck musical wires allow not only the musical wires with the multiples of the fundamental wave but also the musical wires assigned to the tone one octave lower than the struck musical wires to resonate. If the struck musical wires are assigned one of the middle-pitched and high-pitched sounds, musical wires with the fundamental waves not lower than the second multiple hardly resonate, and only the musical wires for the tone one octave lower than the struck musical wires resonate. Time delay is also introduced; however, the resonant tones rises after tens to hundreds milliseconds from the originally produced sound. While the damper pedal is continuously depressed, the damper keeps away from the musical wires, and the sounds, i.e., the originally produced sound and the resonant sounds continue over several to tens seconds. Thus, the damper pedal allows a plurality of musical wires assigned various tones to resonate, and the composite sound creates rich and spread impression on listeners.

Another pedal, i.e., a soft pedal lessens the volume of a sound produced under the manipulation, and the prior art compromised keyboard musical instrument in the electronic mode as well as an electronic keyboard encounters a similar problem in imparting the effects of the soft pedal to sounds to be produced. In detail, when the soft pedal is depressed, the associated pedal mechanism incorporated in a grand piano changes relative position between the musical wires and the hammer units, and a hammer unit strikes two of the three musical wires upon depressing the associated key. This results in decrease of volume. The pedal mechanism incorporated in an upright piano is different from that of the grand piano, and causes the hammer rail to move to a closer position to the musical wires. The distance thus decreased lessens impact of a hammer unit on the associated musical wires and, accordingly, the volume of a sound. However, both pedal mechanisms allow musical wires to produce soft and mellow tones. An analysis of the effect of the manipulated soft pedal incorporated in the grand piano is described as follows. When a key is depressed under the manipulation of the soft pedal, the associated musical wires struck by the hammer unit is decreased from three to two through sliding motion as described hereinbefore, and the two musical wires are struck by a fresh area on the hammer top felt different from that impacting thereto without manipulation of the soft pedal. The decrease of the musical wires struck by the hammer unit lessens the vibratory energy to two third or a half of the full vibratory energy. Although the non-struck musical wire resonates, the volume is surely decreased. Moreover, since the soft pedal is not frequently manipulated, the fresh area is softer than the area usually impacting to the musical wires, and tends to cut off the higher harmonic component frequencies. For this reason, the impact with the fresh area is also conducive to the decrease in volume. The manipulation of the soft pedal further allows the sounds to linger, and the non-struck musical wire makes contribution to the lingering effect. Namely, the non-struck musical wire receives vibratory energy from the struck musical wires through the associated bridge, and resonates. However, the non-struck musical wire vibrates in anti-phase with respect to the struck musical wires, and the anti-phase vibration increases relative volume level for the lingering effect. However, the compromised keyboard musical instrument in the electronic mode merely cuts off the higher harmonic component frequencies in the equalizer, and the resonance of the non-struck musical wire is hardly simulated. As a result, any lingering effect is hardly imparted to the sound electronically produced. Thus, the effects of the damper and soft pedals can not be achieved with the equalizer incorporated in the prior art compromised keyboard musical instrument.

SUMMARY OF THE INVENTION

It is therefore an important object of the present invention to provide a piano-touch musical sound producer which is smaller in size than the prior art compromised piano-like keyboard musical instrument.

It is another important object of the present invention to provide a piano-touch musical sound producer which produces sounds identical with the sounds originally produced by a piano.

It is yet another important object of the present invention to provide a piano-touch musical sound producer which can simulate the effects of the damper and soft pedals incorporated in a piano.

To accomplish the object, the present invention proposes to drive a sound board on the basis of selected vibratory information indicative of a line spectrum of vibrations produced on musical wires and component boards of an acoustic piano.

In accordance with one aspect of the present invention, there is provided a stringless piano-touch electric sound producer comprising: a) a keyboard having a plurality of keys independently manipulated by a player; b) a plurality of hammer units respectively associated with the plurality of keys, and independently driven for rotations; c) a plurality of key action mechanisms respectively coupled between the plurality of keys and the plurality of hammer units for imparting a piano-touch to the player, and operative to drive the associated hammer units for the rotations upon manipulations of the associated keys, a motion of each key, a motion of the associated key action mechanism and the rotation of the associated hammer unit constituting an impact motion; d) board means shared between the plurality of hammer units, and allowing the plurality of hammer units to impact without a substantial amount of sound; e) a housing unit accommodating the keyboard, the plurality of hammer units, the plurality of key action mechanisms and the board means, and having component members including a vibratory board member; f) sensor means operative to detect the impact motion for producing a detecting signal; g) a first memory unit storing pieces of vibratory information about vibrations produced on at least musical wires and a sound board member incorporated in an acoustic piano upon striking the musical wires with hammer units of the acoustic piano; h) selecting means responsive to the detecting signal for selecting one of the pieces of vibratory information; and i) driving means provided in association with the vibratory board member, and operative to produce vibrations thereon on the basis of the aforesaid one of the pieces of vibratory information for producing sounds.

The stringless piano-touch electric sound producer may further comprise means for modifying a piece of vibratory information in accordance with frequency characteristics of the vibratory board member, and damping means may be provided in association with the board means.

In accordance with another aspect of the present invention, there is provided a stringless piano-touch electric sound producer comprising: a) a keyboard having a plurality of keys independently manipulated by a player; b) a plurality of hammer units respectively associated with the plurality of keys, and independently driven for rotations; c) a plurality of key action mechanisms respectively coupled between the plurality of keys and the plurality of hammer units for imparting a piano-touch to the player, and operative to drive the associated hammer units for the rotations upon manipulations of the associated keys, a motion of each key, a motion of the associated key action mechanism and the rotation of the associated hammer unit constituting an impact motion; d) board means shared between the plurality of hammer units, and allowing the plurality of hammer units to impact without a substantial amount of sound; e) a housing unit accommodating the keyboard, the plurality of hammer units, the plurality of key action mechanisms and the board means, and having a plurality of component members including a vibratory board member; f) first sensor means operative to detect the impact motion for producing a first detecting signal; g) a pedal member rockablly supported by the housing, and manipulated by the player when the player wants to impart an effect corresponding to an effect of a damper pedal of an acoustic piano to sounds produced from the vibratory board member; h) second sensor means operative to detect a manipulation of the pedal member for producing a second detecting signal; i) a first memory unit storing pieces of first vibratory information about vibrations originally produced on at least musical wires incorporated in the acoustic piano upon striking the musical wires with hammer units of the acoustic piano; j) a second memory unit storing pieces of second vibratory information about resonant vibrations produced on other musical wires incorporated in the acoustic piano upon striking the musical wires with the hammer units; k) selecting means responsive to the first detecting signal for selecting one of the pieces of first vibratory information in the absence of the second detecting signal, the selecting means being further responsive to the first detecting signal for selecting one of the pieces of first vibratory information as well as one of the pieces of second vibratory information in the presence of the second detecting signal; and l) driving means provided in association with the vibratory board member, and operative to produce vibrations thereon on the basis of the aforesaid one of the pieces of first vibratory information for producing the sounds, the driving means being further produces vibrations on the basis of the aforesaid one of the pieces of first vibratory information and of the one of the pieces of second vibratory information for imparting the effect to the sounds.

In accordance with yet another aspect of the present invention, there is provided a stringless piano-touch electric sound producer comprising: a) a keyboard having a plurality of keys independently manipulated by a player; b) a plurality of hammer units respectively associated with the plurality of keys, and independently driven for rotations; c) a plurality of key action mechanisms respectively coupled between the plurality of keys and the plurality of hammer units for imparting a piano-touch to the player, and operative to drive the associated hammer units for the rotations upon manipulations of the associated keys, a motion of each key, a motion of the associated key action mechanism and the rotation of the associated hammer unit constituting an impact motion; d) board means shared between the plurality of hammer units, and allowing the plurality of hammer units to impact without a substantial amount of sound; e) a housing unit accommodating the keyboard, the plurality of hammer units, the plurality of key action mechanisms and the board means, and having a plurality of component members including a vibratory board member; f) first sensor means operative to detect the impact motion for producing a first detecting signal; g) a pedal member rockablly supported by the housing, and manipulated by the player when the player wants to impart an effect corresponding to an effect of a soft pedal of an acoustic piano to sounds produced from the vibratory board member; h) second sensor means operative of detect a manipulation of the pedal member for producing a second detecting signal; i) a first memory unit storing pieces of first vibratory information about vibrations originally produced on at least musical wires incorporated in the acoustic piano upon striking the musical wires with hammer units of the acoustic piano without any manipulation of the pedal member; j) a second memory unit storing pieces of second vibratory information about resonant vibrations produced on other musical wires incorporated in the acoustic piano without striking; k) selecting means responsive to the first detecting signal for selecting one of the pieces of first vibratory information in the absence of the second detecting signal, the selecting means being further responsive to the first detecting signal for selecting one of the pieces of first vibratory information as well as one of the pieces of second vibratory information in the presence of the second detecting signal; and l) driving means provided in association with the vibratory board member, and operative to produce vibrations thereon on the basis of the aforesaid one of the pieces of first vibratory information for producing the sounds, the driving means being further produces vibrations on the basis of the aforesaid one of the pieces of first vibratory information and of the aforesaid one of the pieces of second vibratory information for imparting the effect to the sounds.

BRIEF DESCRIPTION OF THE DRAWINGS

The features and advantages of the stringless piano-touch electric sound producer according to the present invention will be more clearly understood from the following description taken in conjunction with the accompanying drawings in which.

DESCRIPTION OF THE PREFERRED EMBODIMENTS

First Embodiment

Figure 1:
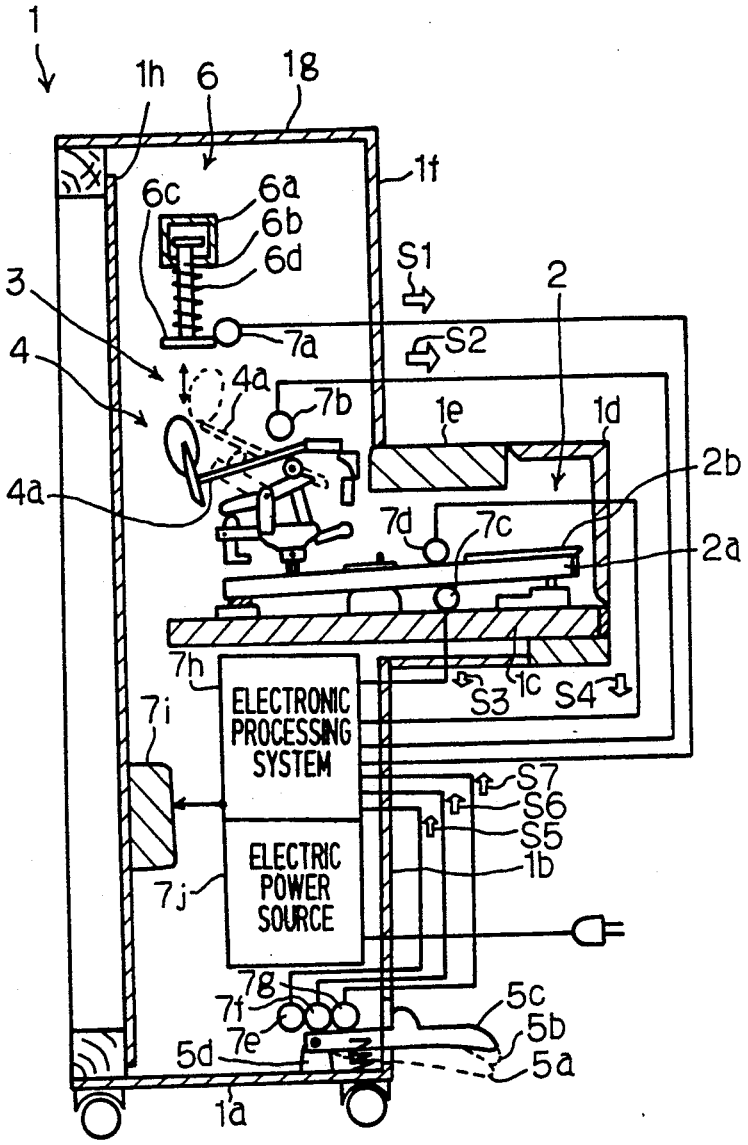
FIG. 1 is a cross sectional side view showing the structure of a stringless piano-touch electric piano producer according to the present invention.

Referring first to FIG. 1 of the drawings, a stringless piano-touch electric sound producer embodying the present invention largely comprises a piano-like keyboard musical instrument and an electric system. Although electric signal paths are drawn outside of the piano-like keyboard musical instrument, the real lines for the electric signal paths are merely indicative of electric connections, and the electric signal paths may extend inside of the piano-like keyboard musical instrument for an actual product.

The piano-like keyboard musical instrument comprises a housing unit 1 fabricated from a bottom plate 1*a*, a lower front board 1*b*, a key bed 1*c*, a fall board 1*d*, an upper sill 1*e*, an upper front board 1*f*, a top board 1*g*, a sound board 1*h* and so forth, and the sound board 1*h* serves as a vibratory board member in this instance. A keyboard 2 is mounted on the key bed 1*c*, and is implemented by a plurality of white and black keys 2*a* and 2*b*. In this instance, the keys are numbered from "1" to "88" on the keyboard 2. A plurality of hammer units 3 are provided in association with the white and black keys 2*a* and 2*b*, and are independently driven for rotations by means of a plurality of key action mechanisms 4 upon depressing the white and black keys 2*a* and 2*b*. The key action mechanisms 4 are complex. However, the structure of each key action mechanism is well known to a person skilled in the art, and no further description is incorporated hereinbelow for the sake of simplicity. Damper, muffler and soft pedals 5*a*, 5*b* and 5*c* project from the lower front board 1*b*, and are rockablly supported by the bottom board 1*a* through a bracket member 5*d*. However, these pedals 5*a* to 5*c* are not associated with any pedal mechanism.

A dashpot 6 is provided in spacing relation with the hammer units 3, and is shared between all the hammer units 3. The dashpot 6 is supported by the housing 1, and comprises a cylinder member 6*a*, a piston rod 6*b* projecting from the cylinder member 6*a*, a board member 6*c* attached to the leading end of the piston rod 6*b*, and a spring member 6*d* urging the piston rod 6*b* and, accordingly, the board member 6*c* in a direction projecting from the cylinder member 6*a*. The hammer units 3 or the hammer shanks 4*a* can be brought into abutting engagement with the board member 6*c*, and the spring member 6*d* takes up the impact energy applied from the hammer units so as to prohibit the board member 6*c* from production of a substantial amount of sound. The dashpot 6 serves as a board member in this instance. Thus, any musical wire, any hammer rail and any pedal mechanism is not provided in the piano-like keyboard musical instrument, and the housing is smaller in volume than an acoustic upright piano.

The electric system incorporated in the stringless piano-touch electric sound producer embodying the present invention comprises a plurality of sensor units 7*a*, 7*b*, 7*c*, 7*d*, 7*e*, 7*f* and 7*g*, an electronic processing system 7*h* and an electromagnetic actuator unit 7*i* attached with the inner surface of the sound board 1*h*. An electric power source 7*j* distributes electric power to the sensor units 7*a* to 7*g*, the electronic processing system 7*h* and the electromagnetic actuator unit 7*i*.

The sensor unit 7*a* is implemented by a pressure sensor of a piezo-electric transducer; however, any force-to-electric converter is available for the sensor unit 7*a*. The sensor unit 7*a* is held in contact with the board member 6*c*, and produces a first electric signal S1 indicative of the impact force applied to the board member 6*c*. The vibrations produced on musical wires are affected by the impact force, and the first electric signal S1 is used in selection of a vibration mode as described hereinlater.

The sensor unit 7*b* is implemented by a plurality of reflection photo-couplers respectively associated with hammer shanks 4*a* of the key action mechanisms 4, and each of the reflection photo-couplers detects the associated hammer shank crossing an optical path radiated therefrom. The reflection photo-coupler may be implemented by a light emitting diode and a photo-transistor. Time period for crossing the optical path is proportional to velocity of the hammer, and the hammer velocity is calculated by the electronic processing system 7*g*. For this reason, the sensor unit 7*b* produces a second electric signal S2 indicative of lapse of time for crossing the optical path, and the hammer velocity is also used in the selection of vibration mode.

The sensor unit 7*c* is also implemented by a plurality of reflection photo-couplers respectively associated with the white and black keys 2*a* and 2*b*, and each of the reflection photo-couplers detects the associated key crossing the optical path radiated therefrom upon depressing. Since the downward velocity of a key affects the line spectrum of vibrations produced on associated musical wires, the sensor unit 7*c* produces a third electric signal S3 indicative of the lapse of time, and the electronic processing system 7g calculates the key velocity used in the selection of vibration mode.

The sensor unit 7d is implemented by a plurality of acceleration pick-up units respectively associated with the white and black keys 2a and 2b, and a fourth electric signal S4 is supplied from the sensor unit 7d to the electronic processing system 7g for the selection of vibration mode.

The sensor units 7e to 7g are respectively associated with the damper, muffler and soft pedals 5a to 5c, and detect respective displacements of the associated pedals 5a to 5c. When a player depresses the damper, muffler and soft pedals 5a to 5c, the sensor units 7e to 7g respectively produce fifth, sixth and seventh electric signals S5, S6 and S7, and the fifth to seventh electric signals S5 to S7 are indicative of the displacements of the associated pedals 5a to 5c, respectively.

Figure 2:
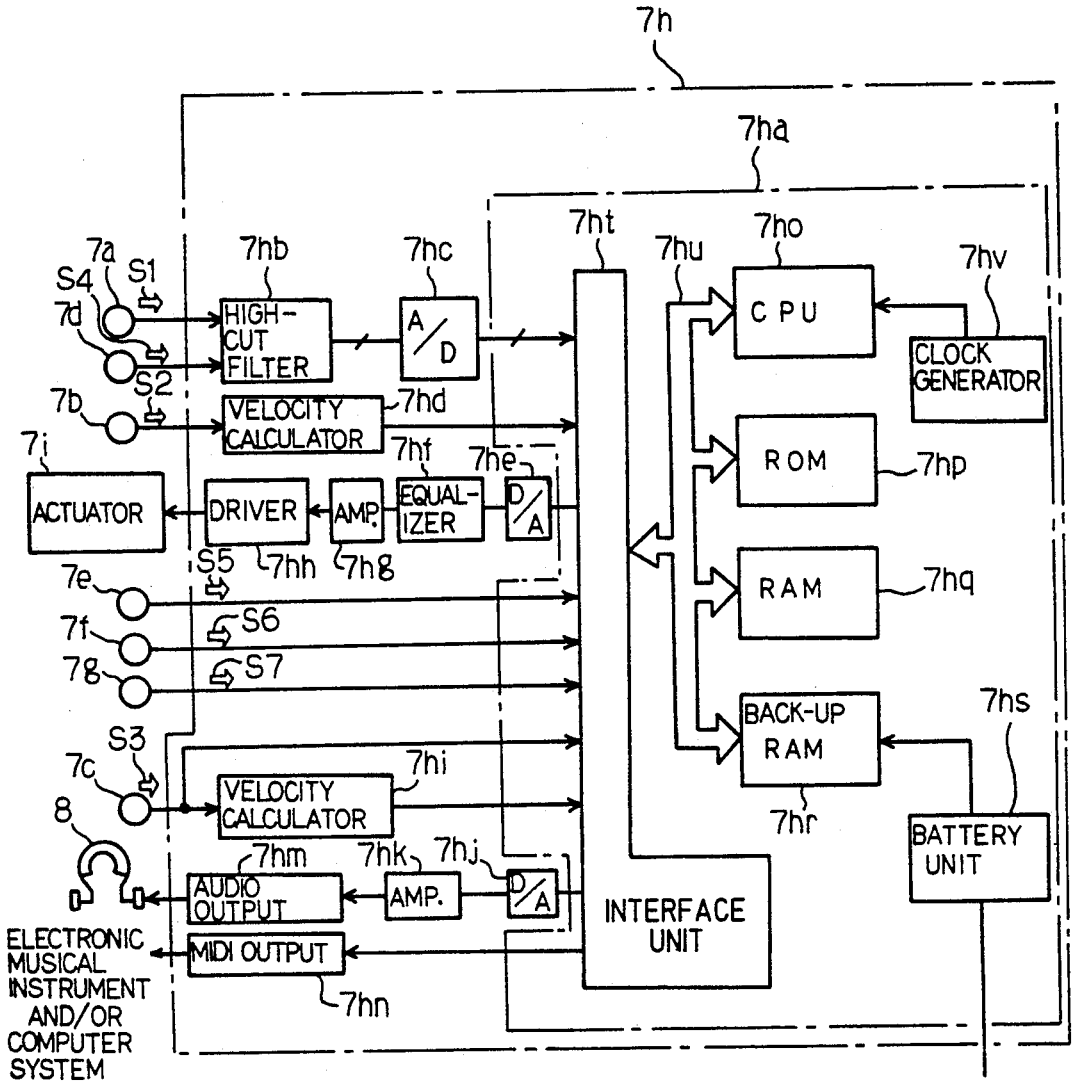
FIG. 2 is a block diagram showing the circuit arrangement of an electronic circuit incorporated in the stringless piano-touch electric piano producer shown in FIG. 1.

The first to seventh electric signals S1 to S7 are supplied to the electronic processing system 7h, and the electronic processing system 7h is illustrated in detail in FIG. 2 of the drawings. The electronic processing system 7h comprises a data processing unit 7ha, a high-cut filter unit 7hb accompanied with an analog-to-digital converter 7hc, a velocity calculator 7hd, a series combination of a digital-to-analog converter 7he, an equalizer 7hf, an amplifier 7hg and a driver 7hh, another velocity calculator 7hi, a series combination of a digital-to-analog converter 7hj, an amplifier 7hk and an audio-output unit 7hm, and a MIDI output unit 7hn. The sensor units 7a and 7d supply the first and fourth electric signals S1 and S4, and the high cut filter unit 7hb eliminates noise components equal to or higher than 8000 Hz from the first and fourth electric signals S1 and S4. The first and fourth electric signals S1 and S4 thus treated are supplied to the analog-to-digital converting unit 7hc, and are converted to first and second digital signals. A line spectrum signal indicative of vibrations produced on the board member 6c upon striking with the associated hammer unit 3 is formed from the first digital signal through a fast Fourier transformation as will be described hereinbelow. The velocity calculator 7hd is coupled with the sensor unit 7b, and is responsive to the second electric signal S2 for calculating the hammer velocity. The velocity calculator 7hd produces a third digital signal indicative of the hammer velocity, and the third digital signal is supplied to the data processing unit 7ha. The data processing unit 7ha produces a digital vibratory mode signal, and supplies the digital vibratory mode signal to the digital-to-analog converting unit 7he. The digital-to-analog converting unit 7he converts the digital vibratory mode signal into an analog vibratory mode signal, and the analog vibratory mode signal is increased in magnitude by means of the amplifier unit 7hg. The analog vibratory mode signal thus amplified is supplied to the driver unit 7hh, and the driver unit 7hh produces a driving signals in response to the analog vibratory signal. The driving signal is supplied to the electromagnetic actuator 7i, and the electromagnetic actuator 7i produces vibrations with a selected vibration mode on the sound board 1h. The third electric signal S3 is supplied in parallel to the data processing unit 7ha and the velocity calculator 7hi, and the velocity calculator 7hi calculates the key velocity. The third electric signal S3 indicative of a depressed key is directly supplied to the data processing unit 7ha, and a third digital signal indicative of the key velocity is supplied from the velocity calculator 7hi to the data processing unit 7ha. However, the fifth to seventh sensor units 7e to 7g are directly supplied to the data processing unit 7ha. The data processing unit 7ha further produces a digital audio signal and a digital MIDI signal, and the digital audio signal is converted into an analog audio signal by the digital-to-analog converting unit 7hj. The analog audio signal is amplified by the amplifier unit 7hk, and is transferred to the audio output 7hm. If a head receiver 8 is coupled with the audio output 7hm, a music performed by the player on the keyboard 2 is reproduced at the head receiver 8. The pieces of musical information indicative of the music is further supplied to the MIDI output 7hn, and is transferred to an electronic musical instrument.

The data processing unit 7ha comprises a central processing unit 7ho, a read only memory unit 7hp, a random access memory unit 7hq, a back-up random access memory unit 7hr associated with a battery unit 7hs and an interface unit 7ht coupled through an internal bus system 7hu with each other, and a clock generator 7hv distributes a system clock to these system components 7ho, 7hp, 7hq, 7hr and 7ht. The read only memory unit 7hp stores a program sequence fetched and executed by a central processing unit 7ho, timing data as well as a plurality of mode data indicative of various vibration modes, respectively. The timing data define delay of sounds, and are accessible with combination of a key number and the hammer velocity. The vibration modes are respectively defined by line spectrums, and each of the line spectrums is measured on musical wires and predetermined component members of an acoustic piano upon striking with a hammer unit. The line spectrums are firstly broken down into 88 classes corresponding to the 88 keys on the keyboard 2, and each of the classes is secondary broken down into four sub-classes, i.e., non-manipulation of any pedals 5a to 5c, manipulation of the damper pedal 5a, manipulation of the muffler pedal 5b and manipulation of the soft pedal 5c. Moreover, each of the sub-classes has a plurality of line spectrums addressable with combination of a line spectrum of vibrations on the board member 6c, acceleration of a key, a key velocity and a hammer velocity.

Figure 3:
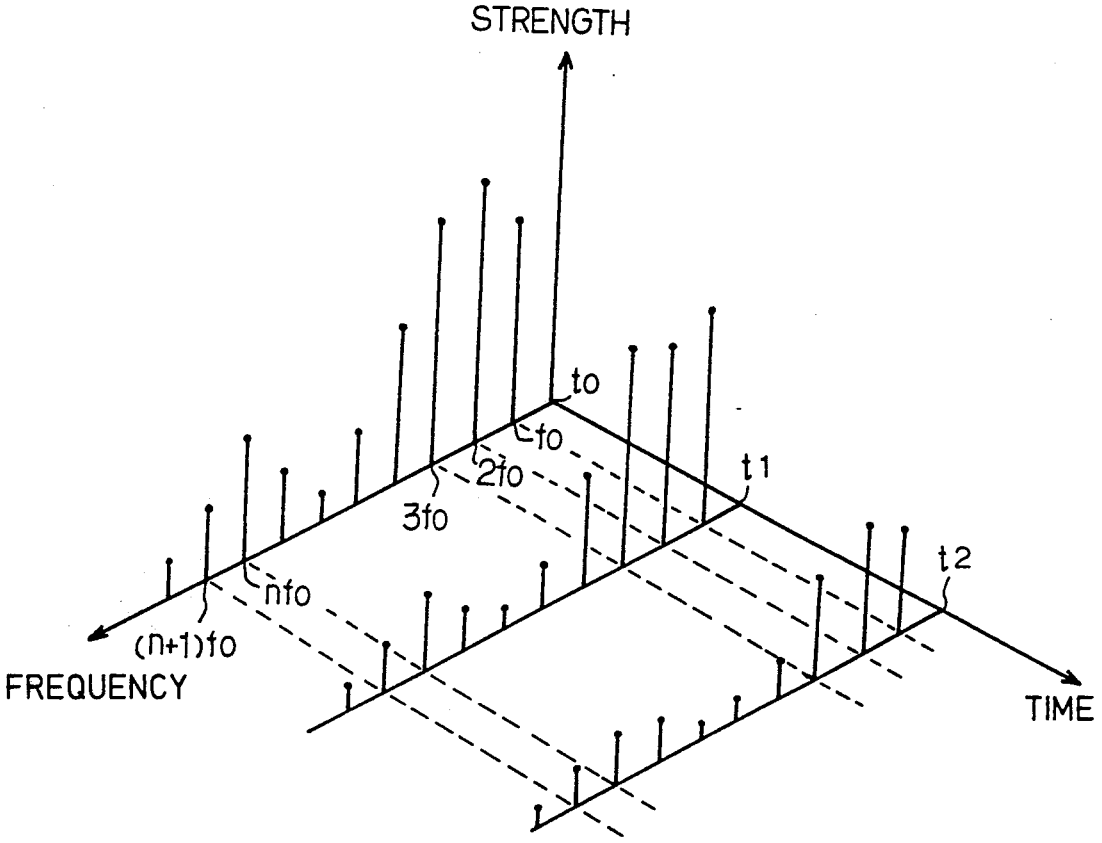
FIG. 3 is a graph showing variation of a line spectrum of vibrations on a first musical wire associated with a key of an acoustic piano in terms of lapse of time.
Figure 4:
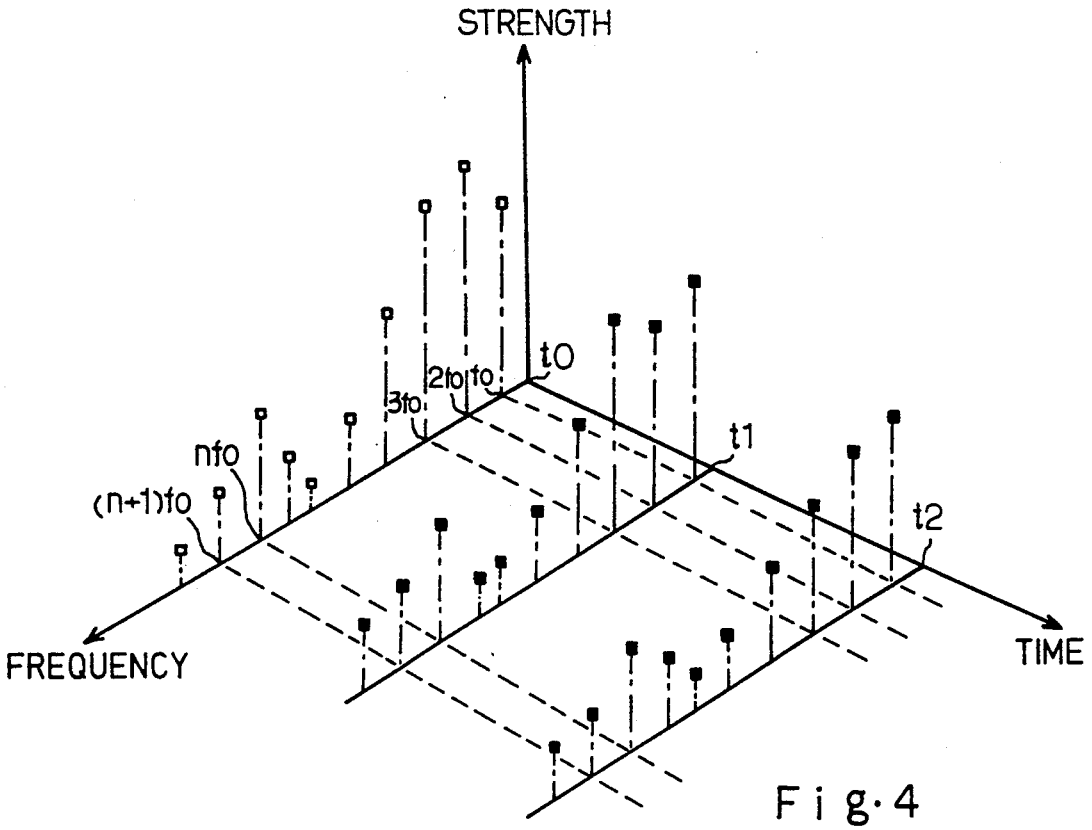
FIG. 4 is a graph showing variation of a line spectrum of vibrations on a second musical wire associated with the key in terms of lapse of time.
Figure 5:
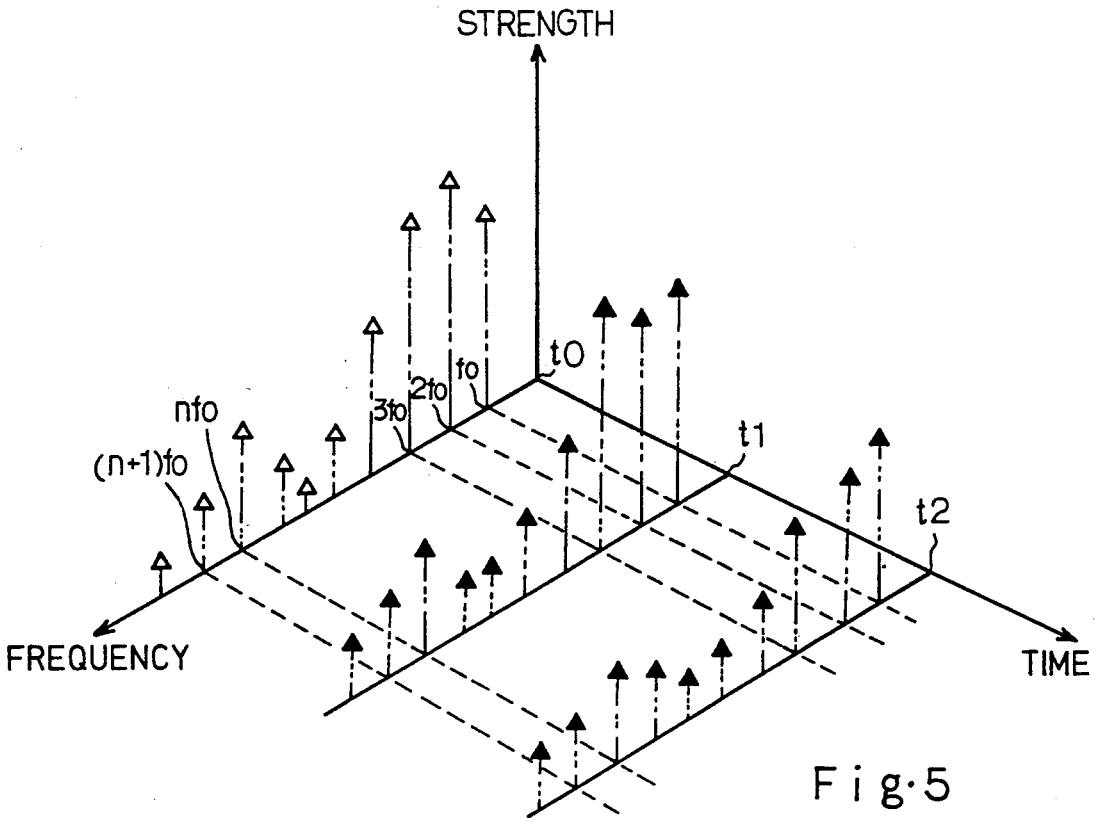
FIG. 5 is a graph showing variation of a line spectrum of vibrations on a third musical wire associated with the key in terms of lapse of time.
Figure 6:
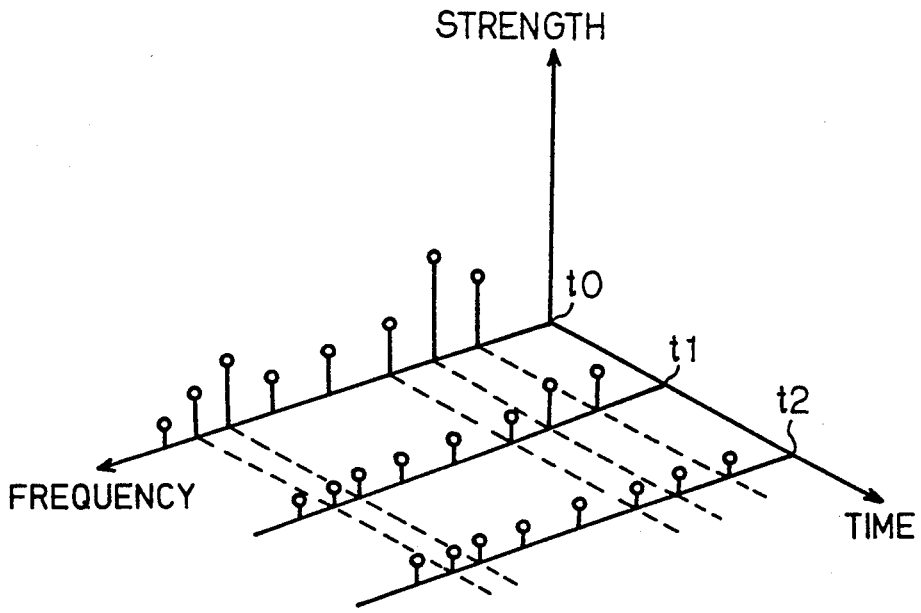
FIG. 6 is a graph showing variation of a line spectrum of vibrations on a frame of the acoustic piano in terms of lapse of time.
Figure 7:
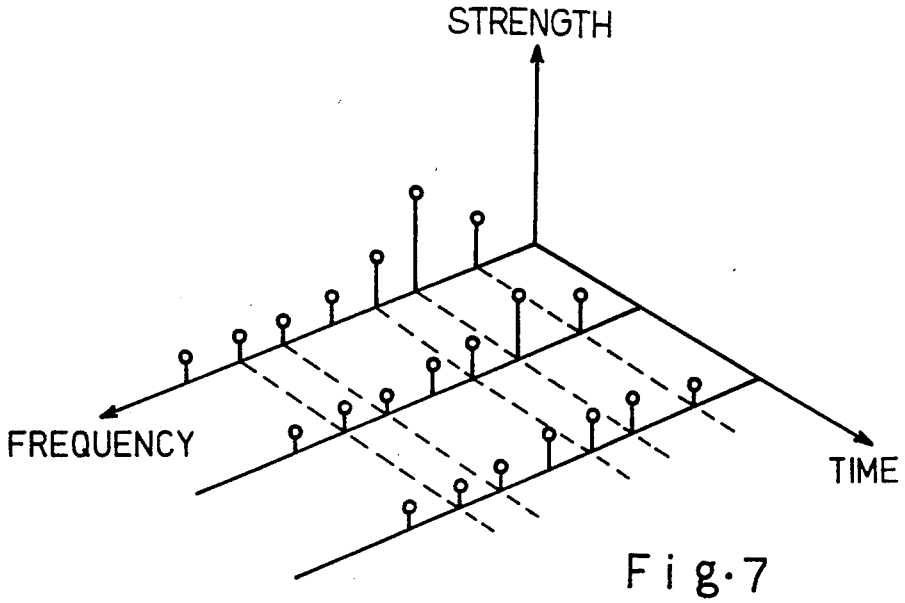
FIG. 7 is a graph showing variation of a line spectrum of vibrations on a post member for a key bed of the acoustic piano.

FIGS. 3 to 5 shows line spectrums of first to third musical wires associated with one of the keys in terms of lapse of time. Upon striking with the associated hammer unit, the first, second and third musical wires associated with the key differently vibrate, and the vibrations of the first to third musical wires are represented by respective line spectrums at time t0. Each of the line spectrums at time t0 is featured by variation of harmonic tones of a fundamental frequency f0, and the line spectrum is changed from time t0 through time t1 to time t2. However, when the line spectrums are prepared, inharmony and decay of vibrations actually produced on the musical wires are taken into account, and, for this reason, the line spectrums are idealized. Similarly, FIG. 6 shows variation of a line spectrum of vibrations on a frame of the acoustic piano upon striking the musical wires with the associated hammer, and FIG. 7 also shows variation of a line spectrum on a post member for a key bed of the acoustic piano. The vibrations on the frame and the vibrations on the post member differently vibrate under the resonance with the musical wires. Since the plurality of vibration data are used for producing the vibration mode signal, the read only memory unit 7hp stores the mode data in the form converted through the inverted Fourier transformation. Since the line spectrums of the musical wires the frame and the post member corresponds to the line spectrums produced on the board member 6c, the line spectrums of one of the sub-classes are addressable with the line spectrum signal produced through the fast Fourier transformation, and the vibration mode signal indicative of a vibration mode is produced from the line spectrums read out from the read only memory unit 7hp.

The random access memory unit 7hg provides a temporally data storage for digital signals supplied from the outside of the data processing unit, intermediate calculation results in the data processing executed by the central processing unit 7ho as well as parameters supplied from a manipulation panel (not shown), and one of the parameters is indicative of volume of sounds. The back-up random access memory unit 7hr stores default parameters in quasi non-volatile manner.

Figure 8:
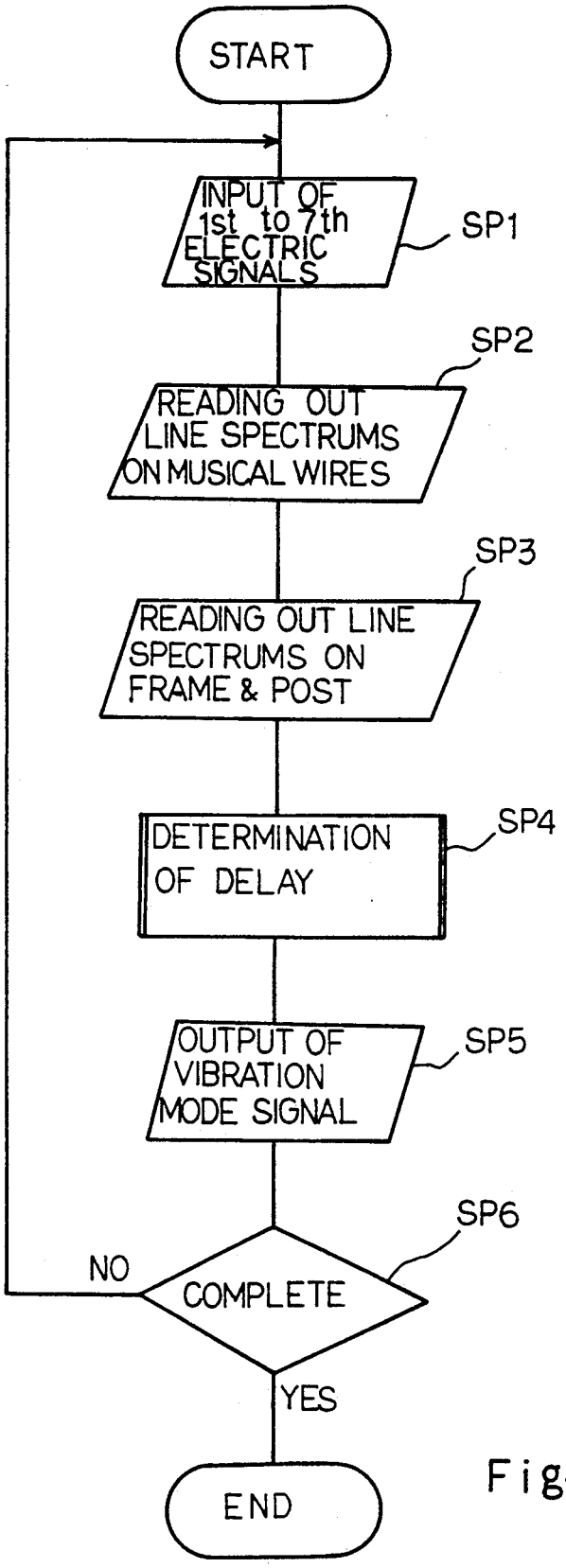
FIG. 8 is a flowchart showing a program sequence of producing a sound executed by a central processing unit incorporated in the stringless piano-touch electric sound producer.

Description is hereinbelow made on operation of the stringless piano-touch electric sound producer according to the present invention with reference to FIG. 8 of the drawings. Assuming now that the first key is depressed without any manipulation of pedals 5a to 5c, the sensor units 7a to 7g produce the first to seventh electric signals S1 to S7 at respective timings, and the first to seventh electric signals S1 to S7 are supplied to the electronic processing system 7h as by step SP1. Namely, the sensor unit 7c associated with the first key detects the first key crossing the optical path radiated therefrom, and produces the third signal S3 indicative of the lapse for crossing the optical path. The sensor unit 7d measures the acceleration of the first key, and produces the fourth electric signal S4. While the first key is depressed, the associated key action mechanism 4 drives the associated hammer unit 3 for rotation, and the sensor unit 7b detects the hammer shank 4a crossing the optical path radiated therefrom. The sensor unit 7b produces the second electric signal S2 indicative of the lapse of time for crossing the optical path. Finally, the hammer unit 3 strikes the board member 6c, and the sensor unit 7a produces the first electric signal S1 indicative of the impact energy.

The first electric signal S1 is converted to the first digital signal, and is, thereafter, subjected to the fast Fourier transformation so that the line spectrum signal indicative of the vibration actually produced on the board member 6c is produced. The second and third electric signals S2 and S3 are used for calculating the hammer velocity and the key velocity, and the second and third digital signals are supplied to the interface unit 7ht of the data processing unit 7ha together with the third electric signal S3. Since any pedals 5a to 5c is not depressed, the fifth to seventh electric signals S5 to S7 remain in an inactive level. The central processing unit 7ho checks the third and fifth to seventh electric signals S3 and S5 to S7 to decide from what sub-class line spectrums should be read out. The third and fifth to seventh electric signals S3 and S5 to S7 are indicative of the sub-class assigned to the non-manipulation of the class which in turn is assigned to the first key. Then, the central processing unit 7ho accesses the selected subclass by using the line spectrum signal as an address, and the line spectrums indicative of the vibrations on the first to third musical wires are read out from the read only memory unit 7hp as by step SP2. Similarly, the central processing unit 7ho reads out the line spectrums indicative of the vibrations on the frame and the post from the read only memory unit 7hp as by step SP3.

The central processing unit 7ho checks the timing data in the read only memory unit 7hp with the key number represented by the third electric signal S3 and the hammer velocity represented by the second digital signal, and decides time delay to production of a sound as by step SP4. The central processing unit 7ho forms the vibration mode signal from the line spectrums read out from the read only memory unit 7hp, and supplies the vibration mode signal to one of or both of the digital-to-analog converting unit 7he and the head receiver 8. If the vibration mode signal is supplied to the digital-to-analog converting unit 7he, the digital-to-analog converting unit 7he is converted into an analog vibration mode signal, and the equalizer 7hf treats the predetermined modification on the analog vibration mode signal. After amplification at the amplifier 7hg, the driver unit 7hh drives the electromagnetic actuator 7i so that vibrations takes place on the sound board 1h, thereby producing a sound. The time interval between the depressing of the first key and the production of sound is equal to or less than 5 milliseconds. Since the vibrations on the sound board 1h is similar to vibrations transferred from musical wires, a frame and a post, the sound produced by the sound board 1h is substantially identical with a sound produced upon depressing the first key of an acoustic piano.

The central processing unit 7ho checks the third electric signal to see whether or not the performance is completed as by step SP6. If the answer is negative, the central processing unit 7ho returns to step SP1, and repeats the loop consisting of steps SP1 to SP6 until the answer at step SP6 is affirmative. While repeating the loop, the central processing unit 7ho selects the subclass and the class in accordance with the third and fifth to seventh electric signals S3 and S5 to S7, and appropriate line spectrums are read out therefrom. If the answer at step SP6 is affirmative, the central processing unit 7ho knows completion of the performance, and waits for new instructions.

Since the stringless piano-touch electric sound producer shown in FIGS. 1 and 2 is equipped with the MIDI output 7hn, musical information of the performance can be transferred to an electronic musical instrument and/ or a computer system.

As will be appreciated from the foregoing description, the stringless piano-touch electric sound producer according to the present invention is small in size rather than an acoustic piano, because any musical wires and any pedal mechanisms is not necessary. Moreover, the volume of the sounds are controllable, and the player can listen to the performance through the head receiver 8 only. With this feature, the wireless piano-touch electric sound producer is convenient for a small house in a closely built-up area.

Second Embodiment

Figure 9:
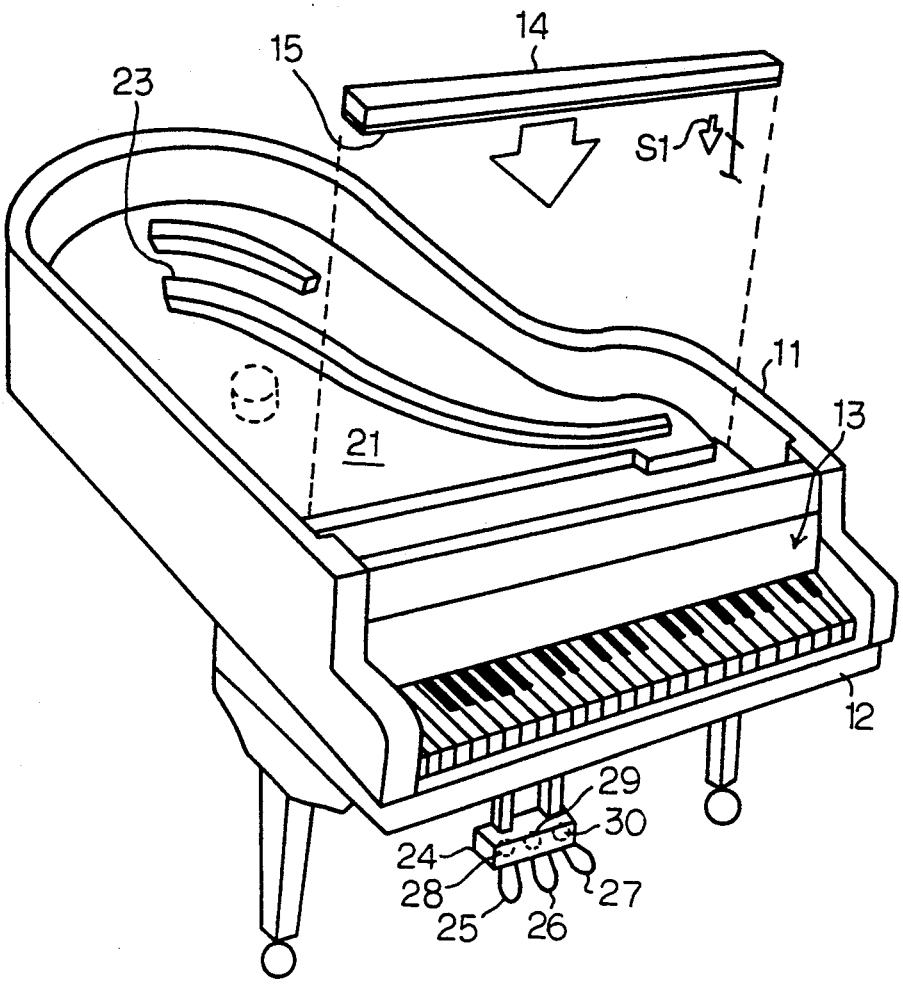
FIG. 9 is a perspective view showing, in a partially disassembled state, another stringless piano-touch electric sound producing system according to the present invention.
Figure 10:
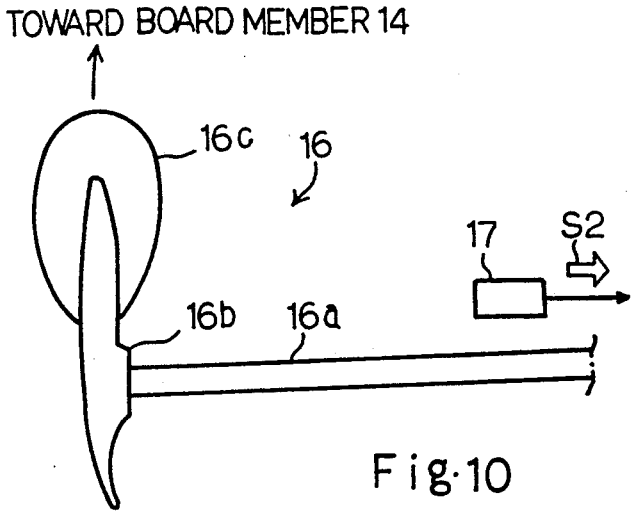
FIG. 10 is a side view showing a hammer unit incorporated in the stringless piano-touch electric sound producer shown in FIG. 9.

Turning to FIG. 9 of the drawings, another stringless piano-touch electric sound producer embodying the present invention is configured to an acoustic grand piano, and comprises a side board 11, a key bed 12 attached to the lower surface on the front side of the side board 11, and a keyboard 13 with 88 keys mounted on the key bed 12. Though not shown in FIG. 9, a plurality of key action mechanisms are provided in association with the 88 keys, and respectively drive associated hammer units for rotation upon depressing the associated keys. However, the key action mechanisms accompanied with the hammer units are well known to a person skilled in the art, and no further description is incorporated hereinbelow. Each of the keys is associated with a reflection type photo coupler which corresponds to the sensor units 7*c* of the first embodiment. However, no further description is incorporated hereinbelow for the sake of simplicity of description. A single board member 14 is provided over the hammer units instead of musical wires of an acoustic grand piano, and is shared between all the hammer units or the hammer shanks. On the bottom surface of the board member 14 is attached a sensor array 15 which is implemented by a plurality of pressure sensor units associated with the hammer units, respectively. In this instance, the pressure sensor units are of the piezo-electric transducer, and correspond to the sensor units 7*a* of the first embodiment. When the keys are depressed, the key action mechanisms drive the associated hammer units, and the hammer units impact the associated pressure sensor units on the board member 14 without a substantial amount of volume, and the sensor units struck with the hammer units produce first electric signals S1 each indicative of the impact force applied from the associated hammer unit. The motion of each hammer unit is further monitored. FIG. 10 shows one of the hammer units 16, and the hammer unit 16 comprises a hammer shank 16*a*, a hammer wood 16*b* attached to the leading end of the hammer shank 16*a* and a hammer top rubber 16*c* fixed to the hammer wood 16*b*. In an acoustic piano, a hammer top felt is usually attached to a hammer wood, and the hammer top felt is replaced with the hammer top rubber 16*c* in the second embodiment. Since the hammer unit 16 associated with the key action mechanism is used for imparting the piano-touch to a player, it is important for the hammer unit 16 to have the same weight as the hammer unit of the acoustic piano, and the material and the size of the hammer top member are less important for the piano-touch. For this reason, the hammer top rubber may be a similar or congruent figure to the hammer top felt of the acoustic piano, and any visco-elastic body such as rubber, felt or polymer is available for the hammer top member. A reflection type photo coupler 17 is provided for the hammer unit 16, and an optical path radiated therefrom crosses the locus of the hammer shank 16*a*. When the hammer unit 16 is driven for rotation, the hammer shank 16*a* reflects the light radiated from the light emitting diode of the photo coupler 17 on the way toward the board member 14, and the photo transistor of the photo coupler 17 detects the reflection from the hammer shank 16*a*. With the reflection, the photo coupler 17 produces a second electric signal S2 indicative of lapse of time for interrupting the optical path, and the photo-coupler corresponds to one of the sensor units 7*b* of the first embodiment. The second electric signal S2 is used for calculating hammer velocity, and the hammer velocity may be carried by a MIDI signal. The other hammer units are similar to the hammer unit 16, and are accompanied with photo couplers, respectively. However, no further description is incorporated hereinbelow for avoiding repetition.

Figure 11:
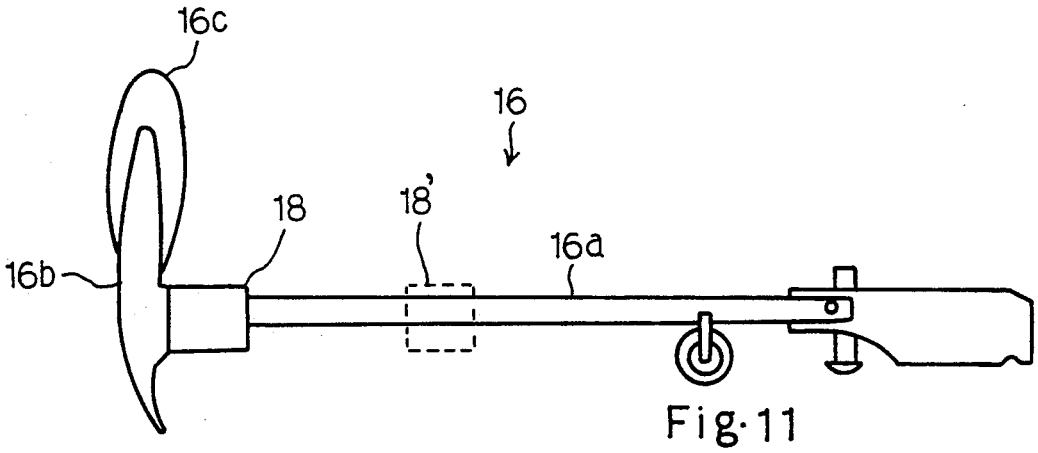
FIG. 11 is a side view showing another hammer unit used in a stringless piano-touch electric sound producer.
Figure 12:
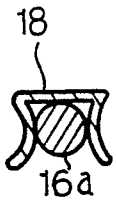
FIG. 12 is a cross sectional view showing a weight member snapped onto the hammer unit shown in FIG. 11.
Figure 13:
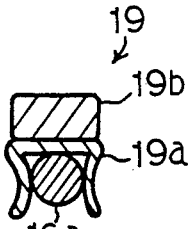
FIG. 13 is a cross sectional view showing another weight member snapped onto the hammer unit.
Figure 14:
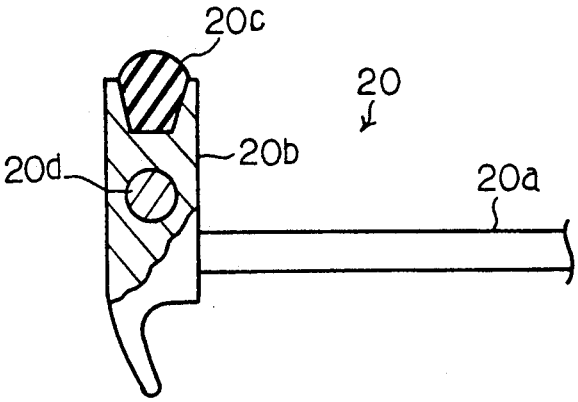
FIG. 14 is yet another hammer unit used in a stringless piano-touch electric sound producer according to the present invention.

As described hereinbefore, the piano-touch is strongly affected by the weight of a hammer unit, and a weight member 18 shown in FIG. 11 allows the hammer unit 16 to be scaled down. The weight member 18 is regulable in relative position to the hammer shank 16*a*. If the hammer unit 18 is associated with a key assigned to a low pitch tone, the weight member 18 is attached to a closer position to the hammer wood 16*b*, and causes the player to feel the key relatively heavy. On the other hand, if the hammer unit 16 is associated with a key assigned to a high pitch tone, the weight member 18 is moved to a position 18′ spaced from the hammer wood 16*b*, and the player feels the key relatively light. Thus, the weight member 18 is regulable, and keys on the keyboard 13 can exactly simulate respective key-touches of the individual keys of an acoustic piano. In this instance, the weight member 18 is made of steel or lead, and is shaped as shown in FIG. 12. A steel weight member 18 can snap the hammer shank 16*a*, and a manufacturer can easily regulate the position on the hammer shank 16*a*. However, another weight member 19 may be implemented by a snap member 19*a* and an additional weight 19*b* fixed to the snap member 19*a* as shown in FIG. 13. FIG. 14 shows yet another hammer unit 20 incorporated in a stringless piano-touch electric sound producer according to the present invention. The hammer unit 20 comprises a shammer shank 20*a*, a hammer wood 20*b*, a hammer top member 20*c* of a visco-elastic body attached to one end of the hammer wood 20*b*, and a weight member 20*d* embedded into the central portion of the hammer wood 20*b*. If the weight member 18, 19 or 20*d* is fixed to the hammer unit 16 or 20, the hammer unit 16 or 20 can be scaled down, and the stringless piano-touch electric sound producer according to the present invention is decreased in size.

Figure 15:
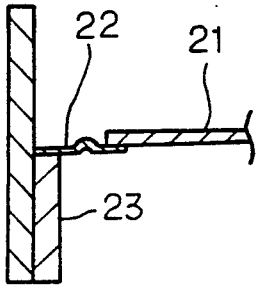
FIG. 15 is a cross sectional view showing the connection mechanism for a sound board incorporated in the stringless piano-touch electric sound producer shown in FIG. 9.
Figure 16:
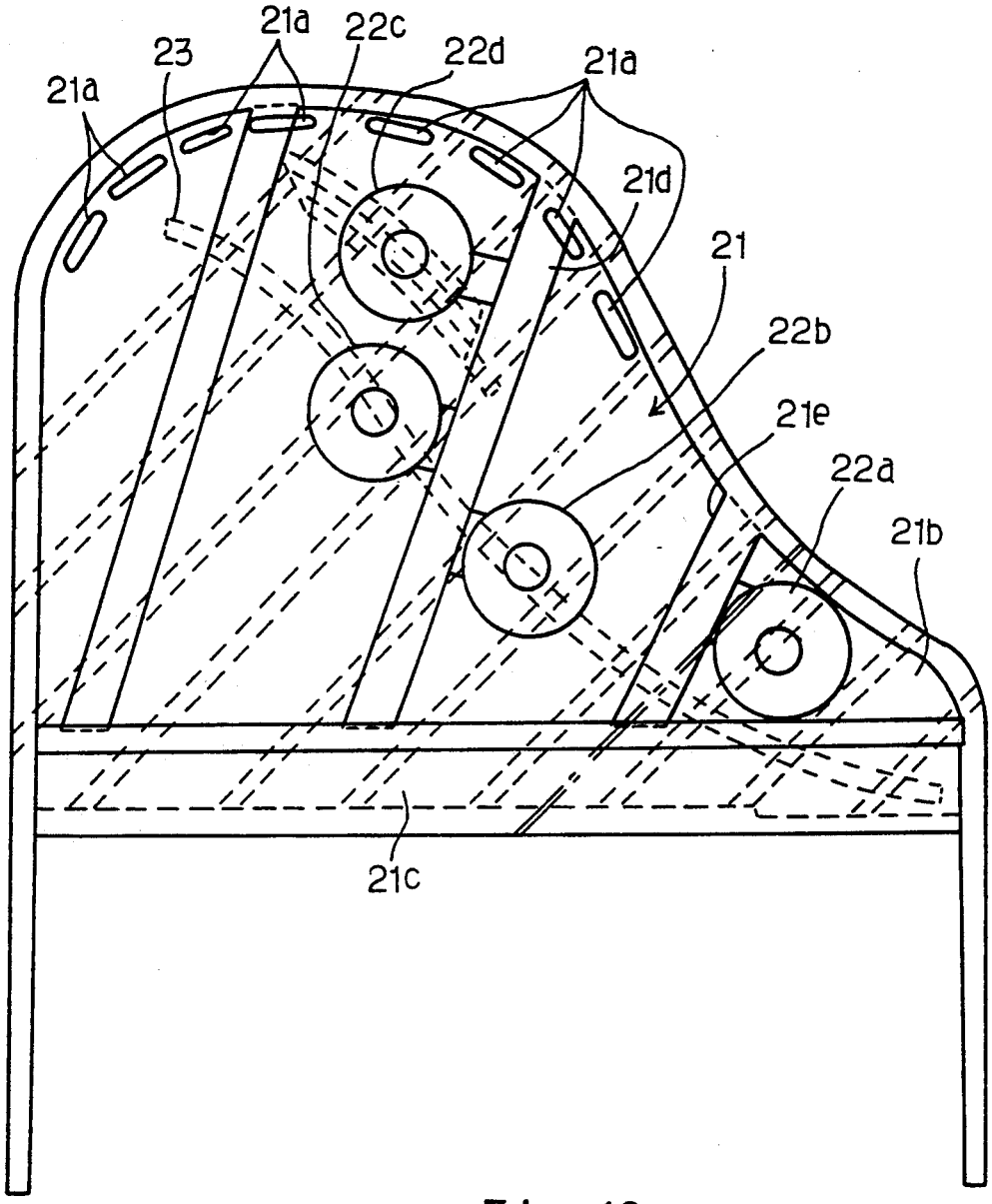
FIG. 16 is a bottom side view showing the structure around the sound board.

Turning back to FIG. 9 of the drawings, a sound board 21 is accommodated in and supported by the side board 11. Any musical wire is stretched over the sound board 21, because musical wires of an acoustic piano are replaced with the board member 14. For this reason, the stringless piano-touch electric sound producer implementing the second embodiment is surely scaled down by virtue of the board member 14. The sound board 21 is supported through a corrugation members 22 by a post members 23, and FIG. 15 shows one of the corrugation members 22 associated with the post member 23. As will be better seen from FIG. 16, elongated holes 21*a* are formed in peripheral area of the sound board 21, and the sound board 21 is split into two sound board members 21*b* and 21*c*. The sound board member 21*b* has relatively small amount of area for high piteh tones, and the sound board member 21*c* has relatively large amount of area for low pitch tones. The aforesaid elongated holes 21*a* are formed in the sound board member 21*c* for the low pitch tones. Four electromagnetic actuators 22*a*, 22*b*, 22*c* and 22*d* are provided for the sound board members 21*b* and 21*c*, and are supported by ribs 21*d* and 21*e*. Each of the electromagnetic actuators 22*a* to 22*d* may be implemented by a moving coil type magnetic circuit. A treble bridge 23 extends on the sound board 21; however, the treble bridge 23 may be cut and shortened depending upon the sound board members 21*b* and 21*c*.

Turning back to FIG. 9 of the drawings, a pedal box 24 is suspended from a lyre block (not shown) attached through a bottom beam (not shown) to the key bed 12, and three pedals, i.e., a soft pedal 25, a muffler pedal 26 and a damper pedal 27 are rockablly supported by the pedal box 24. A soft pedal, a muffler pedal and a damper pedal of an acoustic piano are coupled with respective pedal mechanisms; however, the soft, muffler and damper pedals 25 to 27 are associated with three sensor units 28, 29 and 30 only. The sensor units 28 to 30 correspond to the sensor units 7*e* to 7*g* of the first embodiment, respectively, and produce electric signals indicative of manipulations of the pedals 25 to 27, respectively.

Figure 17:
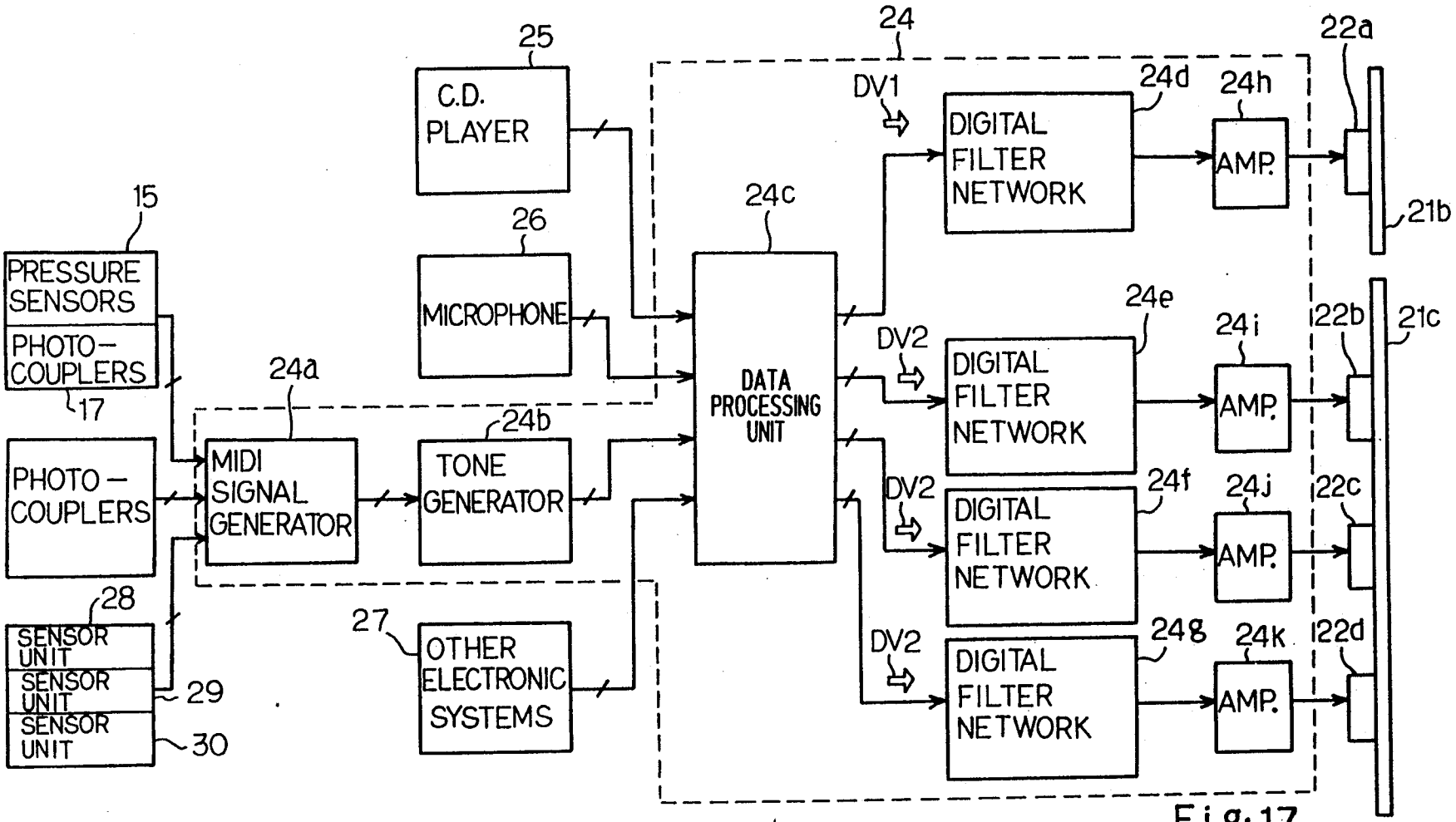
FIG. 17 is a block diagram showing the circuit arrangement of an electric system incorporated in the stringless key-touch electric sound producer shown in FIG. 9.

Thus, the key motion, the hammer motion and the pedal motion are monitored by the three groups of the sensor units, i.e., the pressure sensor array 15/ the photo couplers 17 for the hammer units 16, the photo-couplers for the keyboard 13, and the sensor units 28 to 30 for the pedals 25 to 27. These three groups of the sensor units form parts of an electric system, and FIG. 17 shows the arrangement of the electric system. The electric system incorporated in the stringless piano-touch electric sound producer implementing the second embodiment largely comprises the three groups of the sensor units 15, 17, 28, 29 and 30, an electronic data processing system 24 and the electromagnetic actuators 22*a* to 22*d*. However, the electronic data processing system 24 is communicable with a compact disk player 25, a microphone 26 and other electronic systems 27 such as an electronic musical instrument and a computer system.

The electronic data processing system comprises a MIDI signal generator 24*a* supplied with electric signals and selectively converting into MIDI digital codes. The MIDI codes are supplied to a tone generator 24*b*, and tone generator 24*b* produces digital tone signals. The digital tone signals are supplied to a data processing unit 24*c*, and the data processing unit 24*c* produces digital vibration signals DV1 and DV2 through a predetermined operation. The data processing unit 24*c* corresponds to the data processing unit 7*ha*, and a read only memory unit of the data processing unit 24*c* stores a program sequence, timing data and a plurality of line spectrums as similar to the read only memory unit 7*hp*. Namely, the read only memory unit stores the program sequence fetched and executed by a central processing unit of the data processing unit 24*c*, the timing data as well as a plurality of mode data indicative of various vibration modes, respectively. The timing data define delay of sounds, and are accessible with combination of a key number and the hammer velocity. The vibration modes are respectively defined by line spectrums, and each of the line spectrums is measured on musical wires and predetermined component members of an acoustic piano upon striking with a hammer unit. The line spectrums are firstly broken down into 88 classes corresponding to the 88 keys on the keyboard 13, and each of the classes is secondary broken down into four subclasses, i.e., non-manipulation of any pedals 25 to 27, manipulation of the damper pedal 25, manipulation of the muffler pedal 26 and manipulation of the soft pedal 27. Moreover, each of the sub-classes has a plurality of line spectrums addressable with the digital tone signal supplied from the tone generator 24*b*. In the first embodiment, the line spectrums are finally selected by using the line spectrum signal indicative of the vibrations produced on the board member 6*c*. However, the data processing unit 24*c* finally selects line spectrums with the digital tone signal supplied from the tone generator 24*b*.

Figure 18:
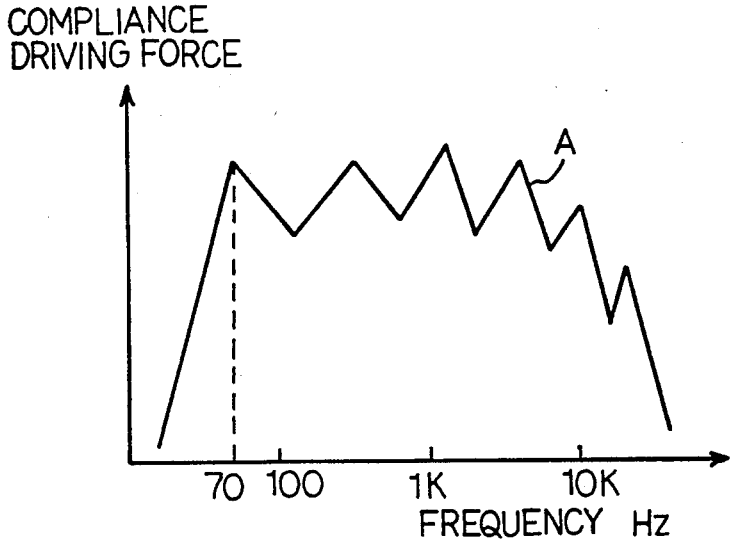
FIG. 18 is a graph showing the frequency characteristics of the sound board shown in FIG. 16.
Figure 19:
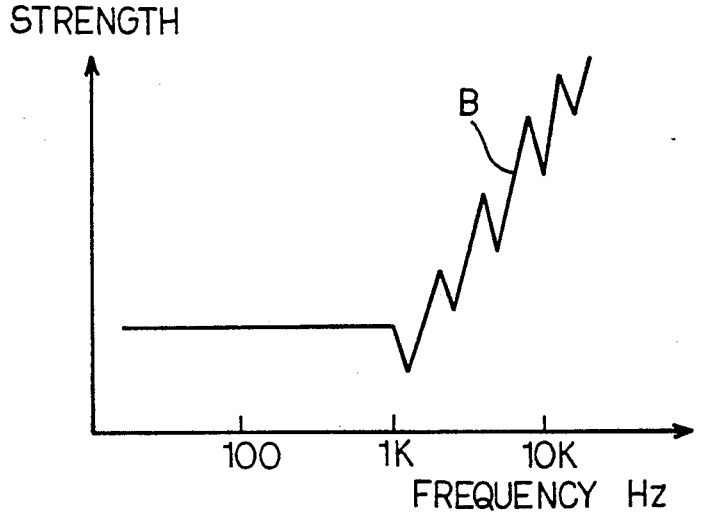
FIG. 19 is a graph showing the frequency characteristics of a digital filter network for the sound board member assigned to high pitch tones.
Figure 20:
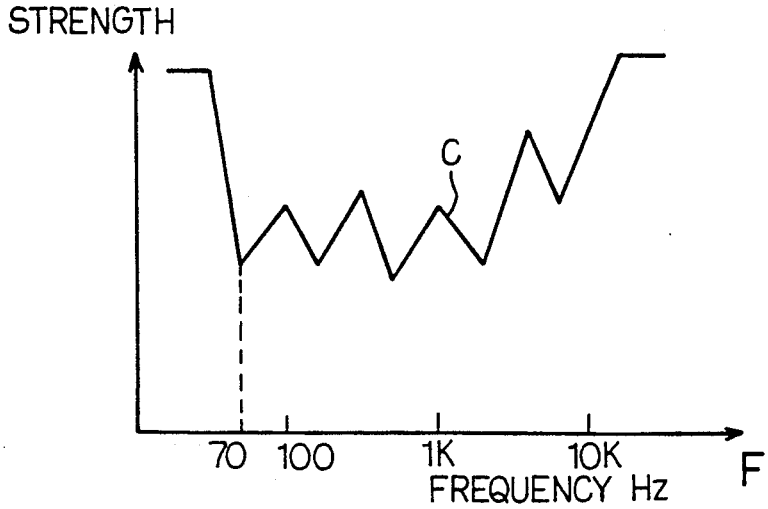
FIG. 20 is a graph showing the frequency characteristics of digital filter networks for the sound board member assigned to low pitch tones.

The digital vibration signal DV1 is used for driving the sound board member 21*b*, and is supplied to a digital filter network 24*d*. On the other hand, the digital vibration signal DV2 is used for the sound board member 21*c*, and is distributed to digital filter networks 24*e*, 24*f* and 24*g*. In this instance, all of the digital filter networks 24*d* to 24*g* are of a band-pass filter, and the digital filter network 24*d* is different in frequency characteristics from the digital filter networks 24*e* to 24*g*. In detail, the sound board 21 has frequency characteristics shown in FIG. 18, the digital filter network 24*d* largely covers the vibrations higher than about 1 kHz, and has frequency characteristics shown in FIG. 19. Comparing plots A over 1 kHz in FIG. 18 with plots B over 1 kHz in FIG. 19, the plots A and B vary in opposite tendency. On the other hand, the digital filter networks 24*e* to 24*g* have frequency characteristics shown in FIG. 20, and plots C in FIG. 20 also show opposite tendency to plots A. For this reason, the digital vibration signals DV1 and DV2 are modified by the digital filter networks 24*d* to 24*g* in accordance with the frequency characteristics of the sound board 21, and the modified digital vibration signals are supplied to respective amplifier units 24*h*, 24*i*, 24*j* and 24*k*. The modified digital vibration signals are converted into corresponding analog driving signals, and are increased in magnitude. The analog driving signals amplified by the amplifier units 24*h* to 24*k* are supplied to the electromagnetic actuator units 22*a* to 22*d*, and the electromagnetic actuator units 22*a* to 22*d* drive the associated sound board members 21*b* and 21*c* so as to produce vibrations produced upon depressing a key of an acoustic piano. In this instance, the time interval between depressing a key and the production of a sound is not longer than about 5 milliseconds.

Description is briefly made on operation of the stringless piano-touch electric sound producer implementing the second embodiment. Assuming now that one of the keys on the keyboard 13 is depressed without any manipulation of pedals 25 to 27, the associated sensor units produce the electric signals at respective timings, and the electric signals are supplied to the electronic processing system 24. Namely, the sensor unit associated with the key detects the first key crossing the optical path radiated therefrom, and produces the electric signal indicative of the lapse of time for crossing the optical path. While the key is depressed, the associated key action mechanism drives the associated hammer unit for rotation, and the sensor unit 17 detects the hammer shank 16*a* crossing the optical path radiated therefrom. The sensor unit 17 produces the electric signal S2 indicative of the lapse of time for crossing the optical path. Finally, the hammer unit 16 strikes the board member 14, and the sensor unit 15 produces the electric signal S1 indicative of the impact energy. The electric signals supplied from the photo couplers are used for calculating the key velocity and the hammer velocity, and all of the electric signals are finally supplied to the data processing unit 24*c*. The data processing unit 24*c* selects line spectrums from the read only memory unit as similar to the first embodiment, and the digital vibration signals DV1 and DV2 are delivered from the data processing unit at a suitable timing selected from the timing data stored in the read only memory unit. the digital vibration signals DV1 and DV2 are modified by the associated digital filter networks 24*d* to 24*g* as described hereinbefore, and the amplifier units 24*h* to 24*k* drive the electromagnetic actuators 22*a* to 22*d* with the analog driving signals. When vibrations take place on the sound board members 21*b* and 21*c*, a sound is produced from the sound board 21, and is substantially identical with the sound produced in an acoustic piano.

Since the digital vibration signals DV1 and DV2 are modified by the digital filter networks 24*d* to 24*g* in accordance with the frequency characteristics of the sound board members 21*b* and 21*c*, the sounds are much closer to those of an acoustic piano. Especially, low pitch tones are improved through the modification. This is because of the fact that musical wires and frames are removed from the stringless piano-touch electric sound producer implementing the second embodiment, and the resonant frequency f0 is lowered to about 70 Hz. Moreover, the sound board 21 is loosely supported by means of the corrugation members 22, and the corrugation members 22 serve as an edge portion of a loud speaker. The elongated holes 21*a* are further conducive to improvement of the sounds. The sound board 21 is split into the two sound board members 21*b* and 21*c*, and this separation improves high pitch tones.

Figure 21:
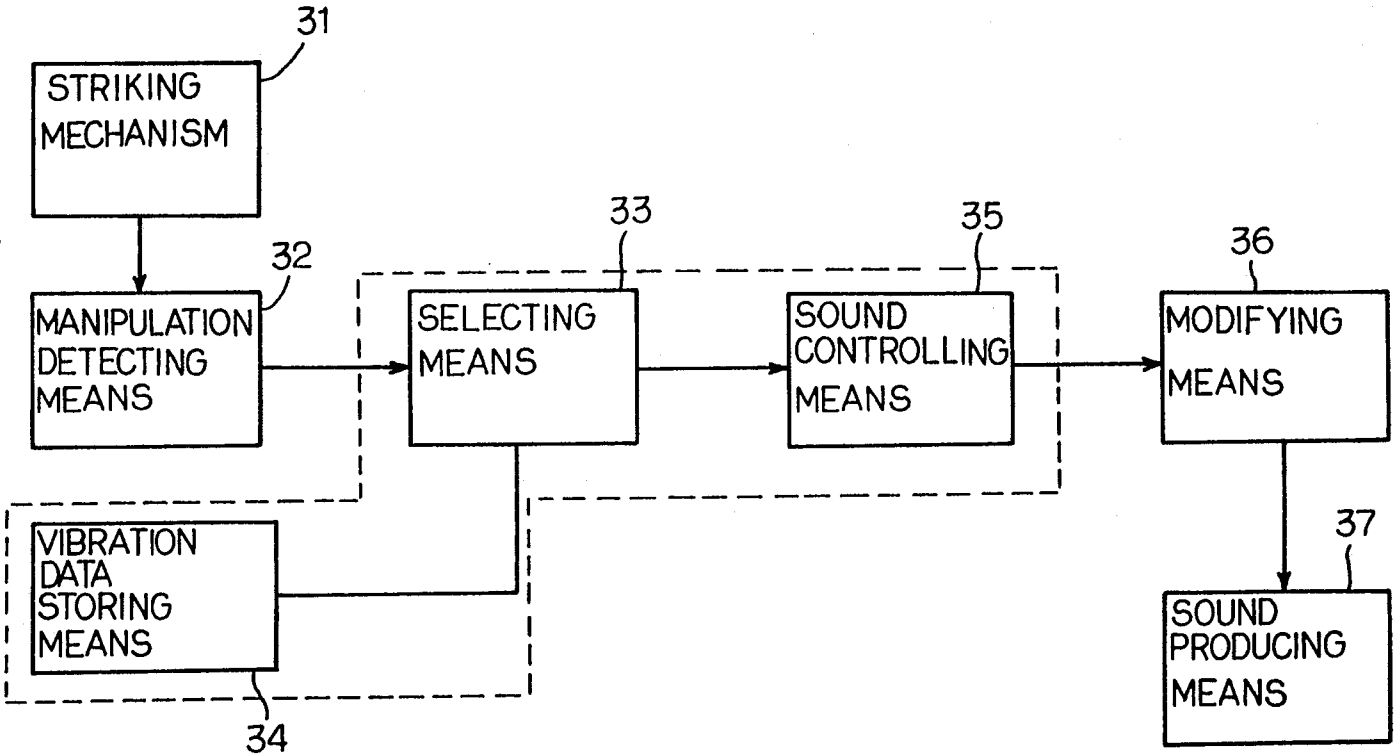
FIG. 21 is a block diagram showing the general arrangement of the stringless piano-touch electric sound producer shown in FIG. 9.

The above described operation can be summarized as a block diagram shown in FIG. 21. Namely, the keyboard 13, the key action mechanisms and the hammer units 16 form in combination a striking mechanism 31, and motion of the striking mechanism 31 is detected by a manipulation detecting means 32 implemented by the sensor units 15 and 17. The manipulation detecting means 32 reports the motion of the striking mechanism 31 to a selecting means 33, and the selecting means 33 selects one of the vibration data stored in a vibration data storing means 34. The selected one of the vibration data is supplied to a sound controlling means 35, and the sound controlling means 35 produces vibration signals. The selecting means 33, the vibration data storing means 34 and the sound controlling means 35 are implemented by the combination of the MIDI signal generator 24*a*, the tone generator 24*b* and the data processing unit 24*c*. The vibration signals thus produced by the sound controlling means 35 are supplied to a modifying means 36, and the modifying means 36 is implemented by the digital filter networks 24*d* to 24*g* different in the frequency characteristics from one another. The modified vibration signals are supplied to a sound producing means 37, and the amplifier units 24*h* to 24*k* and the electromagnetic actuators 22*a* to 22*d* as a whole constitute the sound producing means 37.

A woofer may be provided as an auxiliary speaker, and a tweeter may be used therein. Calculations of line spectrums may be real time.

As will be understood from the foregoing description, the stringless piano-touch electric sound producer implementing the second embodiment is small in size rather than an acoustic piano, because any musical wires and any pedal mechanisms is not necessary. Moreover, the volume of the sounds are controllable, and the player can privately listen to the performance. With this feature, the stringless piano-touch electric sound producer is convenient for a small house in a closely built-up area. Moreover, the sound board 21 split into the sound board members 21*b* and 21*c* effectively improves quality of sounds, and the digital filter networks 24*d* to 24*g* further improve the quality of sounds.

Figure 22:
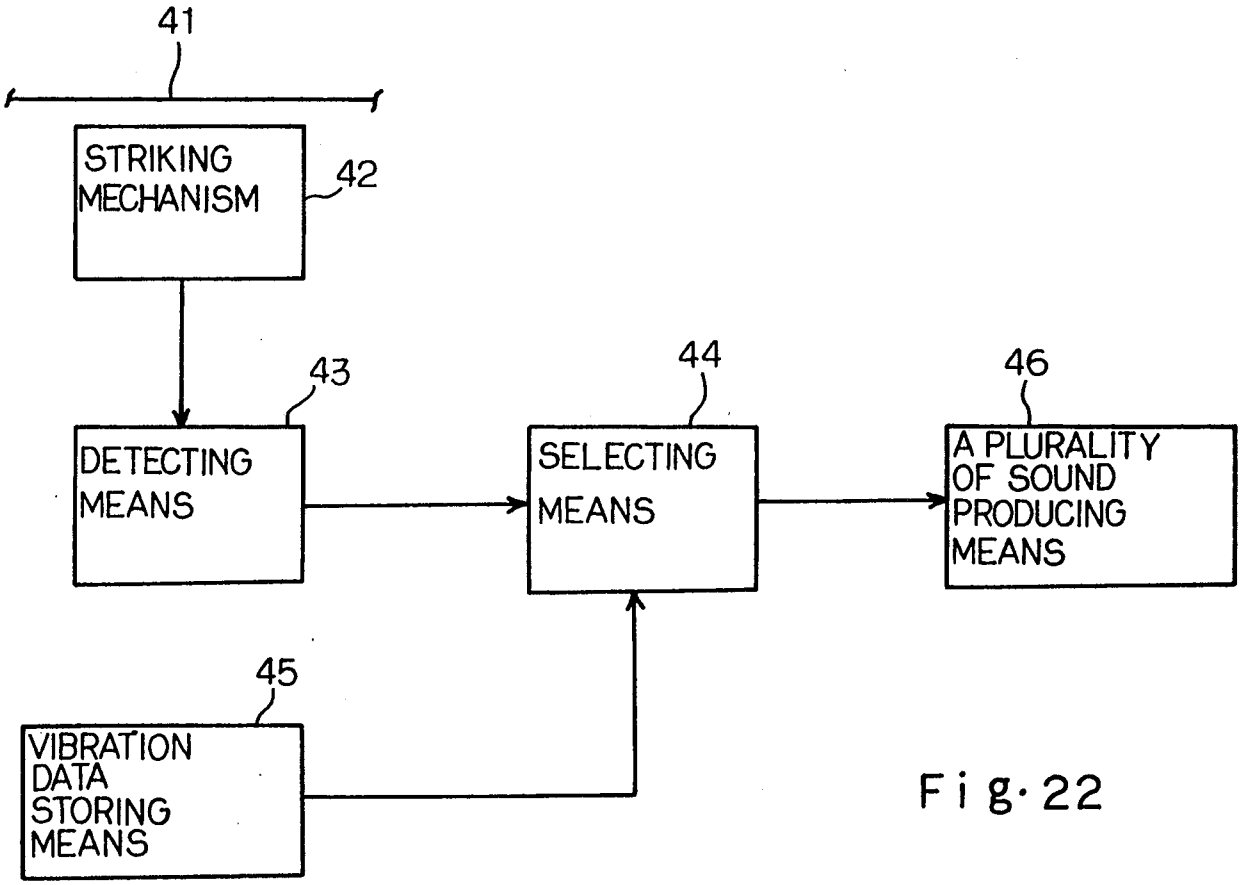
FIG. 22 is a block diagram showing the arrangement of a piano-touch electric sound producer.
Figure 23:
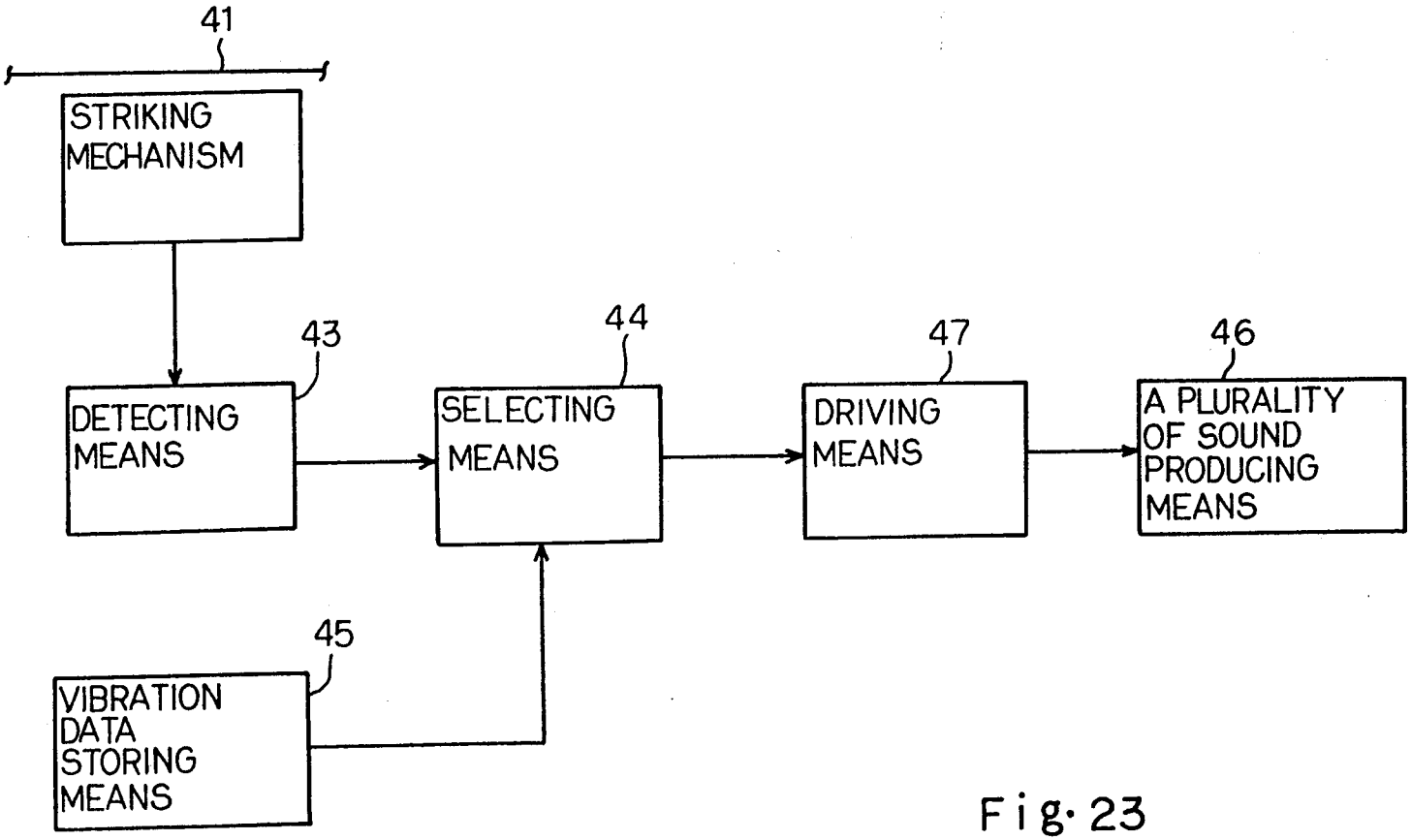
FIG. 23 is a block diagram showing the arrangement of another piano-touch electric sound producer.

However, a sound board split into a plurality of sound board members effectively improves quality of sounds, and a piano-touch electric sound producer with musical wires may be fabricated for the sake of improvement in quality of sounds. FIG. 22 shows an arrangement of a piano-touch electric sound producer with musical wires, and the piano-touch electric sound producer comprises a plurality of musical wires 41 associated with a striking mechanism 42. The striking mechanism 42 is fabricated from a keyboard with a plurality of white and black keys, key action mechanisms and hammer units, and various detecting means 43 is provided for the striking mechanism 42. The detecting means 43 may include a plurality of photo couplers for detecting key velocity, a plurality of acceleration pick-up units for detecting acceleration, a plurality of photo couplers for detecting hammer velocity and a plurality of pressure sensors for detecting impact force. The detecting means 43 reports the motion of the striking mechanism 42 to a selecting means 44 implemented by a data processing unit, and the selecting means 44 selects vibration data stored in a vibration data storing means implemented by a memory unit. The selected vibration data are selectively supplied to a plurality of sound producing means 46, and the plurality of sound producing means 46 are implemented by sound board members different in frequency characteristics. A driving means 47 may be coupled between the selecting means 44 and the plurality of sound producing means 46 as shown in FIG. 23.

Third Embodiment

Figure 24:
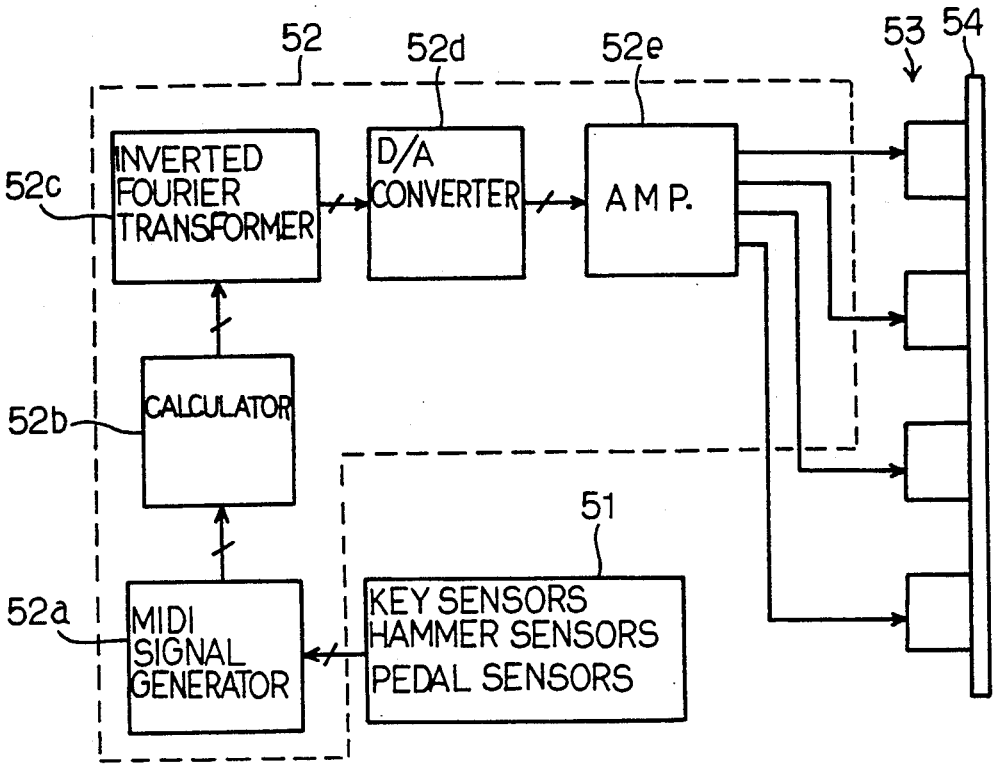
FIG. 24 is a block diagram showing the circuit arrangement of an electric system incorporated in yet another stringless piano-touch electric sound producer.

Turning to FIG. 24 of the drawings, there is shown an electric system incorporated in yet another stringless piano-touch electric sound producer, and the electric system largely comprises sensor arrays 51, an electronic data processing system 52 and a plurality of electromagnetic actuator units 53 attached to a sound board 54. The sensor arrays 51 include key sensor units respectively associated with keys on a key board (not shown), hammer sensor units respectively associated with hammer units (not shown) driven by key action mechanisms (not shown), and pedal sensor units respectively associated with damper, muffler and soft pedals (not shown). The sensor arrays 51 behave as similar to those of the second embodiment, and no further description is incorporated for the sake of simplicity.

The electronic data processing system 52 comprises a MIDI signal generator 52*a* responsive to the electric signals supplied from the sensor arrays 51, and MIDI code signals are supplied from the MIDI signal generator 52*a* to a calculator 52*b*. The calculator 52*b* simulates vibrations of musical wires incorporated in an acoustic piano o the basis of the MIDI code signals, and determines frequency characteristics of the musical wires. The simulation is carried out on the assumption that the acceleration characteristics of the sound board 54 is flat over the frequency. If ejwt and f0 are respectively indicative of an input at the impact point on a musical wire and an output at an associated bridge between the musical wire and the sound board, the frequency characteristics R(w) is given as Equation 1

$$R(w)=f0\ (w,\ t)/ejwt \qquad \text{Equation 1}$$

Figure 25:
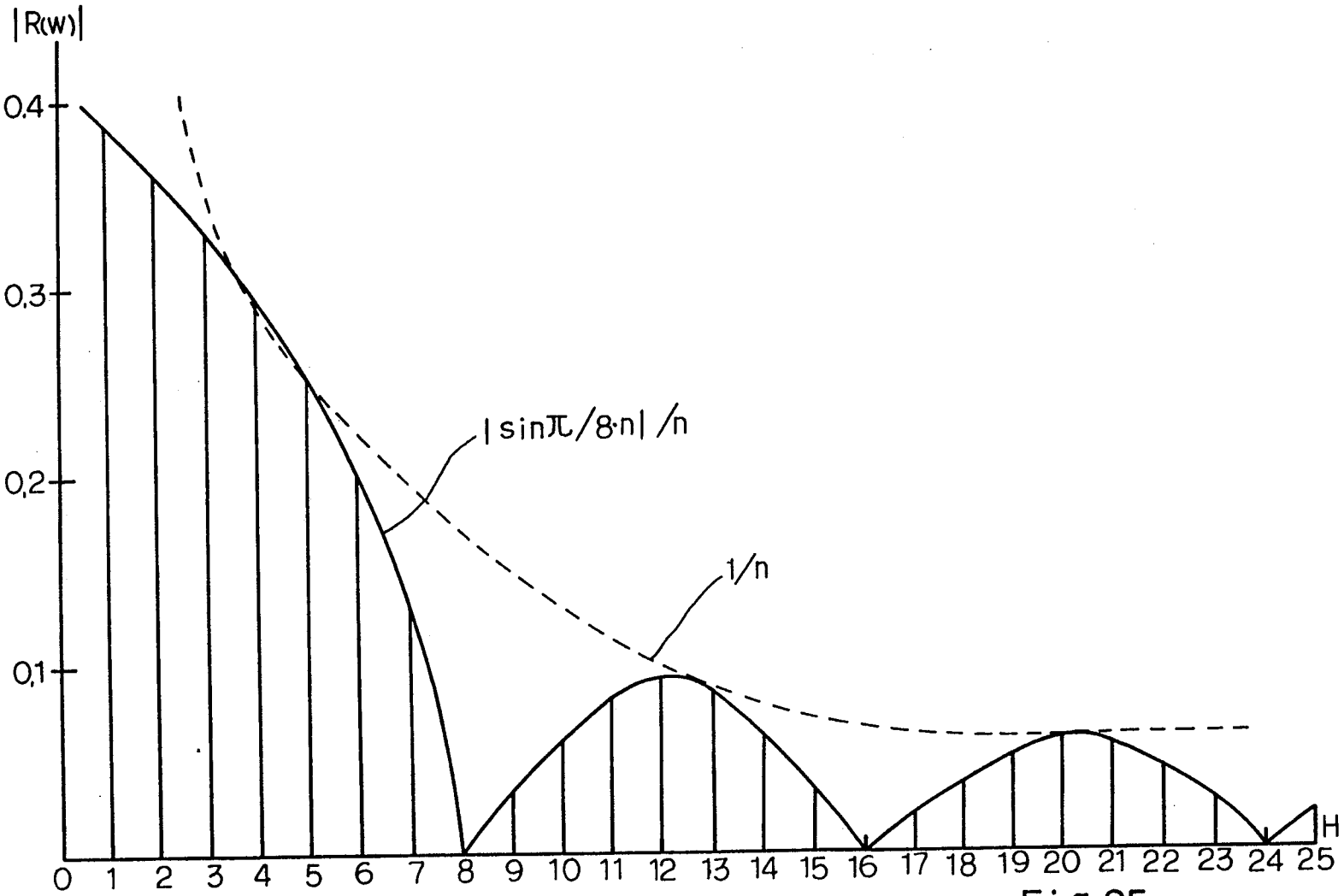
FIG. 25 is a graph showing a line spectrum of vibrations of a musical string.

If an impact ratio is 8, the line spectrum indicative of the simulated frequency characteristics has non-vibration points at multiples of 8 as shown in FIG. 25. Thus, the calculator 52*b* simulates the vibration on musical wires, and supplies a digital line spectrum signal to an inverted Fourier transformer 52*c*. The inverted Fourier transformer 52*c* supplies a digital vibration signal to a digital-to-analog converting unit 52*d*, and the digital vibration signal is converted into an analog driving signal. The analog driving signal is increased in magnitude by an amplifier unit 52*e*, and is distributed to the electromagnetic actuator units 53 for producing vibrations on the sound board 54.

Thus, the acceleration characteristics of the sound board 54 is taken into account, and the line spectrum of vibrations on musical wires are simulated by the calculator 52*b*. For this reason, the analog driving signals allow the sound board 54 to reproduce the vibrations on a sound board incorporated in an acoustic piano. This results in improvement of quality of sounds.

Figure 26:
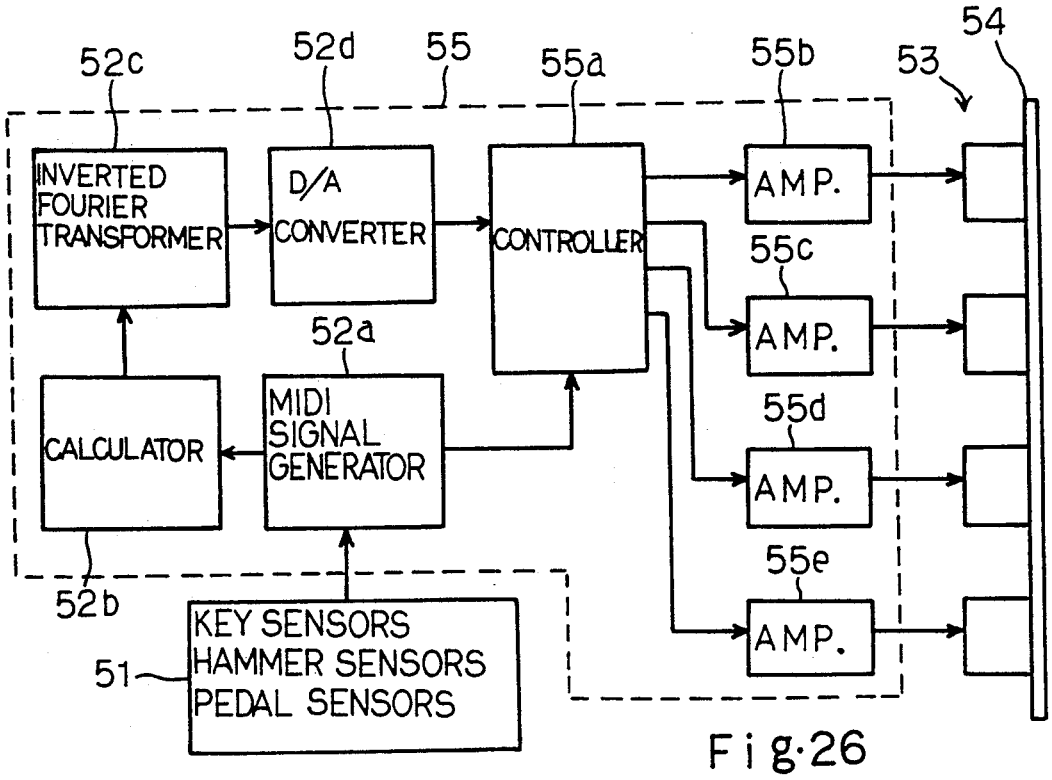
FIG. 26 is a block diagram showing the circuit arrangement of another electric system replaceable with that shown in FIG. 24.

FIG. 26 shows a modification of the electronic data processing system, and the modification is designated in its entirety by reference numeral 55. In the electronic data processing system 55, a controller 55*a* is coupled with the digital-to-analog converting unit 52*d*, and the analog driving signal is supplied to the controller 55*a*. The controller 55*a* is responsive to the analog driving signal from the digital-to-analog converting unit 52*d*, and produces a plurality of analog driving signals respectively modified in consideration of frequency characteristics of the sound board 54. This is because of the fact that a sound board is different in frequency characteristics depending upon frequency of vibrations. The plurality of analog driving signals are respectively assigned frequency ranges, and are supplied to a plurality of amplifier units 55*b* to 55*e*. With the analog driving signals, the electromagnetic actuators 53 drive the sound board 54 with different acceleration energies, and a sound produced from the sound board 54 is much closer to a sound produced in an acoustic piano.

Fourth Embodiment

Figure 27:
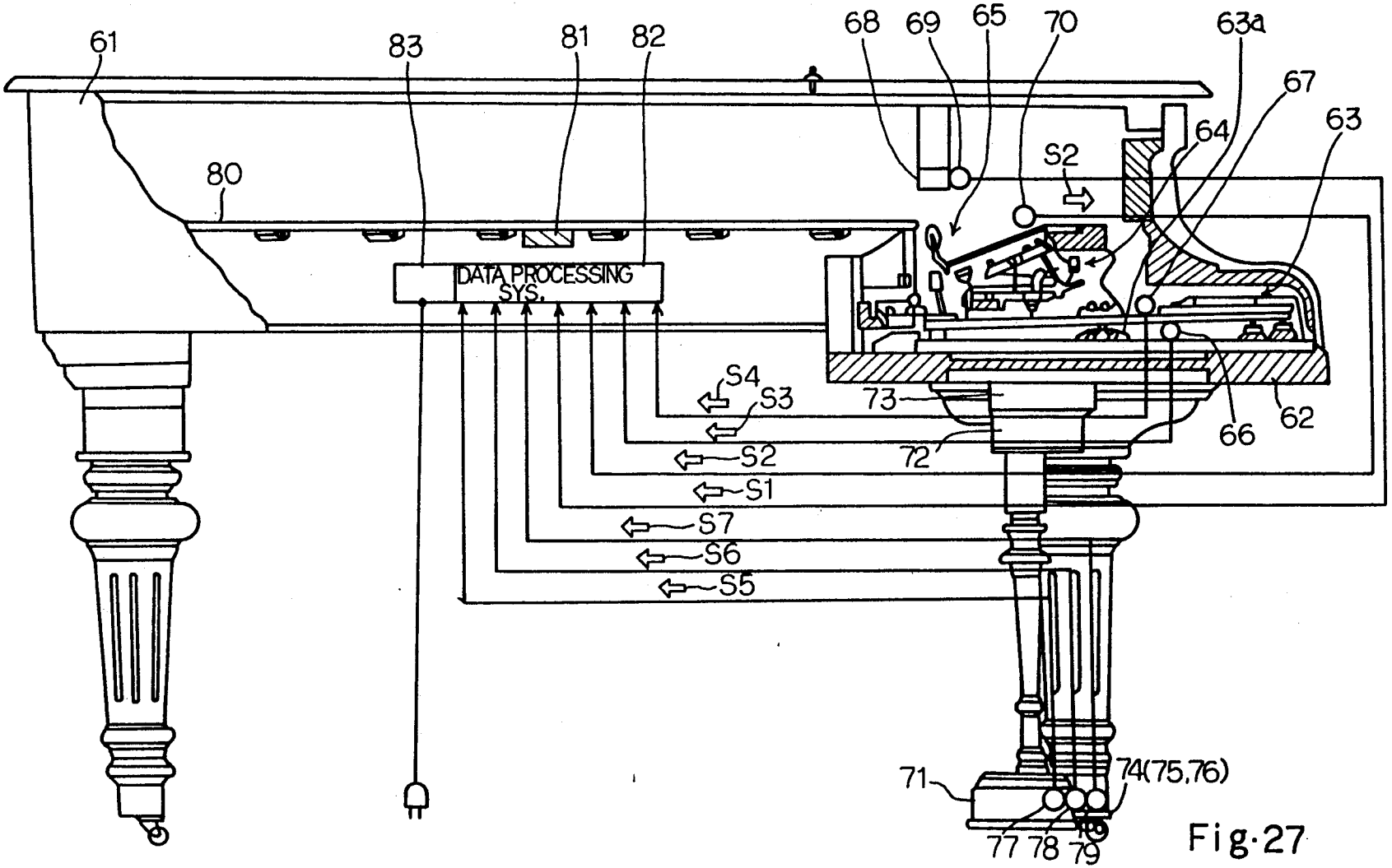
FIG. 27 is a partially cross sectional view showing the structure of yet another stringless piano-touch electric sound producer according to the present invention.

Turning to FIG. 27 of the drawings, yet another stringless piano-touch electric sound producer embodying the present invention is illustrated. The stringless piano-touch electric sound producer comprises a side board 61, a key bed 62 attached to the lower surface on the front side of the side board 61, and a keyboard 63 with 88 keys mounted on the key bed 62. Each of the keys on the keyboard 63 is rockablly supported by a balance rail 63*a* as similar to keys of an acoustic piano. A plurality of key action mechanisms 64 are provided in association with the 88 keys, respectively, and drive associated hammer units 65 for rotation upon depressing the associated keys. However, the key action mechanisms 64 accompanied with the hammer units 65 are well known to a person skilled in the art, and no further description is incorporated hereinbelow.

Each of the keys on the keyboard 63 is associated with a reflection type photo coupler 66 and an acceleration pick-up unit 67 which correspond to the sensor units 7*c* and 7*d* of the first embodiment. The reflection type photo coupler 66 detects the associated key downwardly depressed, and produces an electric signal S3 indicative of the time period for crossing an optical path radiated therefrom. The acceleration pick-up unit 67 detects acceleration of the associated key, and produces an electric signal S4 indicative of the acceleration.

A single board unit 68 is provided over the hammer units 65 instead of musical wires of an acoustic grand piano, and is shared between all of the hammer units 65. A sensor array 69 is provided in association with the board unit 68, and is implemented by a plurality of pressure sensor units respectively associated with the hammer units 65, respectively. When the keys are depressed, the associated key action mechanisms 64 drive the associated hammer units 65, and the hammer units 65 impact the associated pressure sensor units of the sensor array 69 without a substantial amount of volume, and the pressure sensor units 69 struck with the hammer units 65 produce first electric signals S1 each indicative of impact force applied from the associated hammer unit 65. The motions of the hammer units are further monitored by reflection type photo couplers 70, and the photo couplers 70 produces second electric signals S2 each indicative of time period for crossing an optical path radiated from the reflection type photo coupler. Therefore, the pressure sensor units 69 and the reflection type photo couplers 70 correspond to the sensor units 7*a* and 7*b* of the first embodiment.

A pedal box 71 is suspended from a lyre block 72 attached through a bottom beam 73 to the key bed 62, and three pedals, i.e., a soft pedal 74, a muffler pedal 75 and a damper pedal 76 are rockablly supported by the pedal box 71. A soft pedal, a muffler pedal and a damper pedal of an acoustic piano are coupled with respective pedal mechanisms; however, the soft, muffler and damper pedals 74 to 76 are associated with three sensor units 77, 78 and 79 only. The sensor units 77 to 79 correspond to the sensor units 7*e* to 7*g* of the first embodiment, respectively, and produce electric signals S5, S6 and S7 indicative of manipulations of the pedals 74 to 76, respectively.

A sound board 80 is horizontally supported, and an electromagnetic actuator 81 is attached to a predetermined position on the back surface of the sound board 80. The electromagnetic actuator 81 is coupled with an electronic data processing system 82 associated with an electric power source 83, and the electric signals S1 to S7 are supplied from the sensor units 69, 70, 66, 67 and 77 to 79 to the electronic data processing system 82.

Figure 28:
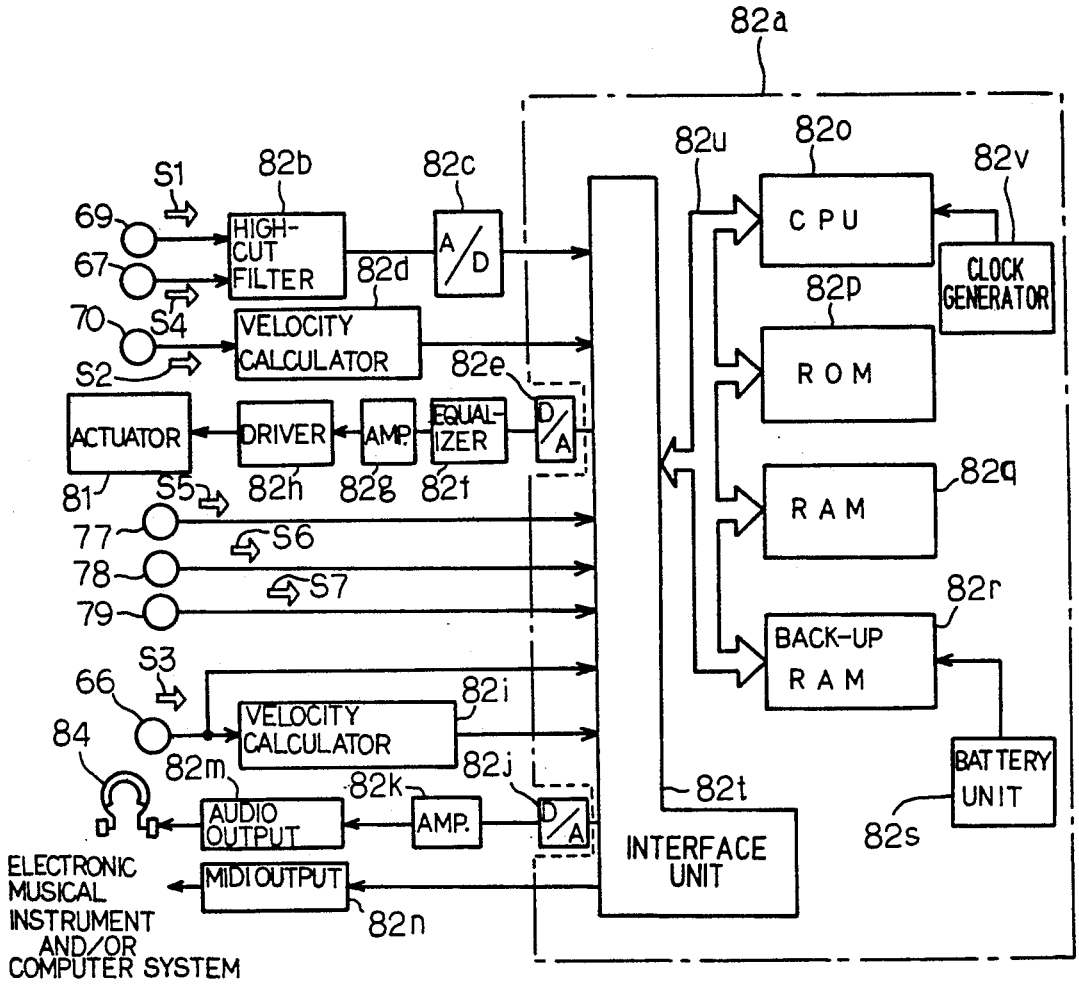
FIG. 28 is a block diagram showing the circuit arrangement of an electronic data processing system incorporated in the stringless piano-touch electric sound producer shown in FIG. 27.

The circuit arrangement of the electronic data processing system 82 is illustrated in FIG. 28 in detail. The electronic data processing system 82 comprises a data processing unit 82*a*, a high-cut filter unit 82*b* accompanied with an analog-to-digital converter 82*c*, a velocity calculator 82*d*, a series combination of a digital-to-analog converter 82*e*, an equalizer 82*f*, an amplifier 82*g* and a driver 82*h*, another velocity calculator 82*i*, a series combiantion of a digital-to-analog converter 82*j*, an amplifier 82*k* and an audio-output unit 82*m*, and a MIDI output unit 82*n*. The high cut filter unit 82*b* eliminates noise components equal to or higher than 8000 Hz from the first and fourth electric signals S1 and S4. The first and fourth electric signals S1 and S4 thus treated are supplied to the analog-to-digital converting unit 82*c*, and are converted to first and second digital siganls. A line spectrum signal indictive of vibrations produced on the board unit 68 upon striking with the assoicated hammer unit 65 is formed from the first digital siganl S1 through a fast Fourier transformation. The velocity calculator 82*d* is coupled with the sensor unit 70, and is responsive to the second electric signal S2 for calculating the hammer velocity. The velocity calculator 82*d* produces a third digital signal indicative of the hammer velocity, and the third digital signal is supplied to the data processing unit 82*a*. The data processing unit 82*a* produces a digital vibrative mode signal, and supplies the digital vibrative mode signal to the digital-to-analog converting unit 82*e*. The digital-to-analog converting unit 82*e* converts the digital vibrative mode signal into an analog vibrative mode signal, and the analog vibrative mode signal is increased in magnitude by means of the amplifier unit 82*g*. The analog vibrative mode signal thus amplified is supplied to the driver unit 82*h*, and the driver unit 82*h* produces a driving signals in response to the analog vibrative signal. The driving signal is supplied to the electromagnetic actuator 81, and the electromagnetic actuator 81 produces vibrations under a selected vibration mode on the sound board 1*h*. The third electric signal S3 is supplied in parallel to the data processing unit 82*a* and the velocity calculator 82*i*, and the velocity calculator 82*i* calculates the key velocity. The third electric signal S3 indicative of a depressed key is directly supplied to the data processing unit 82*a*, and a third digital signal indicative of the key velocity is supplied from the velocity calculator 82*i* to the data processing unit 82*a*. However, the fifth to seventh sensor units 77 to 79 are directly supplied to the data processing unit 82*a*. The data processing unit 82*a* further produces a digital audio signal and a digital MIDI signal, and the digital audio signal is converted into an analog audio signal by the digital-to-analog converting unit 82*j*. The analog audio signal is amplified by the amplifier unit 82*k*, and is transferred to the audio output 82*m*. If a head receiver 84 is coupled with the audio output 82*m*, a music performed by the player on the keyboard 63 is reproduced at the head receiver 84. The pieces of musical information indicative of the music is further supplied to the MIDI output 82*n*, and is transferred to an electronic musical instrument.

The data processing unit 82*a* comprises a central processing unit 82*o*, a read only memory unit 82*p*, a random access memory unit 82*q*a back-up random access memory unit 82*r* associated with a battery unit 82*s* and an interface unit 82*t* coupled through an internal bus system 82*u* with each other, and a clock generator 82*v* distributes a system clock to these system components 82*o*, 82*p*, 82*q*, 82*r* and 82*t*. The read only memory unit 82*p* stores a program sequence fetched and executed by a central processing unit 82*o*, timing data as well as a plurality of mode data indicative of various vibration modes, respectively. The timing data define delay of sounds, and are accessible with combination of a key number and the hammer velocity. The vibration modes are respectively defined by line spectrums, and each of the line spectrums is measured on musical wires and predetermined component members of an acoustic piano upon striking with a hammer unit. The line spectrums are firstly broken down into 88 classes corresponding to the 88 keys on the keyboard 63, and each of the classes is secondary broken down into four sub-classes, i.e., non-manipulation of any pedals 74 to 76, manipulation of the damper pedal 74, manipulation of the muffler pedal 75 and manipulation of the soft pedal 76. Moreover, each of the sub-classes has a plurality of line spectrums addressable with combination of a line spectrum of vibrations on the board unit 68, acceleration of a key, a key velocity and a hammer velocity.

Figure 29:
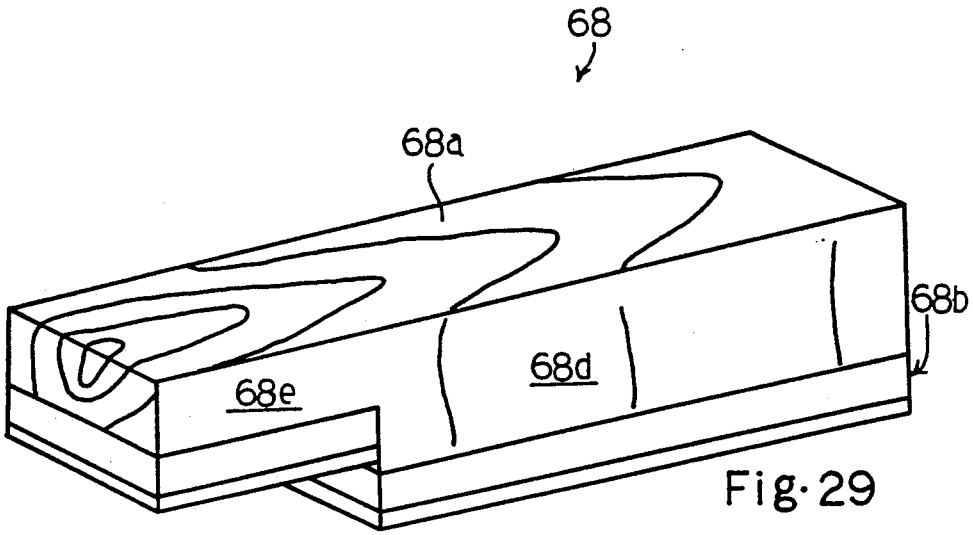
FIG. 29 is a perspective view showing the structure of a board unit incorporated in the stringless piano-touch electric sound producer shown in FIG. 27.
Figure 30:
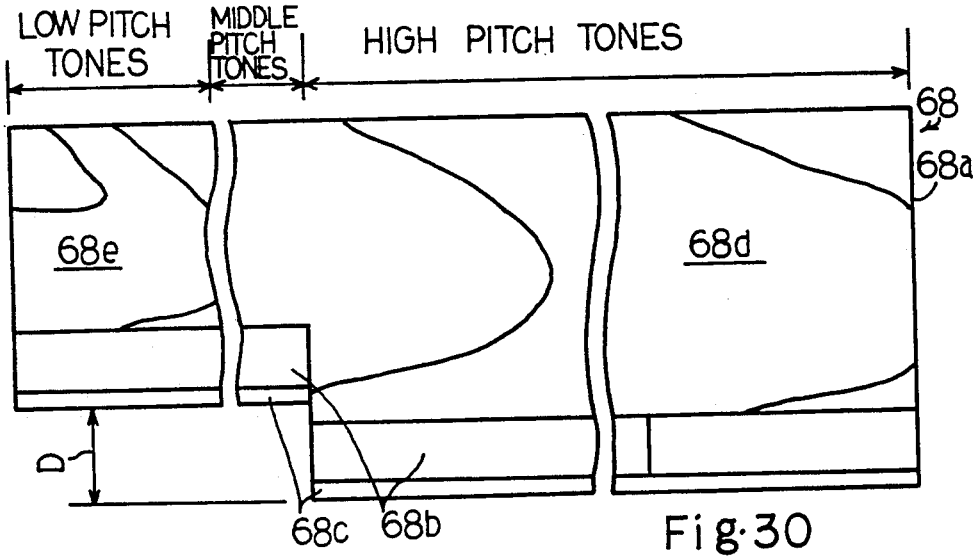
FIG. 30 is a front view showing the board unit shown in FIG. 29.
Figure 31:
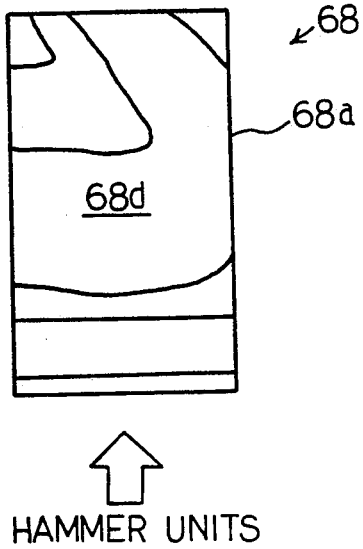
FIG. 31 is a side view showing the board unit shown in FIG. 29.

Turning to FIGS. 29 to 31 of the drawings, the board unit 68 incorporated in the stringless piano-touch electric sound producer largely comprises a beam member 68*a*, elastic sheet members 68*b* and protective sheet members 68*c*. The beam member 68*a* is formed of wood and the elastic sheet members 68*b* are of visco-elastic substance such as, for example, rubber or felt. The protective sheet members 68*c* are formed of artificial leather or cloth, by way of example, and protects the elastic sheet members 68*b* against impact with the hammer units 65 for providing prolonged service time to the elastic sheet members 68*b*. In this instance, the elastic sheet members 68*b* adhere to the beam member 68*a*, and the protective sheet members 68*c* further adhere to the elastic sheet members 68*b*. If the key action mechanisms 65 usually incorporated in an acoustic grand piano are used for the stringless piano-touch electric sound producer, the impact surfaces on the beam unit 68 are different between the kay action mechanisms for high pitch tones and the key action mechanisms for middle and low pitch tones, and the beam member 68*a* is shaped into a step configuration, and, accordingly, has a relatively thick portion 68*d* and a relatively thin portion 68*e*. In this instance, distance D of about 8 millimeters takes place at the step portion of the beam member 68*a*. The relatively thick portion 68*d* is associated with the keys assigned the high pitch tones, and the relatively thin portion 68*e* is associated with the key assigned the middle pitch tones as well as the low pitch tones. However, quasi-hammers may be used in the stringless piano-touch electric sound producer, and a beam member with a flat low surface may be associated with the quasi-hammers.

The beam unit 68 is deformable upon striking with the hammer unit, and takes up vibrations produced thereon. Moreover, the beam unit 68 according to the present invention provides piano-like key touch to a player, and substances of the beam unit 68 are selected in such a manner as to create the piano-like key-touch. In detail, various properties of a musical wire such as, for example, the mass, the coefficient of friction and the spring constant affect the key touch; however, the most important factor is the spring constant. For this reason, if the impact resilience of the beam unit 68 is regulated depending upon the keys on the key board 63, piano-like key touch is produced by the beam unit 68. Ratio between hammer velocity before the impact and hammer velocity after the impact is roughly indicative of the impact resilience of a set of musical wires. The ratio for the first key of an grand piano is about 20 per cent, the ratio for the forty-ninth key is about 60 per cent, and the ratio for the eighty-fifth key is about 60 per cent. In the beam unit 68, the impact resilience is strongly affectable by the elastic sheet members 68*b*, and, for this reason, the substance of the elastic sheet members 68*b* are selected in such a manner as to achieve impact resilience corresponding to the ratio between the hammer velocities. For example, nitrile butadiene rubber achieves 10 to 65 per cent, butyl rubber achieves 20 to 50 per cent, ethylene propylene rubber achieves 30 to 70 per cent, chloroprene rubber achieves 40 to 80 per cent, styrene butadiene rubber achieves 40 to 80 per cent, natural rubber achieves 40 to 90 per cent, and butadiene rubber achieves 50 to 95 per cent. As to felt, the impact resilience is depending upon the compression index; however, the same range as rubbers is achieved by felt. The aforesaid data are taken into consideration, and suitable substances are selected for the elastic sheet members 68*b*. It is desirable for the elastic sheet member assigned the high pitch tones to have large impact resilience; however, small impact resilience is suitable for low pitch tones. By virtue of the selected substances for the elastic sheet members 68*b*, the key touch on the keyboard 63 is much closer to that of an acoustic piano.

Description is hereinbelow made on operation of the stringless piano-touch electric sound producer according to the present invention. Assuming now that a key is depressed without any manipulation of pedals 77 to 79, the sensor units 69, 70, 66, 67 and 77 to 79 produce the respective electric signals S1 to S7 at respective timings, and the electric signals S1 to S7 are supplied to the electronic processing system 82. Namely, the sensor unit 66 associated with the depressed key detects the key crossing the optical path radiated therefrom, and produces the electric signal S3 indicative of the lapse of time for crossing the optical path. The sensor unit 67 measures the acceleration of the depressed key, and produces the electric signal S4. While the first key is downwardly depressed, the associated key action mechanism 64 drives the associated hammer unit 65 for rotation, and the sensor unit 70 detects the hammer shank thereof crossing the optical path radiated therefrom. The sensor unit 70 produces the electric signal S2 indicative of the lapse of time for crossing the optical path. Finally, the hammer unit 65 strikes the board unit 68, and the sensor unit 69 produces the electric signal S1 indicative of the impact energy.

The electric signal S1 is converted to the first digital signal, and is, thereafter, subjected to the fast Fourier transformation so that the line spectrum signal indicative of the vibration actually produced on the board unit 68 is produced. The electric signals S2 and S3 are used for calculating the hammer velocity and the key velocity, and the second and third digital signals are supplied to the interface unit 82*t* of the data processing unit 82*a* together with the electric signal S3. Since any pedals 77 to 79 is not depressed, the electric signals S5 to S7 remain in an inactive level. The central processing unit 82*o* checks the electric signals S3 and S5 to S7 to decide from what sub-class line spectrums should be read out. The electric signals S3 and S5 to S7 are indicative of the sub-class assigned to the non-manipulation of the class which in turn is assigned to the depressed key. Then, the central processing unit 82*o* accesses the selected sub-class by using the line spectrum signal as an address, and the line spectrums indicative of the vibrations on the musical wires associated with the depressed key are read out from the read only memory unit 82*p*. Similarly, the central processing unit 82*o* reads out the line spectrums indicative of the vibrations on the frame and the other vibratory member from the read only memory unit 82*p*.

The central processing unit 82*o* checks the timing data in the read only memory unit 82*p* with the key number represented by the electric signal S3 and the hammer velocity represented by the second digital signal, and decides time delay for production of a sound. The central processing unit 82*o* forms the vibration mode signal from the line spectrums read out from the read only memory unit 82*p*, and supplies the vibration mode signal to one of or both of the digital-to-analog converting unit 82*e* and the head receiver 84. If the vibration mode signal is supplied to the digital-to-analog converting unit 82*e*, the digital-to-analog converting unit 82*e* is converted into an analog vibration mode signal, and the equalizer 82*f* treats the predetermined modification on the analog vibration mode signal. After amplification at the amplifier 82*g*, the driver unit 82*h* drives the electromagnetic actuator 81 so that vibrations takes place on the sound board 80, thereby producing a sound. The time interval between the depressing of the key and the production of sound is equal to or less than 5 milliseconds. Since the vibrations on the sound board 80 is similar to vibrations transferred from musical wires, a frame and a corresponding vibratory member, the sound produced by the sound board 80 is substantially identical with a sound produced upon depressing the corresponding key of an acoustic piano.

Since the stringless piano-touch electric sound producer shown in FIGS. 1 and 2 is equipped with the MIDI output 82*n*, musical information of the performance can be transferred to an electronic musical instrument and/ or a computer system.

As will be appreciated from the foregoing description, the stringless piano-touch electric sound producer according to the present invention is small in size rather than an acoustic piano, because any musical wires and any pedal mechanisms is not necessary. Moreover, the volume of the sounds are controllable, and the player can listen to the performance through the head receiver 84 only. With this feature, the stringless piano-touch electric sound producer is convenient for a small house in a closely built-up area.

Figure 32:
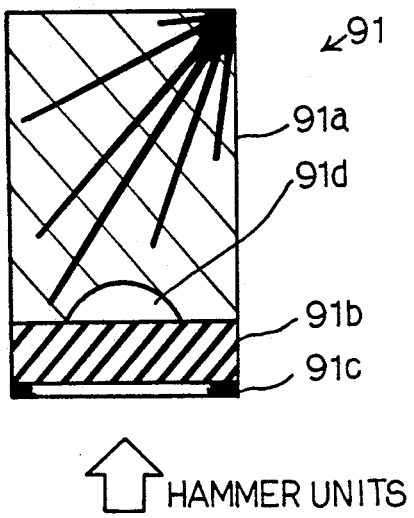
FIG. 32 is a cross sectional view showing a first modification of the board unit.
Figure 33:
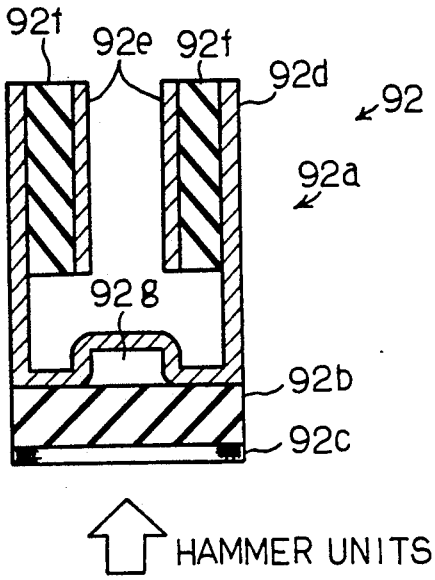
FIG. 33 is a cross sectional view showing a second modification of the board unit.

Various modifications are described hereinbelow. FIG. 32 shows a first modification 91 of the beam unit 68 associated with the hammer units 65. The first modification 91 comprises a beam member 91*a* of wood, an elastic sheet member 91*b* attached to the lower surface of the beam member 91*a*, and a protective sheet member 91*c* attached to the lower surface of the elastic sheet member 91*b*. An elongated hollow space 91*d* is formed in the beam member 91*a*, and extends in the longitudinal direction of the beam member 91*a*. The hammer units strike at central area of the protective sheet member 91*c*, and the elastic sheet member 91*b* is deformed into the elongated hollow space 91*d* upon striking at the central area of the protective sheet member 91*c*. The musical wires of an acoustic grand piano are usually deformed by about 4 to 5 millimeters upon striking with the associated hammer unit, and the elastic sheet member 91*b* deformed into the elongated hollow space 91*d* causes the key touch to be much closer to that of an acoustic grand piano. The dimensions of the elongated hollow space 91*d* are not uniform, and are varied with the hammer units. Namely, the elongated hollow space 91*d* over the hammer units for low pitch tones is wide and deep; however, the elongated hollow space 91*d* over the hammer units for middle and high pitch tones is narrow and shallow. Such a variable elongated hollow space is conducive to actual key touch of an acoustic grand piano.

A second modification 92 also comprises a beam member 92*a*, an elastic member 92*b*, and a protective sheet member 92*c*, and the beam member 92*a* is fabricated from a generally channel shaped metal member 92*d* of, for example, steel, counter plate members 92*e* and elastic sheet members 92*f* sandwiched between the inner surfaces of the channel shaped metal member 92*d* and the counter plate members 92*e*. The bottom portion of the channel shaped metal member 92*d* is twice bent so that an elongated hollow space 92*g* is formed at the central area of the beam member 92*a*. The elastic sheet members 92*f* are of the visco-elastic substance, and prohibit the channel shaped metal member 92*d* from vibrations, because the metal member 92*d* is much liable to resonate. The second modification 92 is attractive in view of reduction in weight.

Figure 34:
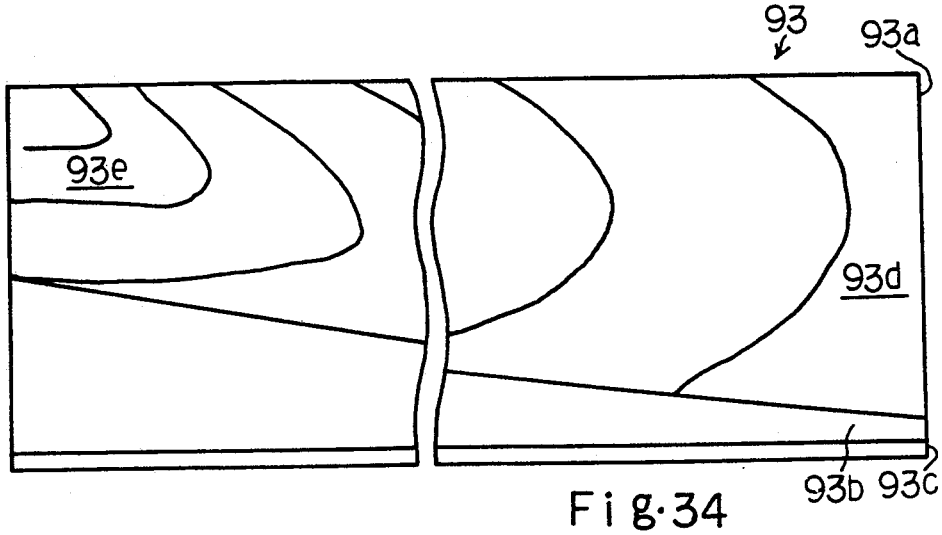
FIG. 34 is a front view showing a third modification of the board unit.
Figure 35:
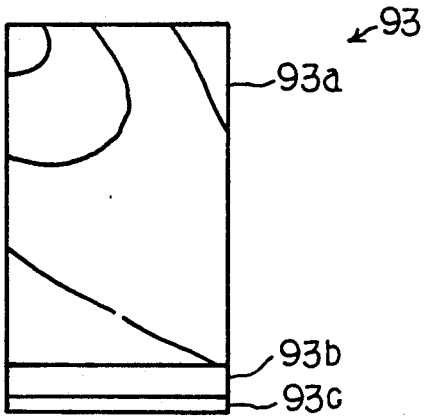
FIG. 35 is a side view showing the third modification of the beam unit.

FIGS. 34 and 35 show a third modification 93 of the beam unit 68, and the third modification 93 comprises a beam member 93*a* of wood, an elastic sheet member 93*b* of visco-elastic substance, and a protective sheet member 93*c*. The beam member 93*a* is shaped into a wedge configuration, and the elastic sheet member 93*b* is formed into a counter wedge configuration. The elastic sheet member 93*b* thus varied in thickness causes the impact resilience to gradually vary along the longitudinal direction of the beam unit 68. The right side portion of the elastic sheet member 93*b* is relatively thin, and causes the ratio between the hammer velocities to be larger than that of the left side portion. For this reason, the right side portion is assigned the hammer unit for high pitch tones, and the left side portion is assigned the hammer units for low pitch tones. Since the elastic sheet member 93*b* is formed into a single piece of the visco-elastic substance, the fabrication of the third modification is relatively easy.

Figure 36:
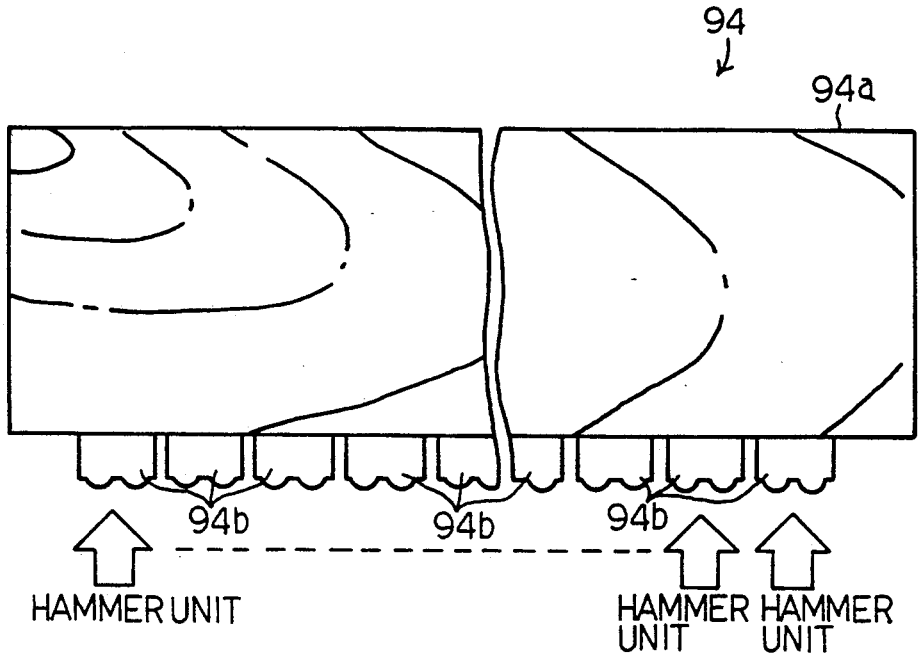
FIG. 36 is a front view showing a fourth modification of the beam unit.
Figure 37:
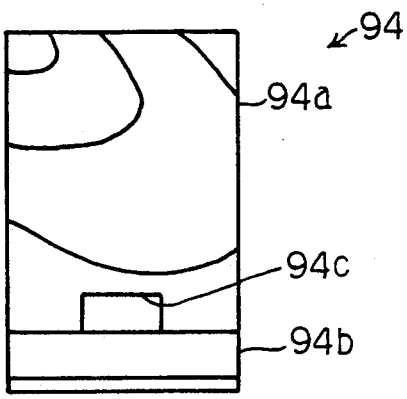
FIG. 37 is a side view showing the fourth modification.
Figure 38:
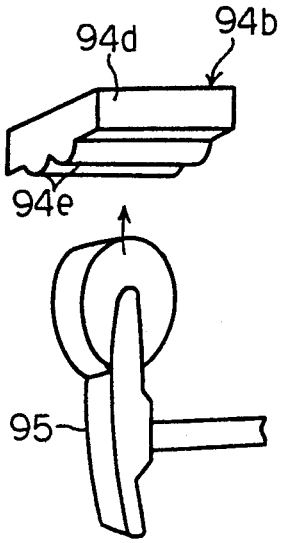
FIG. 38 is a perspective view showing an elastic unit forming a part of the fourth modification.

FIGS. 36 to 38 show a fourth modification of the beam unit 68. The fourth modification 94 comprises a beam member 94*a* of wood, and a plurality of elastic units 94*b* which are respectively associated with a plurality of hammer units 95. An elongated hollow space 94c is formed in the beam member 94a, and extends along the longitudinal direction of the beam unit. The elongated hollow space 94c serves as similar to the elongated hollow space 91d. The elastic units 94b are formed of the visco-elastic substance, and each of the elastic units 94b has a boss portion 94d attached to the bottom surface of the beam member 94a and juxtaposed two ridges 94e formed on the boss portion 94d. In this instance, each of the juxtaposed ridges 94e is semi-circular in cross section. If the hammer units 95 are of the type incorporated in an acoustic grand piano, the pitch between two adjacent hammer units 95 is variable, and, accordingly, the elastic units 94b are spaced apart at different intervals. However, if quasi-hammers are incorporated in the stringless piano-touch electric sound producer, the quasi-hammers are easily arranged at a predetermined pitch, and the elastic units 94b are integral with each other so as to form elastic blocks. This results in easy fabrication. If the elastic units 94b are formed of suitable substances, the impact resiliencies of the elastic units 94b are regulable, and allow the stringless piano-touch electric sound producer to produce actually piano-like key touch.

Figure 39:
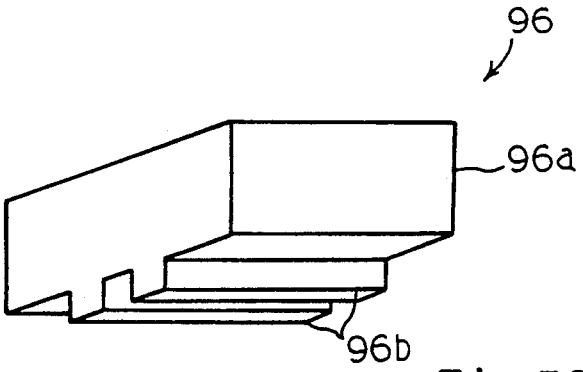
FIG. 39 is another elastic unit for a beam unit.
Figure 40:
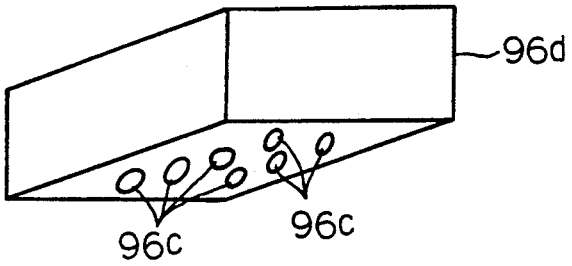
FIG. 40 is yet another elastic unit for a beam unit.

Since reduction in abutting area is effective against noises, various elastic units are formed for a beam unit. For example, an elastic unit 96 has a boss portion 96a and juxtaposed ridges 96b with rectangular cross section as shown in FIG. 39, and semi-spherical projections 96c are formed on the bottom surface of a boss portion 96d as shown in FIG. 40.

If a hammer unit or a hammer shank strikes a beam unit in face-to-face relation, large noises take place. However, the elastic unit 94b allows the associated hammer unit 95 to impact to the ridges 94, and the abutting area is surely decreased. This results in reduction of noises. Moreover, the semi-spherical projections 96c may directly mounted on the bottom surface of a beam member, and there is no need to take the pitch of the hammer units into account. This results in easy fabrication.

Figure 41:
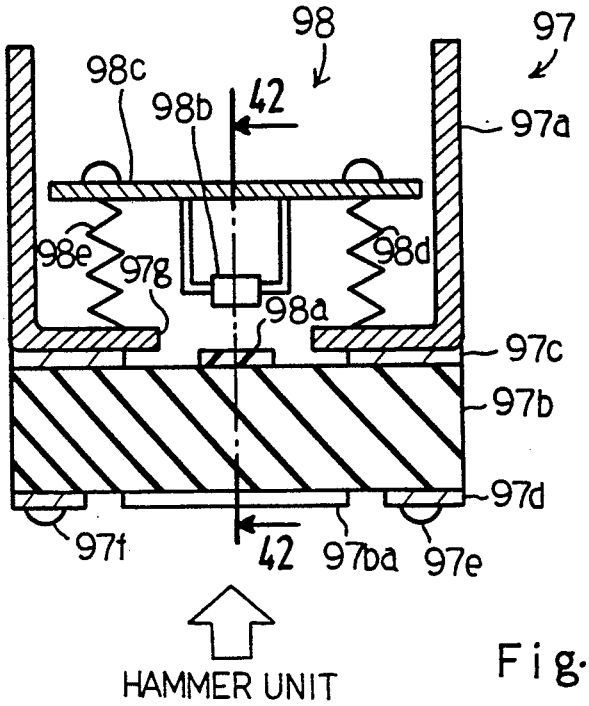
FIG. 41 is a cross sectional view showing yet another elastic unit associated with a sensor unit.
Figure 42:
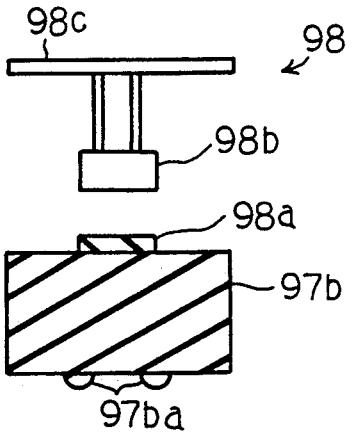
FIG. 42 is a cross sectional view, taken along line A—A of FIG. 41, showing relation between an elastic unit and the sensor unit.
Figure 43:
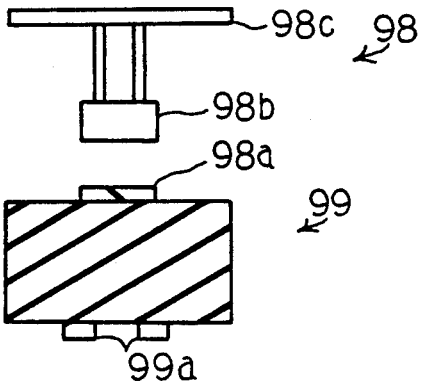
FIG. 43 is a cross sectional view showing relation between another elastic unit and the sensor unit.

The sensor units 69 may be implemented by a photo coupler. FIG. 41 shows a beam unit 97 associated with a sensor unit 98 for detecting vibrations produced on the beam unit 97 upon striking with a hammer unit. The beam unit 97 comprises a channel shaped metal member 97a of steel galvanized with zinc, a plurality of elastic units 97b each having juxtaposed ridges 97ba and sandwiched between reinforcing plate members 97c and 97d, and bolts 97e and 97f screwed through the elastic unit 97b and the reinforcing plate members 97c and 97d into the channel shaped metal member 97a. A slot 97g is formed in the bottom portion of the channel shaped metal member 97a, and exposes a white rubber strip 98a attached to the upper surface of one of the elastic units 97b to the sensor unit 98. The sensor unit 98 comprises the white rubber strip 98a, a photo coupler 98b suspended from a plate member 98c of polypoly-clorinated biphenyl, and spring members 98d and 98e inserted between the bottom portion of the channel shaped metal member 97a and the plate member 98c. Since the channel shaped metal member 97a is colored in black, the background luminance is weak. Moreover, the elastic unit 97b is also colored in black, optical radiation fallen upon the white rubber strip 98a is discriminative from the exposed upper surface of the elastic unit 97b. If an elastic unit 99 has juxtaposed ridges with rectangular cross section, relation between the sensor unit 98 and the elastic unit 99 is as shown in FIG. 43.

The sensor unit 98 thus associated with the beam unit 97 detects impact force applied from the associated hammer unit. Namely, when the hammer unit strikes the elastic unit 97b, the elastic unit 97b is elastically deformed, and the amount of deformation is dependent upon the impact force applied from the hammer unit. In other words, the white rubber strip 98a is moved toward the photo coupler 98b, and the distance between the white rubber strip 98a and the photo coupler 98b is inversely proportional to the impact force. If the distance is decreased, the reflection becomes strong, and the photo current is increased. Thus, the electric signal or the photo current is indicative of the impact force as well as impact timing, and is supplied to an electronic data processing system. The electronic data processing system similarly behaves as the electronic data processing system 82, and allows a sound board to produce a sound corresponding to the sound produced in an acoustic piano.

Figure 44:
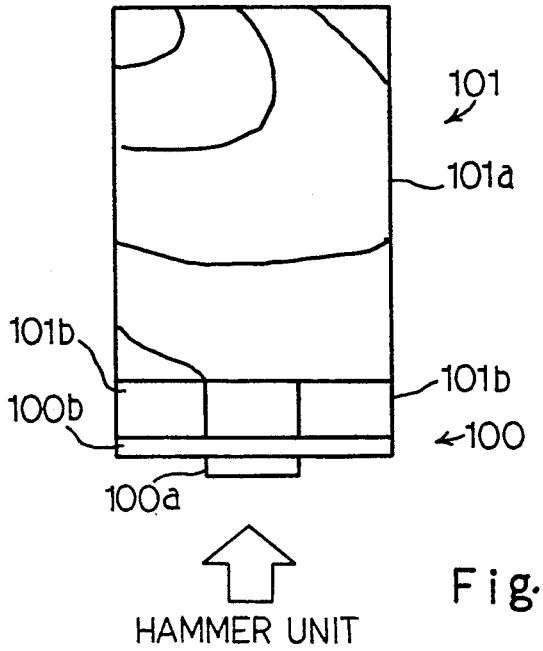
FIG. 44 is a side view showing relation between another sensor unit and a beam unit.
Figure 45:
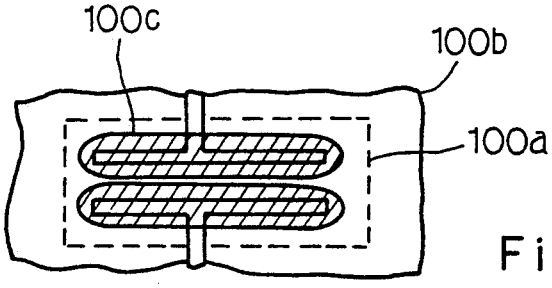
FIG. 45 is a plan view showing a pressure sensitive pattern of the sensor unit shown in FIG. 44.
Figure 46:
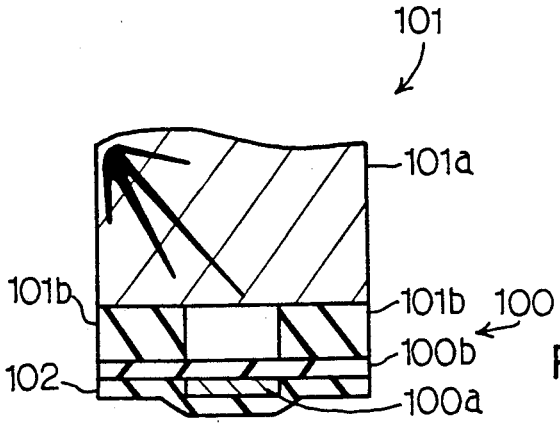
FIG. 46 is a cross sectional view showing a modification of the sensor unit shown in FIG. 44.
Figure 47:
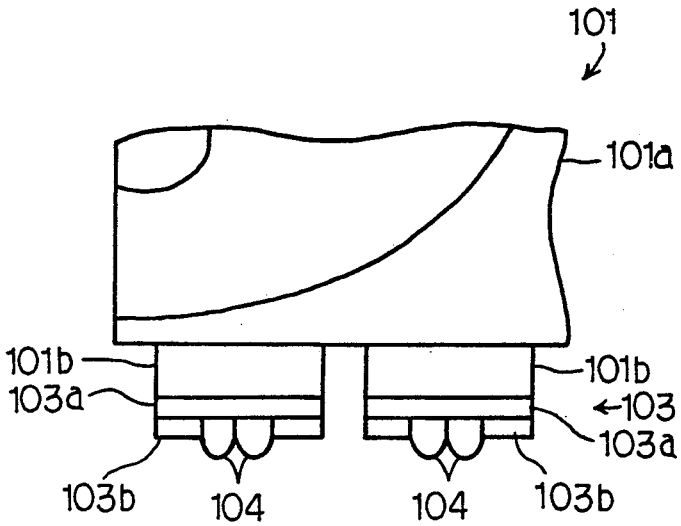
FIG. 47 is a side view showing yet another pressure sensor unit.

Turning to FIG. 44 of the drawings, another pressure sensor unit 100 is attached to a beam unit 101. The beam unit 101 comprises a beam member 101a of wood and a plurality of elastic sheet member 101b of visco-elastic substance attached to the lower surface of the beam member 101a. The visco-elastic substance is selected in such a manner as to have impact resilience corresponding to musical wires of an acoustic grand piano. The pressure sensor unit 100 is implemented by a conductive strip 100a mounted on a substrate 100b with a pressure sensitive pattern 100c as shown in FIG. 45. In FIG. 45, the pressure sensitive pattern 100c is hatched for the sake of better understanding, and the hatching lines are not indicative of cross section. The conductive strip 100a may be covered with a cushion 102 as shown in FIG. 46. The cushion 102 not only protects the pressure sensor 100 from impact applied with a hammer unit but also eliminates undesirable noises. The pressure sensitive pattern 100c and the conductive strip 100a produces an electric signal indicative of the impact force, and the electric signal indicative of the impact force as well as impact timing is supplied to an electronic data processing system corresponding to the electronic data processing system 82.

In another implementation, a pressure sensor unit 103 is split into two blocks each having a pressure sensitive pattern printed on a substrate 103a and a conductive strip 103b, and cushion members 104 project from the lower surfaces of the conductive strips 103b.

Figure 48:
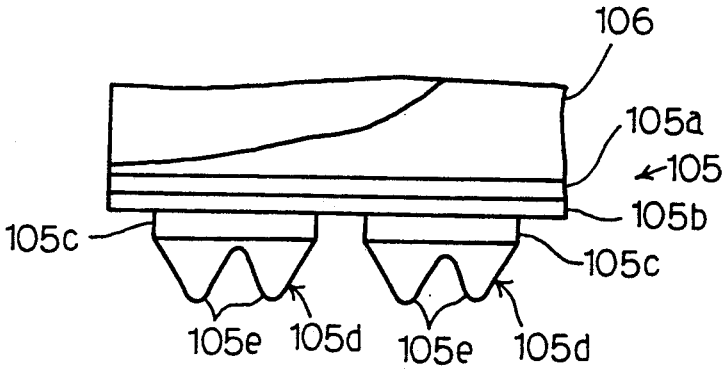
FIG. 48 is a side view showing yet another pressure sensor unit.

FIG. 48 shows yet another pressure sensor unit 105 directly attached to a beam member 106 of wood. The pressure sensor unit 105 comprises a pressure sensitive pattern printed on a substrate 105a, a conductive sheet member 105b laminated over the pressure sensitive pattern on the substrate 105a, ebonite members 105c attached on the lower surfaces of the conductive sheet member 105b, and elastic members 105d attached to the lower surface of the ebonite members 105c. Each of the elastic members 105d has two juxtaposed ridges 105e, and the elastic members 105d are formed of visco-elastic substance with impact resilience corresponding to that of musical wires.

Figure 49:
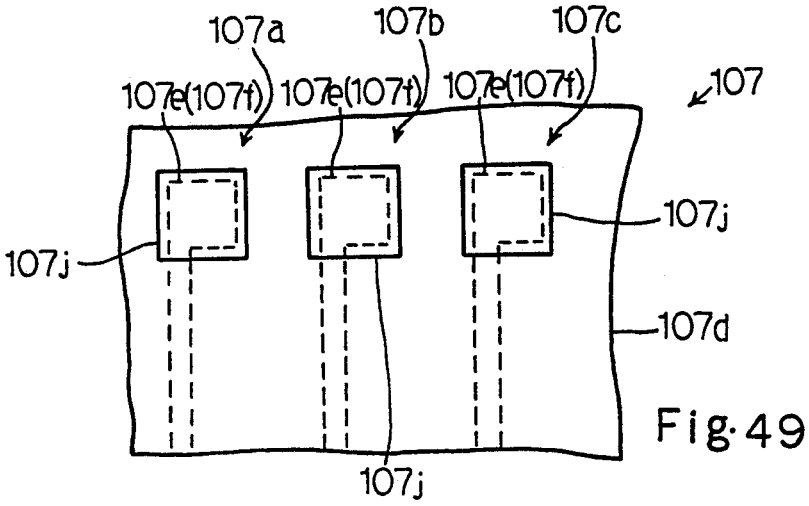
FIG. 49 is a plan view showing pressure sensor units respectively associated with hammer units.
Figure 50:
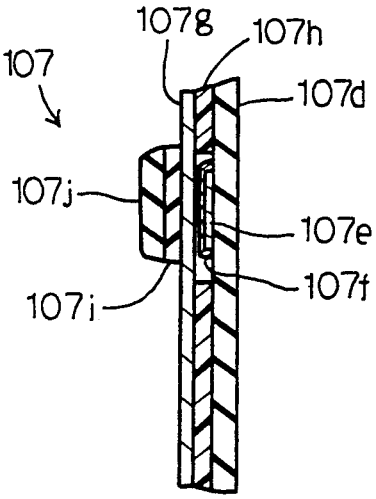
FIG. 50 is a cross sectional view showing the structure of one of the pressure sensor units shown in FIG. 49.
Figure 51:
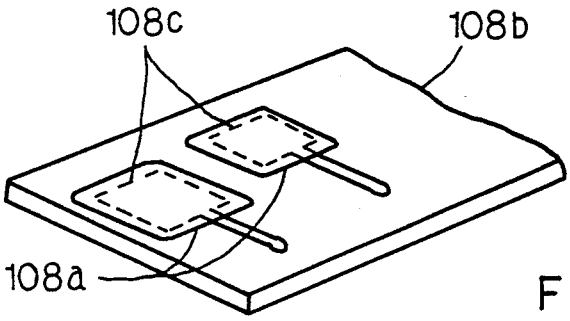
FIG. 51 is a perspective view showing the arrangement of a modification of the pressure sensor units shown in FIG. 49.

FIGS. 49 and 50 show yet another pressure sensor 107 for detecting impact force according to the present invention. The pressure sensor 107 is split into a plurality of sensor elements 107a, 107b and 107c respectively associated with hammer units (not shown), and comprises a substrate 107d, resistive patterns 107e overlapped with pressure sensitive films 107f, a conductive sheet 107g fixed to the substrate 107d by means of an adhesive sheet 107h, ebonite members 107i provided over the pressure sensitive films 107f, and elastic sheets 107j covering the ebonite members 107i. Resistive patterns 108a may be formed on a substrate 108b and covered with photo sensitive sheets 108c. The pressure sensor thus arranged 107 detects impact forces at the sensor elements 107a to 107c, and produces electric signals indicative of impact force as well as impact timing which are supplied to an electronic data processing system corresponding to the electronic data processing system 82.

Figure 52:
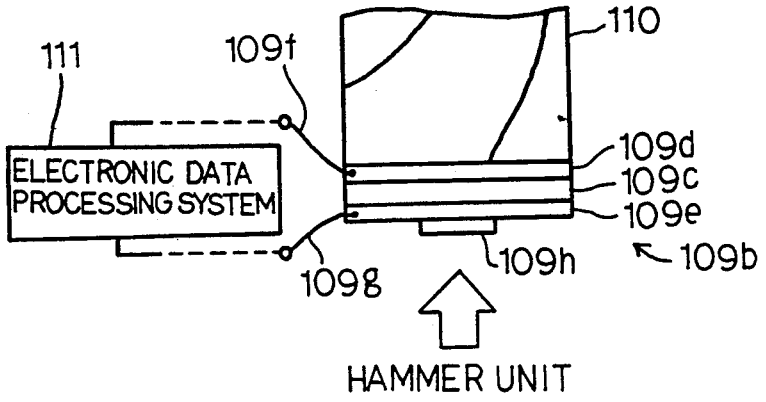
FIG. 52 is a side view showing a pressure sensor associated with a beam unit in accordance with the present invention.
Figure 53:
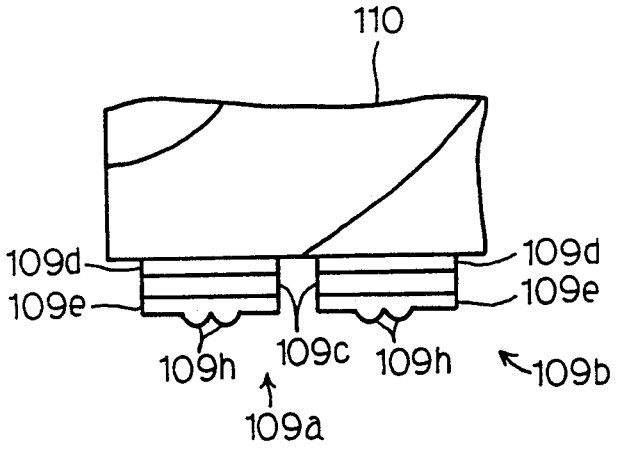
FIG. 53 is a front view showing the pressure sensor shown in FIG. 52.
Figure 54:
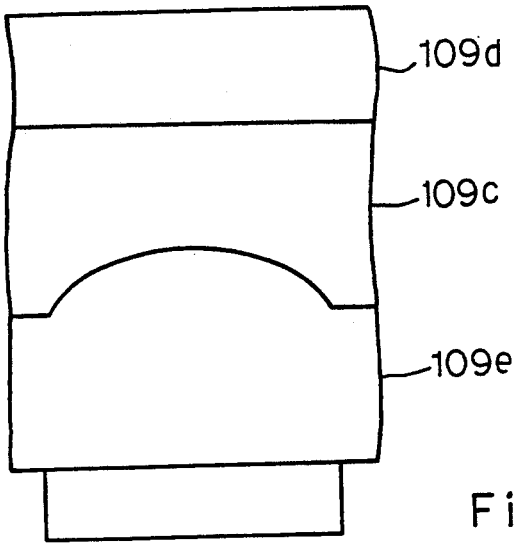
FIG. 54 is a side view showing, in an enlarged scale, the pressure sensor unit shown in FIG. 52.
Figure 55:
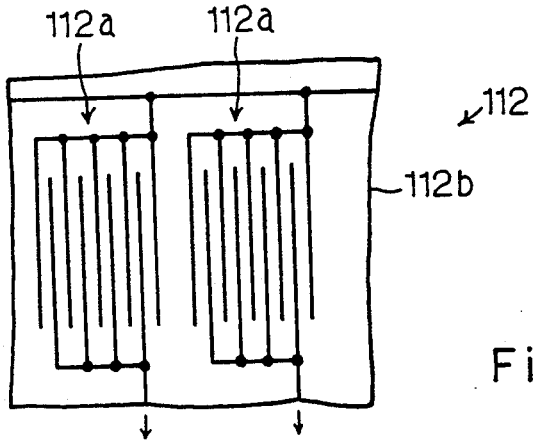
FIG. 55 is a a plan view showing conductive pattern of a switching element forming a part of a pressure sensor according to the present invention.

FIG. 52 to 54 show yet another pressure sensor according to the present invention. The pressure sensor is implemented by a plurality of sensor elements 109a and 109b directly attached to a lower surface of a beam member 110 of wood. Each of the sensor elements 109a and 109b comprises a conductive rubber sheet 109c sandwiched between two electrodes 109d and 109e of conductive metal or conductive plastic. The electrodes 109d and 109e are coupled through suitable wirings 109f and 109g with an electronic data processing system 111, and the electrodes 109e has two juxtaposed ridges 109h. When a hammer unit strikes the juxtaposed ridges 109h, the pressure sensitive rubber 109c of the associated sensor element is varied in resistance depending upon impact force applied from the hammer unit, and current passing therethrough is changed. The current or an electric signal is indicative of the impact force as well as impact timing, and the electronic data processing unit 111 causes a sound board to produce a sound.

Figure 56:
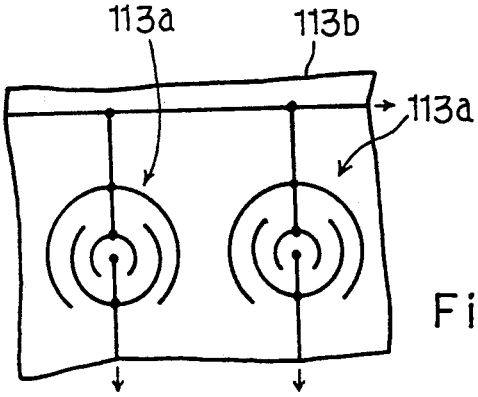
FIG. 56 is a plan view showing another conductive pattern of a switching element forming a part of a pressure sensor according to the present invention.

Each sensor element 109a or 109b may be replaced with a switching element 112, and the switching element 112 has interdigitated conductive patterns 112a faced with a conductive sheet (not shown) and formed on an insulating substrate 112b, and the interdigitated conductive patterns 112a are associated with hammer units, respectively. FIG. 56 shows another conductive patterns 113a formed on an insulating substrate 113b.

Figure 57:
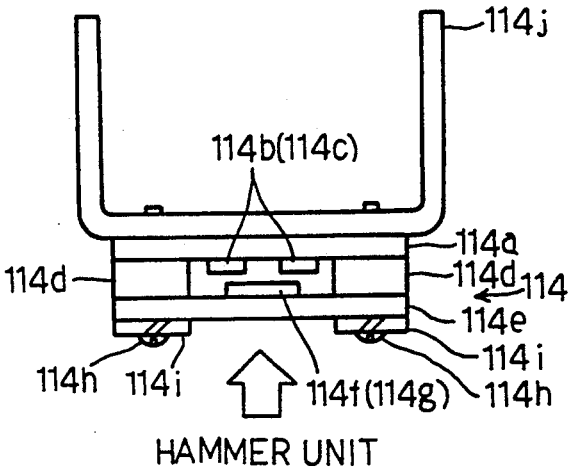
FIG. 57 is a side view showing relation between a beam unit and a pressure sensor according to the present invention.
Figure 58:
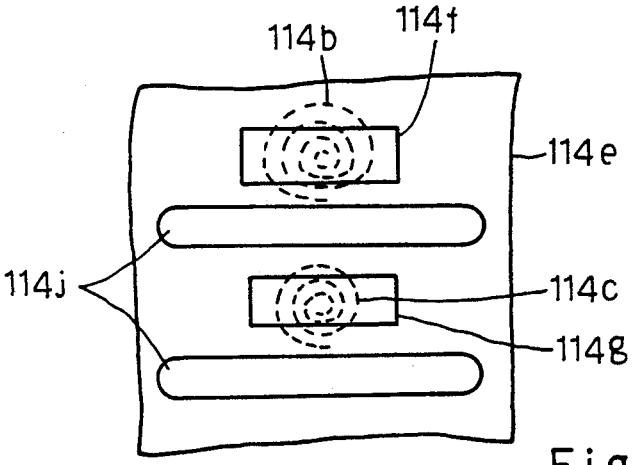
FIG. 58 is a plan view showing an elastic plate member for coil patterns incorporated in another pressure sensor.

FIG. 57 shows yet another pressure sensor associated with a beam unit. The pressure sensor 114 comprises a substrate 114a, a plurality of coil patterns 114b and 114c formed on the substrate 114a, a spacer member 114d attached to peripheral areas of the substrate 114a, an elastic plate member 114e of rubber, rubber coated plate or spring steel, a plurality of magnet pieces 114f and 114g of rubber or plastic mounted on the elastic plate member 114e, and bolt members 114h for securing the spacer member 114d, the elastic plate member 114e and the substrate 114a to a channel shaped metal member 114j together with washer members 114i. The channel shaped metal member 114j is effective against impact with a hammer unit, and is of a back plate. The coil patterns 114b and 114c are respectively associated with the magnet pieces 114f and 114g, and the combinations of the coil patterns 114b and 114c and the magnetic pieces 114f and 114g are respectively associated with a plurality of hammer units.

When a hammer unit strikes the elastic plate member 114e, the elastic plate member 114e is deformed so that the distance between the magnet pieces 114f and 114g and the coil patterns 114b and 114c is changed. The coil patterns 114b and 114c cross the magnetic force lines of the associated magnet pieces 114f and 114g, and current is induced in the coil patterns 114b and 114c. The current serves as an electric signal indicative of impact force and impact timing, and is supplied to an electronic data processing system for producing vibration on a sound board.

Figure 59:
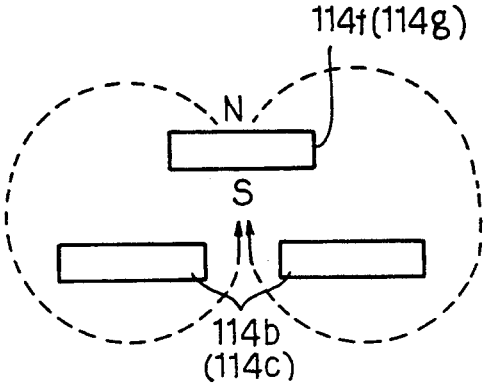
FIG. 59 is a view showing magnetic force of a magnet piece affecting the coil patterns.

The elastic plate member 114e may have slits 114j, and the slits 114j allow the elastic plate member 114e to be widely deformed. Moreover, an area of the elastic plate member 114e assigned to the magnet pieces 114f and 114g may be not wider than the coil patterns 114b and 114c as shown in FIG. 59, and such an arrangement can minimize undesirable interference between adjacent two coil members.

Figure 60:
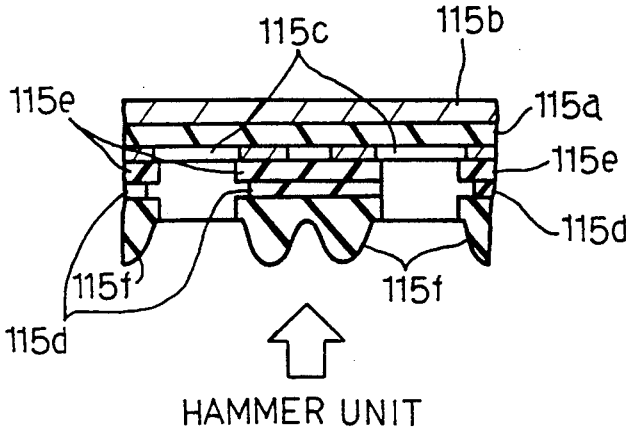
FIG. 60 is a cross sectional view showing a modification of the pressure sensor shown in FIG. 57.

FIG. 60 shows a modification of the pressure sensor shown in FIG. 57. The pressure sensor shown in FIG. 60 comprises a substrate 115a attached to a back plate member 115b, a plurality of coil patterns 115c mounted on the substrate 115a, rubber magnetic pieces 115d, a rubber spacer 115 sandwiched between the coil patterns 115c and the rubber magnetic pieces 115d, and elastic blocks 115f attached to the lower surfaces of the rubber magnetic pieces 115d.

The coil patterns 115c are respectively associated with the rubber magnetic pieces 115d, and the combinations of the coil patterns 115c and the rubber magnetic pieces 115d in turn are associated with hammer units, respectively. When a mahher unit strikes one of the elastic blocks 115f, the spacer 115e is deformed, and current is induced in the associated coil pattern as similar to the coil pattern shown in FIG. 57. Since the hammer unit strikes the elastic block 115f, undesirable noises are minimized, and only a piano-like sound is produced.

Fifth Embodiment

Figure 61:
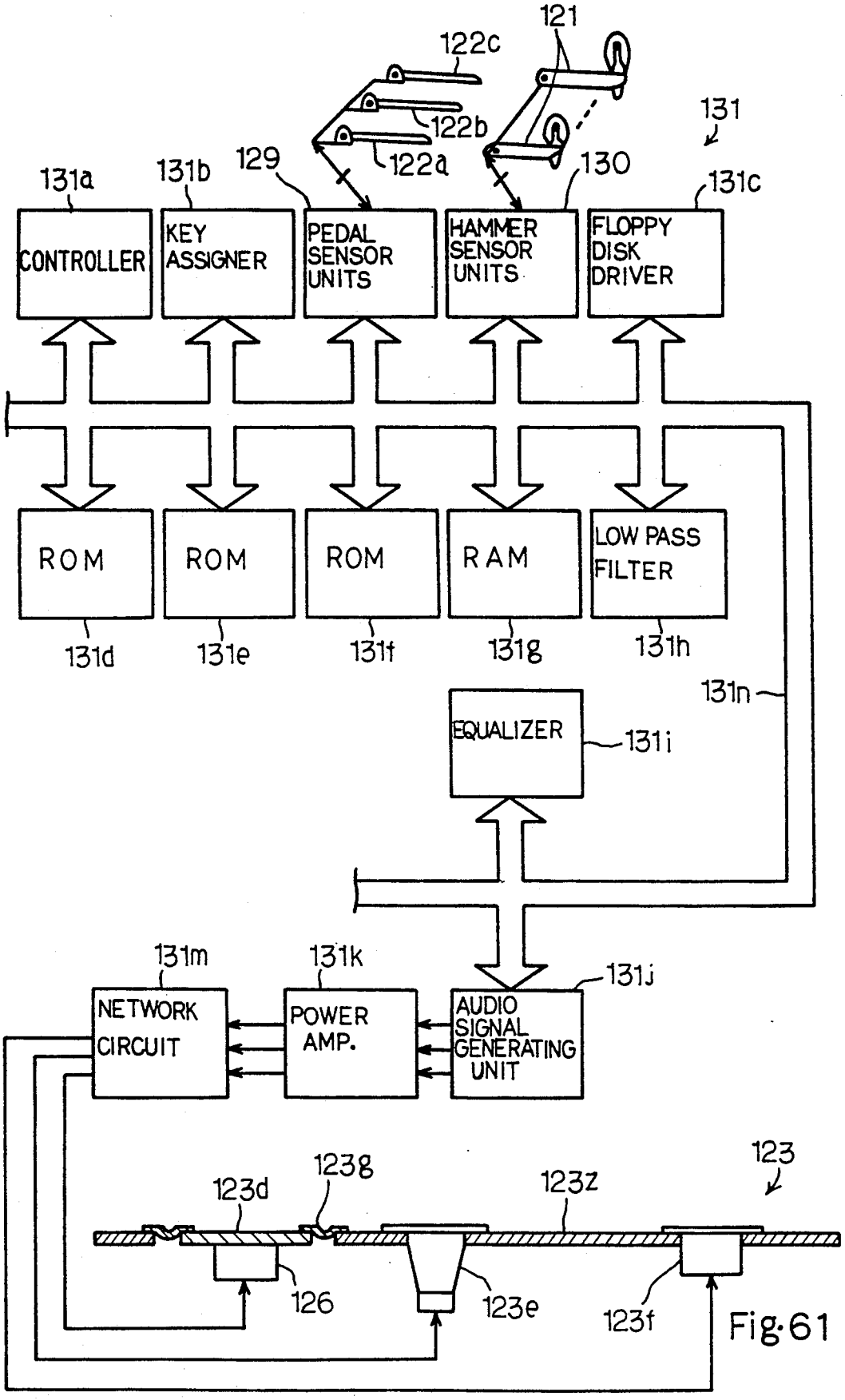
FIG. 61 is a block diagram showing the arrangement of yet another stringless piano-touch electric sound producer according to the present invention.

Turning to FIG. 61 of the drawings, a stringless piano-touch electric sound producer embodying the present invention largely r a piano-like keyboard musical instrumemnt, and an electric system. The piano-like keyboard musical instrument comprises a housing (not shown), a keyboard with a plurality of keys (not shown), a plurality of key action mechanisms (not shown) assoicated with the keys, resepctively, a plurlity of hammer units 121 respectively driven for rotations by the plurlaity of key action mechanisms upon depressing the assoicated keys, soft, muffler and damper pedals 122a, 122b and 122c rockablly supported by a pedal box (not shown), and a vibrative board unit 123 accomodated in the housing. However, musical wires and a frame are deleted from the piano-like keyboard musical instrument.

Figure 62:
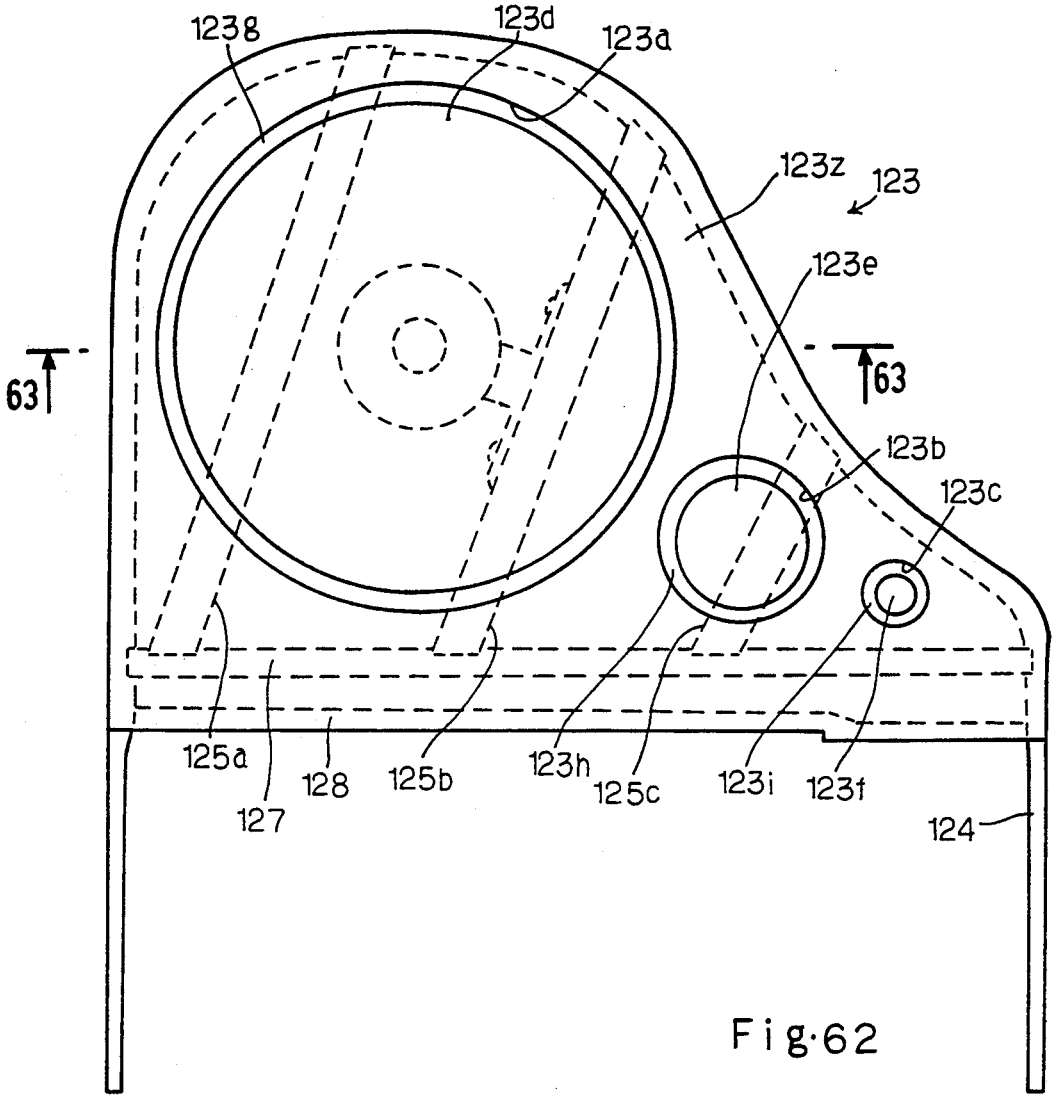
FIG. 62 is a plan view showing a sound board incorporated in the stringless piano-touch electric sound producer according to the present invention.
Figure 63:
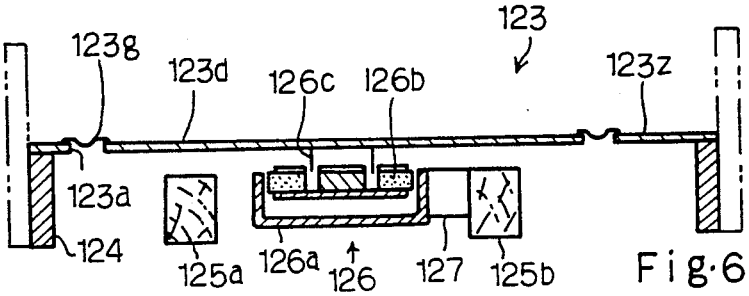
FIG. 63 is a cross sectional view taken along line B—B of FIG. 62 and showing the structure of the sound board.

As will be better seen from FIGS. 62 and 63, the vibrative board unit 123 has a baffle plate 123z, and is similar in shape to a sound board incorporated in an acoustic piano. The baffle plate 123z is supported by a post member 124, and is formed of wood effective against secular distortion. Sufficiently rigid articule board, laminated wood, and s single solid board are available for the baffle plate 123z. A large-sized circular aperture 123a, a middle-sized circular aperture 123b and a small circular aperture 123c are formed in the baffle plate 123z at spacings, and a slightly smaller vibrative circular plate 123d is loosely received in the large-sized circular aperture 123a. On the other hand, auxiliary speaker units 123e and 123f are snagly received in the circular apertures 123b and 123c, respectively. The vibrative circular plate 123d is supported by the baffle plate 123z by means of ring-shaped corrugation member 123g, and the auxiliary speaker units 123e and 123f are directly supported by the baffle plate 123z. By virtue of the ring-shaped corrugation member 123g, the vibrative circular plate 123d is vibrative with respect to the baffle plate 123z. Reinforcing beams 125a, 125b and 125c extend and are connected with the post member 124. An actuator 126 is supported by the reinforcing beam 125b by means of a bracket member 127, and comprises a casing 126a, a magnet unit 126b and a voice coil 126c suspended from the vibrative circular plate 123d toward the magnet unit 126b. When electric current is supplied to the voice coil 126c, the vibrative circular plate 123d electromagnetically vibrates with respect ot the baffle plate member 123z. The auxiliary speaker unit 123e is assigned to relatively low and middle pitch tones, and the auxiliary speeaker unit 123f produces high pitch tones. Reference numerals 127 and 128 designate two reinforcing beams for increasing the strength of the post member 124.

Turnig back to FIG. 61 of the drawings, the electric system lagely comprises pedal sensor units 129 for detecting displacements of the pedals 122a to 122c, hammer sensor units 130 for detecting the associated hammer units crossing optical paths radiated therefrom, the actuator 126, the two auxiliary speaker units 123e adn 123f, and an electronic data processing system 131. The electronic data processing system 131 comprises a controller 131a, a key assigner 131b, a floppy disk driver 131c, read only memory units 131d, 131e and 131f, a random access memory unit 131g serveing as working memory, a low pass filter unit 131h, an equalizer 131i, an audio signal generating unit 131j equipped with a digital-to-analog converter, a power amplifier unit 131k, and a network circuit 131m which are electrically coupled through an internal bus system 131n. The controller 131a is implemented by a micro-computer system, and comprises a microprocessor, an interface unit and so forth. The key assigner 131b is operative to identify a key depressed by a player, and reports the depressed key to the controller 131a. The low pass filter unit 131h is implemented by filter network corresponding to sixteen tones, and each of the filter circuits forming a part of the filter network has a cut-off frequency as well as a slop variable with the hammer speed. The read only memory unit 131d stores pieces of vibratory information respectively indicative of vibrations produced on musical wires of an acoustic piano, and the pieces of vibratory information are memorized in the form of line spectrums of the vibrations. The read only memory unit 131e stores pieces of vibratory information respectively indicative of vibrations produced on non-struck musical wires under depressing the damper pedal 122c, because predetermined non-struck musical wires resonate under depressing the damper pedal 122c. The read only memory unit 131f is associated with the soft pedal 122a, and stores pieces of vibratory information for non-struck musical wires produced under depressing the soft pedal 122a. Namely, three musical wires are provided for each key of an acoustic piano, and only two of the three musical wires are struck by a hammer unit when the associated key is depressed. However, the remaining musical wire resonates, and participates the production of an acoustic sound. For this reason, the pieces of vibratory information are stored in the read only memory unit 131f for the non-struck musical wires in the form of line spectrums. However, predetermined time period lapses before the vibrations on the non-struck musical wires, and the controller 131a controls output timings of digital vibration signals under the manipulation of the soft and damper pedals 122a and 122c. in order to control the output timings, the read only memory units 131e and 131f store respective tables indicative of delay time accessible with a depressed key number and the hammer velocity of the associated hammer unit. However, the pieces of vibratory information may be read out from the read only memory units 131e or 131f after the predetermined time delay. Thus, the read only memory units 131d to 131f stores the pieces of vibratory information under the non-manipulation of pedals 122a to 122c, the manipulation of the damper pedal 122c and the manipulation of the soft pedal 122a, and the controller 131a sequentially accesses the pieces of vibratory information with reference to the electric signals supplied from the pedal sensor units 129 and the hammer sensor units 130 so as to produce digital vibration signals indicative of sound produced by an acoustic piano. The equalizer 131i modifies digital vibration signals, and the vibration characteristics of the vibratory board 123 are taken into account. Namely, the equalizer 13i is implemented by a filter network which has frequency characteristics inverse to the frequency characteristics of the vibratory board 123, and the relation between the frequency characteristics of the vibratory board 123 and the frequency characteristics of the filter network can be analogous to that shown in FIGS. 18 to 20. After the modification, the digital vibration signals are converted into analog vibration signals at the digital-to-analog converting unit incorporated in the audio signal generating unit 131j, and the analog vibration signals are further treated by the power amplifier 131k and the network circuit 131m. Thereafter, the analog vibration signals are distributed to the vibratory circular plate 123d and the two auxiliary speaker units 123e and 123f, and the vibratory board 123 produces piano-like sounds.

Figure 64:
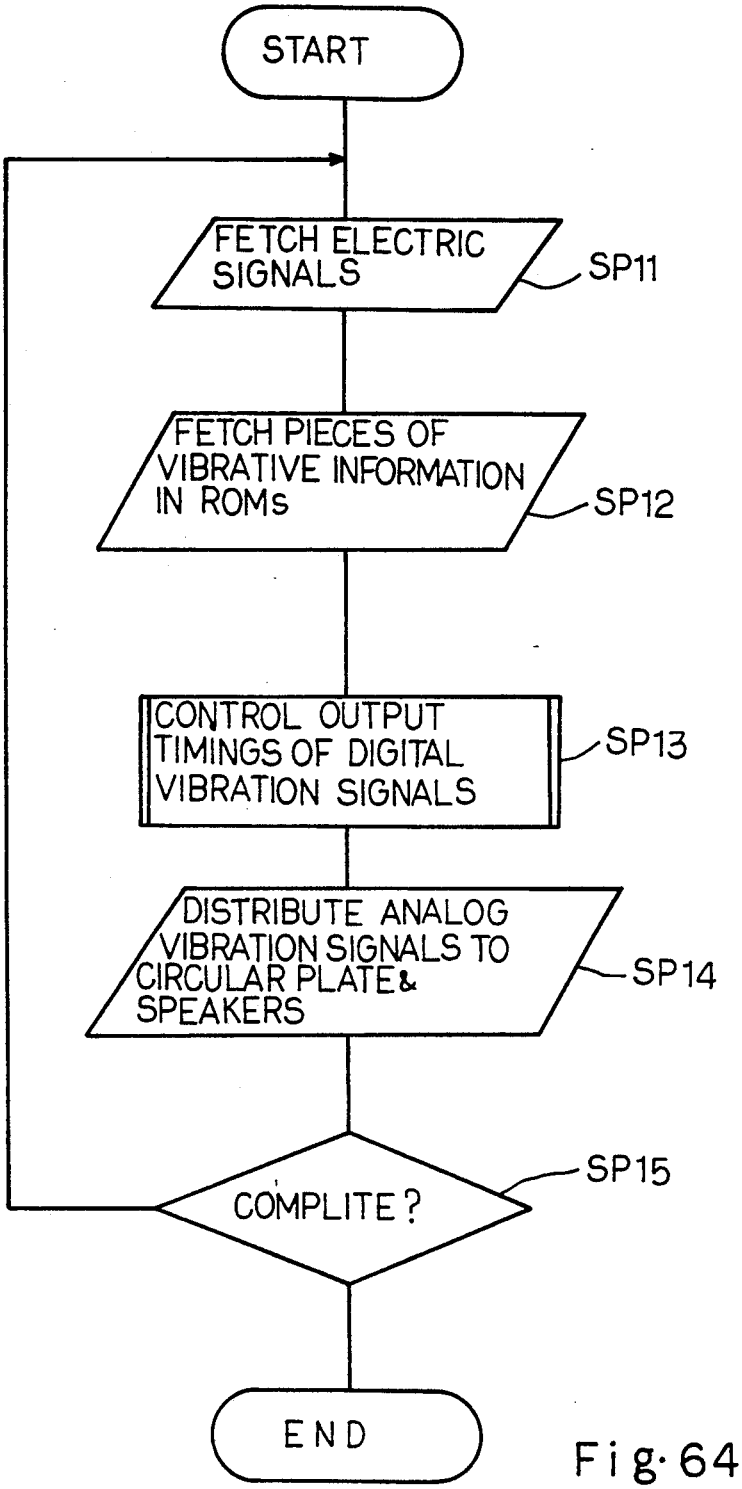
FIG. 64 is a flowchart showing a program sequence executed by an electronic data processing system incorporated in the stringless piano-touch electric sound producer shown in FIG. 61.

Description is hereinbelow made on operation of the stringless piano-touch electric sound producer implementing the fifth embodiment with reference to FIG. 64. When a player starts a music, the key assigner 131b identifies a key depressed by the player, and reports the depressed key to the controller 131a. The controller 131a fetches electric signals produced by the pedal sensor units 129 and the hammer sensor units 130 as by step SP11, and determines hammer action such as the hammer velocity, the impact timing and so forth as well as the status of the pedals 122a to 122c. The controller 131a fetches the pieces of vibratory information stored in the read only memory unit 131d and in the read only memory unit 131e and 131f, if necessary, as by step SP12. The controller 131a produces digital vibration signals indicative of vibrations corresponding to a sound produced by an acoustic piano on the basis of the pieces of vibratory information read out from the read only memory units 131d to 131f, and output timings of the digital vibration signals are controlled as by step SP13. The digital vibration signals thus delivered from the controller 131a are subjected to the predetermined treatments, and are converted into analog vibration signals at the digital-to-analog converting unit of the audio signal generating unit 131j. The analog vibration signals are increased in magnitude at the power amplifier 131k, and are selectively distributed through the network circuit 131m to the vibratory circular plate 123d and the auxiliary speaker units 123e and 123f as by step SP14. Then, the voice coil 126c is energized with current, and the vibratory circular plate 123d vibrates at predetermined line spectrums for producing the sound indicated by the pieces of vibratory information. Since the vibratory circular plate 123d is supported by the ring-shaped corrugation member 213g, the vibratory circular plate 123d easily simulates the vibrations of an acoustic piano sound even if the depressed key is assigned a relatively low pitch tone. However, the auxiliary speaker units 123e and 123f may be used depending upon the tone range of the depressed key. The controller 131a checks the report from the key assigner 131b to see whether or not the performance is completed as by step SP15. If the answer is negative, the controller 131a returns to step SP11, and reiterates the loop consisting of steps SP11 to SP15 until the answer at step SP15 becomes affirmative. When the answer at step SP15 is affirmative, the controller 131a completes the program sequence.

Figure 65:
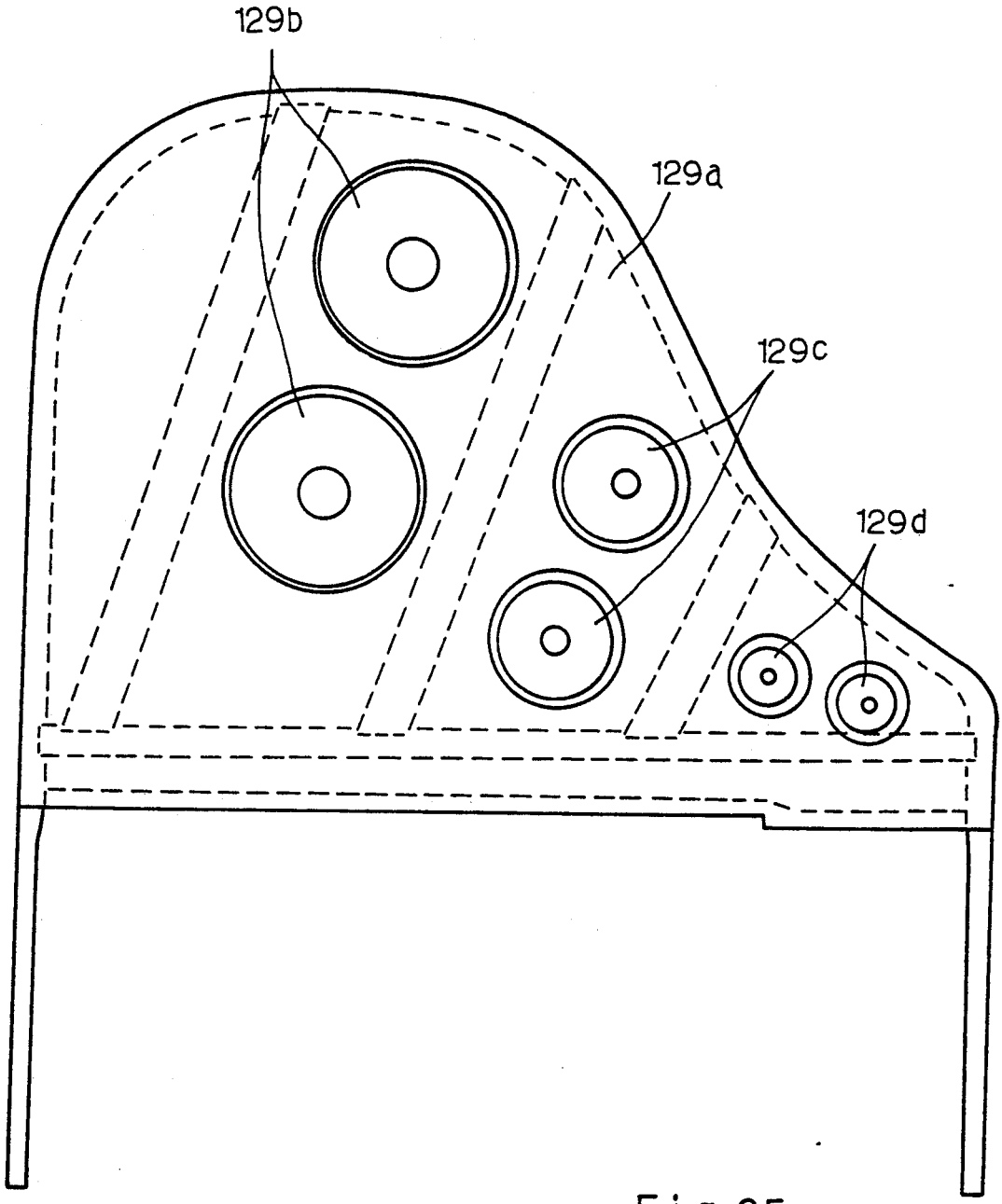
FIG. 65 is a plan view showing a modification of the sound board shown in FIG. 62.

FIG. 65 shows a modification of the vibratory board 123, and the modification comprises a baffle plate 129a, a first pair of speaker units 129b assigned low pitch tones, a second pair of speaker units 129c assigned middle pitch tones and a third pair of speaker units 129d assigned high pitch tones. The first to third pairs of speaker units 129b to 129d are snugly received in the baffle plate 129a, and analog vibration signals are selectively supplied to the first to third speaker units 129b to 129d.

As will be understood from the foregoing description, musical wires and a frame are deleted from the stringless piano-touch electric sound producer implementing the fifth embodiment, and the stringless piano-touch electric sound producer is scaled down in comparison with an acoustic piano. Moreover, the read only memory units 131e and 131f store the pieces of vibratory information indicative of line spectrums for vibrations under manipulation of the soft and damper pedals 122a and 122c, and the controller 131a produces the digital vibration signals on the basis of not only the pieces of vibratory information in the read only memory unit 131d but also the pieces of vibratory information in the read only memory unit 131e or 131f under the manipulation of either soft or damper pedal. This results in that the sound produced on the vibratory board 123 is very close to a sound produced in an acoustic piano.

Sixth Embodiment

Figure 66:
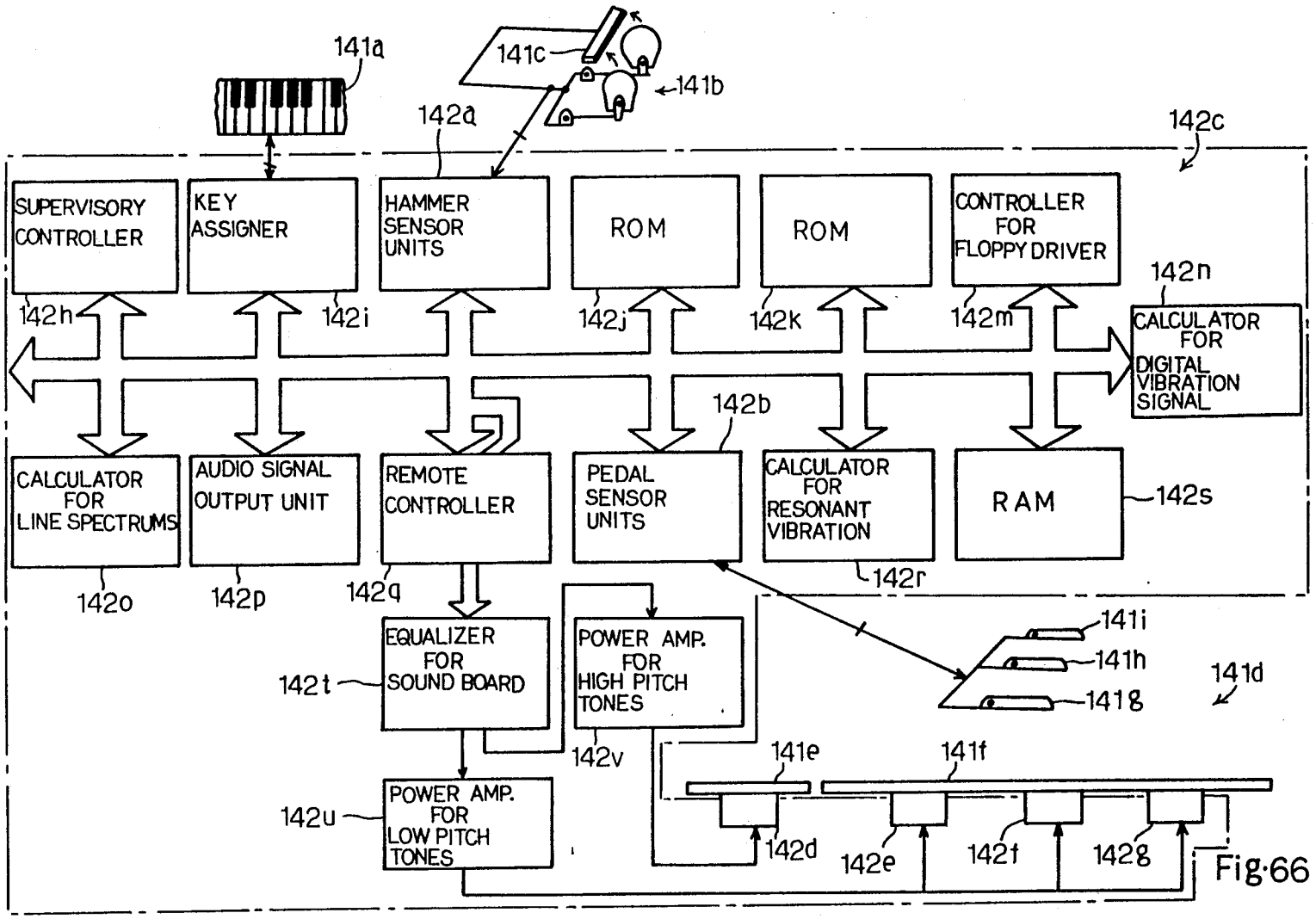
FIG. 66 is a block diagram showing essential part of a stringless piano-touch electric sound producer according to the present invention.

Turning to FIG. 66 of the drawings, essential parts of yet another stringless piano-touch electric sound producer embodying the present invention largely comprises a piano-like keyboard musical instrument, and an electric system. The piano-like keyboard musical instrument comprises a key board 131a with 88 keys, a plurality of key action mechanisms (not shown) associated with keys on the keyboard 141a, a plurality of hammer units 141b associated with the keys on the keyboard 141a and driven for rotation by the associated key action mechanisms upon depressing the associated keys, a beam unit 141c shared between the hammer units 141b or the hammer shanks and struck therewith, a sound board 141d split into a first board member 141e for high pitch tones and a second board member 141f for low pitch tones, and soft, muffler and damper pedals 141g, 141h and 141i rockablly supported by a pedal box (not shown). The first board member 141e is smaller in area than the second board member 141f, and the first and second board members 141e and 141f are suitable for producing appropriate vibrations for the high pitch tones and the low pitch tones. The piano-like keyboard musical instrument thus arranged does not have any musical wires, any frame, any tuning pins and any damper head, and, for this reason, is scaled down rather than an acoustic piano.

The electric system incorporated in the stringless piano-touch electric sound producer largely comprises sensor arrays 142a and 142b, an electronic data processing system 142c and electromagnetic actuators 142d, 142e, 142f and 142g attached to the sound board 121. Each of the electromagnetic actuators 142d to 142g is implemented by combination of a permanent magnet piece, a yoke member and a voice coil, and is energized with current for producing vibrations on the sound board 141d. In this instance, the voice coil is attached to the sound board 141d, and the casing of the permanent magnetic piece is supported by a reinforcing beam (not shown) forming a part of a housing of the stringless piano-touch electric sound producer.

The sensor array 142a is implemented by a pressure sensor unit as well as a plurality of reflection type photo couplers respectively associated with the plurality of hammer units 141b. The pressure sensor unit is attached to the beam unit 141c, and is operative to detect vibrations produced thereon. In this instance, the pressure sensor unit is implemented by a piezo-electric transducer. The reflection type photo couplers are respectively provided in the vicinity of loci of the hammer shanks of the respective hammer units 141b, and detect the hammer shanks moved toward the beam member 141 upon depressing the associated keys. The pressure sensor unit produces an electric signal indicative of impact force applied from a hammer unit, and the reflection type photo couplers produce respective electric signals each indicative of lapse of time for crossing optical path radiated therefrom. The electric signals from the reflection type photo couplers are respectively used for calculating hammer velocities.

The pedal sensor units 142b is implemented by three sensor units respectively provided in association with the soft, muffler and damper pedals 141g to 141i, and each of the three sensor units detects displacement of the associated pedal for producing an electric signal indicative of the displacement.

The electronic data processing system comprises a supervisory controller 142h, a key assigner 142i, read only memory units 142j and 142k, a controller 142m for a floppy disk driver (not shown), a calculator 142n for digital vibration signals, a calculator 142o for line spectrums, an audio signal output unit 142p, a remote controller 142q, a calculator 142r for resonant vibrations, a random access memory unit 142s serving as working memory, an equalizer 142t for the sound board 141d, a power amplifier unit 142u for the electromagnetic actuators 142e to 142g, and a power amplifier unit 142v for the electromagnetic actuator 142d.

The supervisory controller 142h has a central processing unit, and supervises the other component units, and communicates therewith for executing a predetermined control sequence. The key assigner 142i is provided in association with the key board 141a, and identifies a key depressed by a player. The read only memory unit 142j stores pieces of vibratory information respectively indicative of line spectrums of vibrations produced on musical wires of an acoustic piano previously sampled or calculated. However, the pieces of vibratory information may be replaced with corresponding sound data. The line spectrums are calculated on the assumption that any one of the pedals 141g to 141i is not depressed, and are broken down into 88 groups respectively corresponding to the 88 keys. Since higher harmonic components are emphasized in a line spectrum produced on musical wires when the associated hammer unit violently strikes, the line spectrums should be modified depending upon the hammer velocity of the associated hammer unit, and the calculator 142n modifies the line spectrum with reference to the hammer velocity calculated from the electric signal of the hammer sensor units 142a.

In another implementation, the read only memory unit 142j may stores fundamental frequencies of the respective sets of musical wires. In this instance, the line spectrums are calculated from one of the fundamental frequency f1 in a real time manner. If one of the fundamental frequency f1 is selected from the read only memory unit 142j, the calculator 142o can produce the peak frequency of a line spectrum $f(_n)$ through Equation 2.

$$f(_n)=nf1(1+Bn^2)^{\frac{1}{2}} \qquad \text{Equation 2}$$

where n is a natural number indicative of the degree of a peak frequency. Equation 2 teaches us that the component frequency is non-harmonic because of B. B is given by Equation 3.

$$B=(phi)^2\,EAK^2/\,(TL^2) \qquad \text{Equation 3}$$

where A is the cross section of a musical wire, K is radius of curvature, and T is tensile force exerted on the musical wire. The relative intensity between the peak frequencies is given by Equation 4.

$$|R(w)|=|\sin\{(phi/L)\times(L/H)\times n\}|/n \qquad \text{Equation 4}$$

where H is impact ratio.

The read only memory unit 142k stores pieces of vibratory information respectively indicative of line spectrums of resonant vibrations produced on the musical wires of the acoustic piano under manipulation of the damper pedal 141i. In an acoustic piano, while the damper pedal is depressed, predetermined non-struck musical wires resonate upon striking a set of musical wires with a hammer unit, and six sets of resonant musical resonate at the maximum. However, if a key lower than the thirteenth key is depressed, the second, third, fourth and sixth harmonic overtones are taken into account in practice usage. However, if the depressed key is higher than the thirteenth key, it is desirable to take the set of musical wires for the key one-octave lower than the depressed key into account. Therefore, the read only memory device 142k stores the pieces of vibratory information indicative of the line spectrums of resonant vibrations of those predetermined non-struck musical wires accessible with the depressed key. However, the line spectrums of the resonant vibrations are also varied with the hammer velocity, and the calculator 142r modifies the line spectrums of the resonant vibrations with reference to the hammer velocity calculated from the electric signal supplied from the reflection type photo coupler associated with the hammer unit.

In another implementation, the line spectrums of resonant vibrations are calculated by the calculator 142r, and the calculator 142r can simultaneously cope with six depressed keys under manipulation of the damper pedal. The calculator 142r can calculates first to eighth harmonic overtones for each key, and the harmonic overtone fn is given by Equation 5.

$$fn=nf1(1+Bn_2)^{\frac{1}{2}} \qquad \text{Equation 5}$$

The intensity of each line spectrum is varied with the depressed key, and the resonant tones range from −10 dB to −20 dB. However, the resonant tones take place after hundreds milliseconds to several seconds after the tone from the vibrations on the musical wires associated with a depressed key, and are maintained for several seconds in so far as the damper pedal is released. However, if the damper pedal is released before decay of the sound, the pedal sensor units 142b detects the release, and instructs the audio signal output unit 142p to terminate the sound. However, if the player maintains the damper pedal at the half-pedal position and, then, releases the damper pedal, the decay of sound is regulated in accordance with the pedal operation. The audio signal output unit 142p can provide one of three sequences, i.e., rapid termination, ordinal termination and gradual termination depending upon the pedal operation. For example, in case of oblique contact with the musical wires, the low pitch tones are decayed slower than high pitch tones. Additionally, the pedal is maintained in the half-pedal position, it is desirable to modify the ratio between the fundamental tone and the harmonic overtones and to decay higher harmonic components faster than lower harmonic components.

The audio signal output unit 142p is responsive to an internal digital signal indicative of release of the depressed key supplied from the key assigner 142i, and causes vibrations on the sound board 141d to be decayed.

The equalizer is supplied with digital vibration signals, and is implemented by a digital filter network so as to modify the digital vibration signals as similar to the 131i shown in FIG. 61. The modified digital vibration signals are converted to analog vibration signals at a digital-to-analog converting circuit associated with the equalizer 142t, and the analog vibrations signals are increased at the power amplifier units 142u and 142v before reaching the electromagnetic actuators 142d to 142g.

Figure 67:
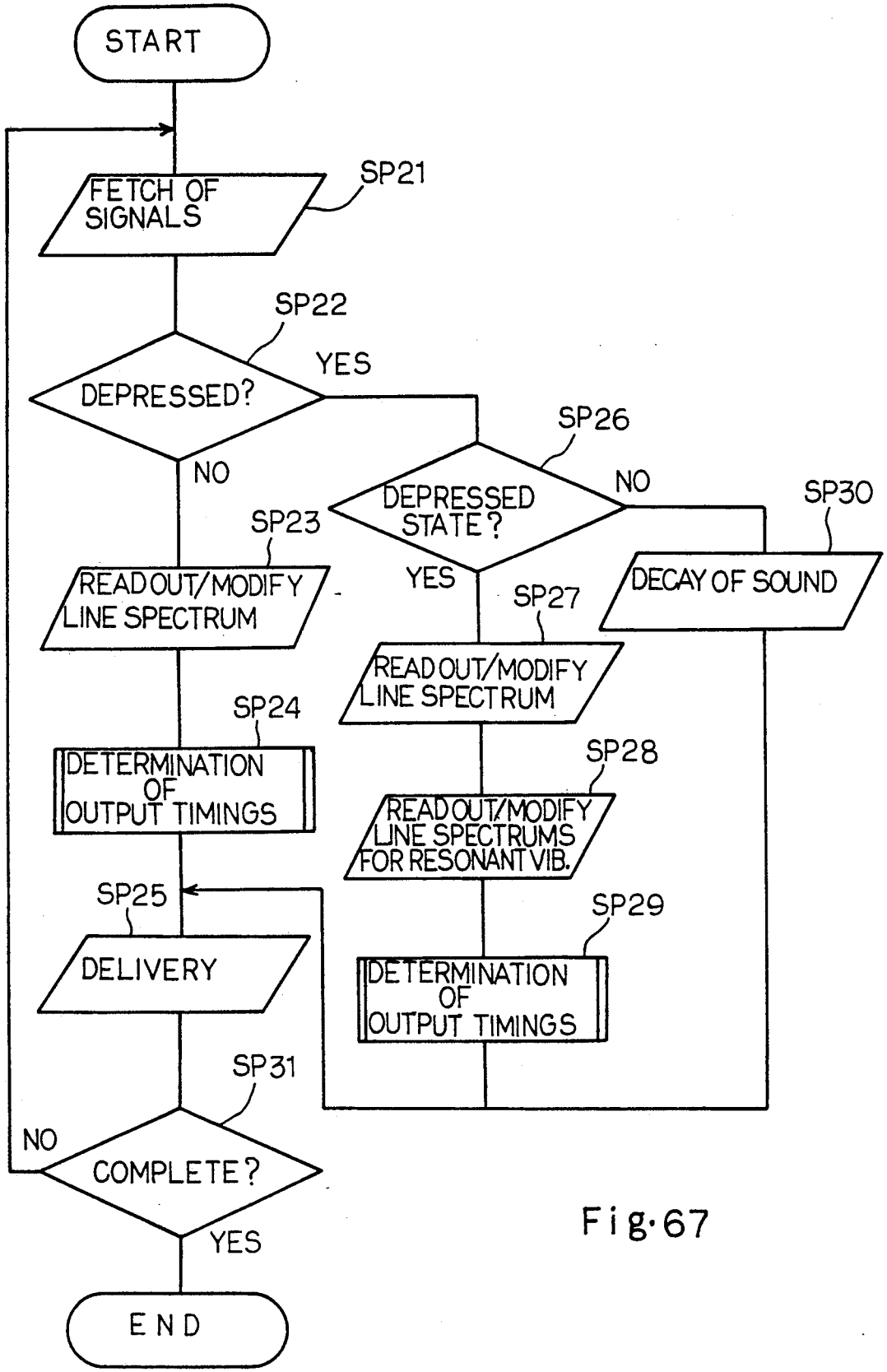
FIG. 67 is a flowchart showing a program sequence executed by an electronic data processing system incorporated in the stringless piano-touch electric sound producer shown in FIG. 66.

Description hereinbelow made on operation with reference to FIG. 67 of the drawings When a player depresses a key, the program sequence shown in FIG. 67 starts with fetch of signals as by step SP21. Namely, the key assigner 142i identifies the depressed key, and reports the depressed key to the supervisory controller 142h. The hammer sensor units 142a detects the hammer motion, and supplies the electric signal indicative of the hammer motion to the supervisory controller 142h. Subsequently, the supervisory controller 142h checks the pedal sensor units to see whether or not the damper pedal 141i is depressed by the player as by step SP22. If the answer is negative, the supervisory controller 142h proceeds to step SP23, and the supervisory controller 142h reads out a pieces of vibratory information indicative of vibrations on musical wires from the read only memory unit 142j and causes the calculator 142n to modify the piece of vibratory information with reference to the hammer velocity, if necessary. However, the line spectrum may be calculated on the basis of the fundamental frequency as described hereinbefore. The line spectrum indicative of the vibrations on the musical wires are used for producing digital vibration signals, and the supervisory controller 142h determines output timings for the digital vibration signals as by step SP24. The digital vibration signals are delivered to the internal bus system at the output timings as by step SP25, and the digital vibration signals are subjected to the predetermined treatments at the equalizer 142t. After the treatments, the digital vibration signals are converted into analog vibration signals, and are distributed to the electromagnetic actuators 142*d* to 142*g* after the amplification. Then, the sound board 141*d* vibrates, and a sound is produced therefrom.

However, if the answer at step SP22 is affirmative, the supervisory controller 142*h* checks the electric signal indicative of the manipulation of the damper pedal 141*i* to see whether or not the player keeps the damper pedal in depressed state as by step SP26. If the answer at step SP27 is affirmative, the supervisory controller 142*h* reads out the piece of vibratory information indicative of the line spectrum from the read only memory device 142*j* as similar to step SP23, and the line spectrum is modified with reference to the hammer velocity as by step SP27. The line spectrum may be calculated from the fundamental frequency inherent in the musical wires. The supervisory controller 142*h* further reads out a pieces of vibratory information indicative of line spectrums for the resonant vibrations from the read only memory unit 142*k* as by step SP28. The line spectrums thus read out are modified, if necessary. The line spectrums thus read out from the read only memory units 142*j* and 142*k* are used for producing digital vibration signals, and the supervisory controller 142*h* proceeds to step SP29 for determining output timings. The digital vibration signals are delivered to the internal bus system at the output timings as by step SP25, and the digital vibration signals are subjected to the predetermined treatments at the equalizer 142*t*. After the treatments, the digital vibration signals are converted into analog vibration signals, and are distributed to the electromagnetic actuators 142*d* to 142*g* after the amplification. Then, the sound board 141*d* vibrates, and a sound is produced therefrom. The digital vibration signals indicative of the resonant vibrations allow the sound board 141*d* to vibrate in a different manner, and damper effects are imparted to the sound as similar to an acoustic piano.

If the player releases the damper pedal 141*i*, the answer at step SP26 is negative, and the supervisory controller 142*h* allows the audio signal output unit 142*p* to decay the sound produced from the sound board 141*d* as by step SP30. However, the pedal sensor units 142*b* monitors the pedal operation, and the audio signal output unit 142*p* allows the sound to trace one of the rapid termination course, ordinary termination course and the gradual termination course.

The supervisory controller 142*h* proceeds to step SP31 to see whether or not the player completes the music. If the answer at step SP31 is negative, the supervisory controller 142*h* reiterates the loop consisting of steps SP21 to SP31 until the answer at step SP31 is given affirmative. When the answer at step SP31 is affirmative, the supervisory controller 142*h* completes the program sequence.

Figure 68:
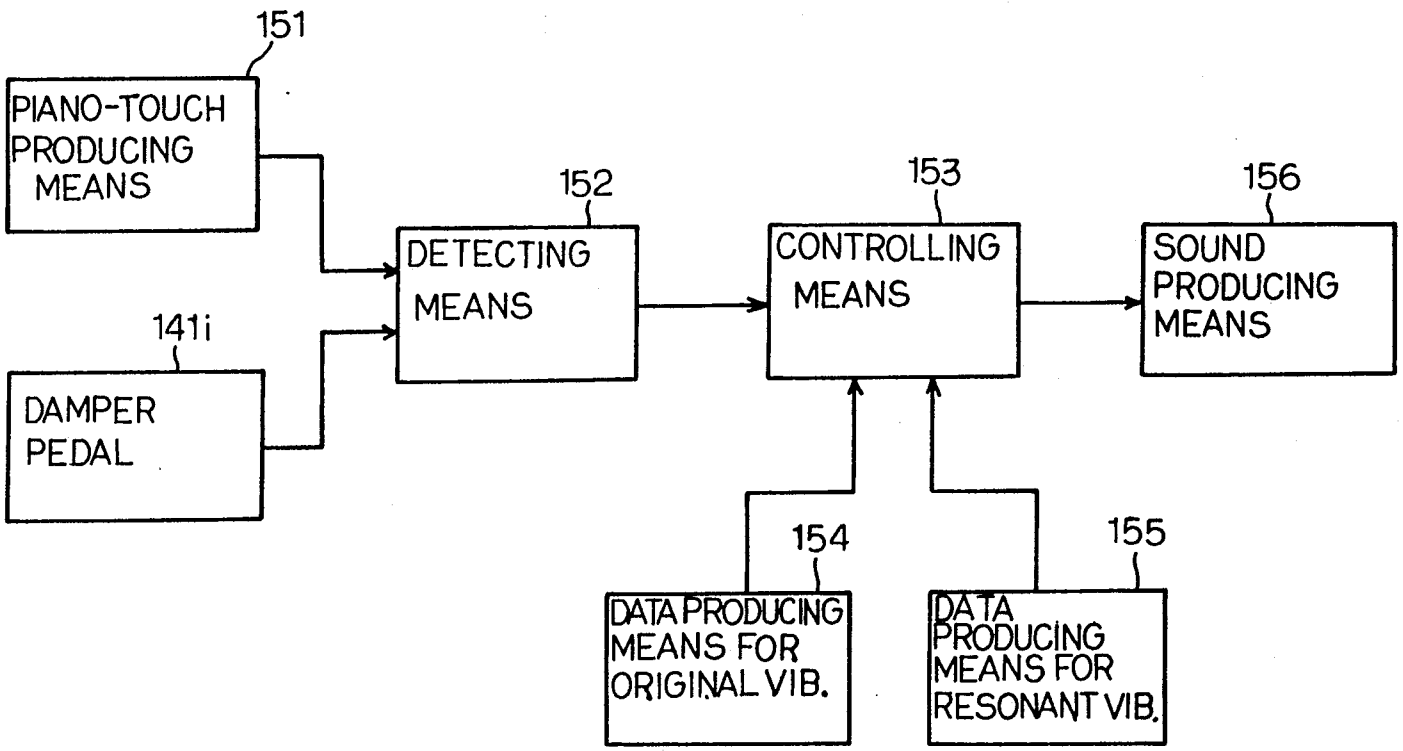
FIG. 68 is a block diagram showing relation between means of the stringless piano-touch electric sound producer shown in FIG. 66 from a first aspect.

The operation of the stringless piano-touch electric sound producer is summarized from an aspect, and FIG. 68 shows one of the gist of the sixth embodiment. The keyboard 141*a*, the key action mechanisms and the hammer units 141*b* form in combination a piano-touch producing means 151, and the piano-touch producing means 151 and a damper pedal 141*i* are monitored by a detecting means 152. The detecting means 152 detects the motion of the piano-touch producing means 151 and the damper pedal 141*i*, and reports them to a controlling means 153. The detecting means 152 is implemented by the hammer sensor 142*a*, the pedal sensor units 142*b* and the key assigner 142*i*, and the controlling means 153 corresponds to the combination of the supervisory controller 142*h*, the calculator 142*n*, the audio signal output unit 142*p*, equalizer 142*t* and the power amplifier units 142*u* and 142*v*. If the damper pedal 141*i* is not depressed, a data producing means 154 supplies vibratory information indicative of original vibrations originally produced on music wires upon striking, and is implemented by the read only memory unit 142*j* and the calculator 142*o*. On the other hand, if the damper pedal 141*i* is depressed, a data producing means 155 supplies vibratory information indicative of resonant vibrations produced on predetermined musical wires together with the data producing means 154, and is implemented by the read only memory nit 142*k* and the calculator 142*r*. Then, the controlling means 153 instructs a sound producing means 156 to produce a sound on the basis of the motions of the piano-touch producing means 151 and the damper pedal 141*i*.

Figure 69:
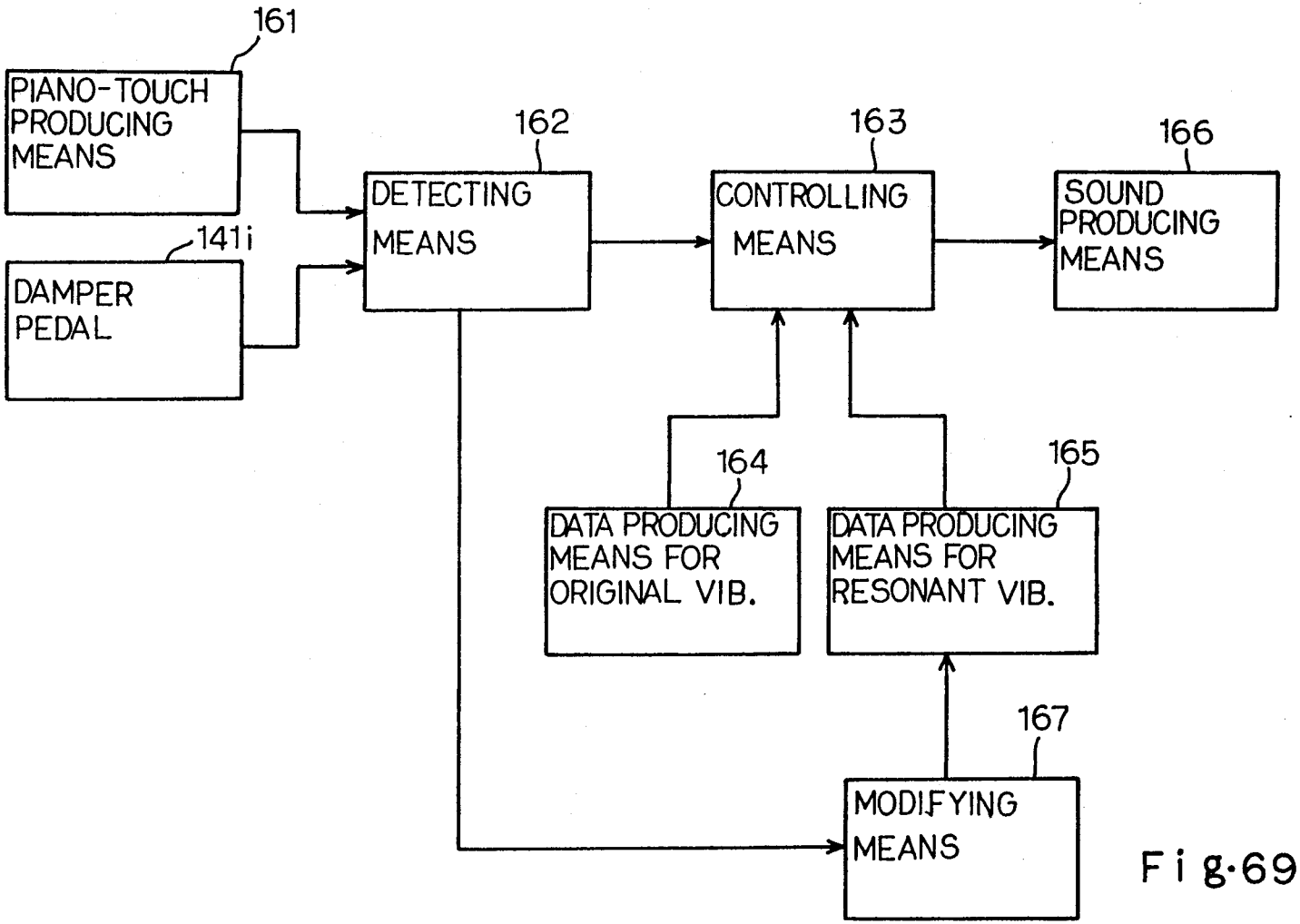
FIG. 69 is a block diagram showing relation between means of the stringless piano-touch electric sound producer shown in FIG. 66 from a second aspect.

The sixth embodiment may be summarized as shown in FIG. 69 from another aspect. The keyboard 141*a*, the key action mechanisms and the hammer units 141*b* form in combination a piano-touch producing means 161, and the piano-touch producing means 161 and a damper pedal 141*i* are monitored by a detecting means 162. The detecting means 162 detects the motion of the piano-touch producing means 161 and the damper pedal 141*i*, and reports them to a controlling means 163. The detecting means 162 is implemented by the hammer sensor 142*a*, the pedal sensor units 142*b* and the key assigner 142*i*, and the controlling means 163 corresponds to the combination of the supervisory controller 142*h*, the calculator 142*n*, the audio signal output unit 142*p*, equalizer 142*t* and the power amplifier units 142*u* and 142*v*. If the damper pedal 141*i* is not depressed, a data producing means 164 supplies vibratory information indicative of original vibrations originally produced on music wires upon striking, and is implemented by the read only memory unit 142*j* and the calculator 142*o*. On the other hand, if the damper pedal 141*i* is depressed, a data producing means 165 supplies vibratory information indicative of resonant vibrations produced on predetermined musical wires together with the data producing means 164, and is implemented by the read only memory nit 142*k* and the calculator 142*r*. Then, the controlling means 153 instructs a sound producing means 166 to produce a sound on the basis of the motions of the piano-touch producing means 161 and the damper pedal 141*i*. When the damper pedal 141*i* is released, a modifying means 167 controls decay of the sound depending upon the pedal operation, and the sound is either rapidly, ordinarily or gradually decayed. The modifying means 167 is implemented by the pedal sensor unit 142*b* and the audio signal output unit 142*p*.

Seventh Embodiment

Figure 70:
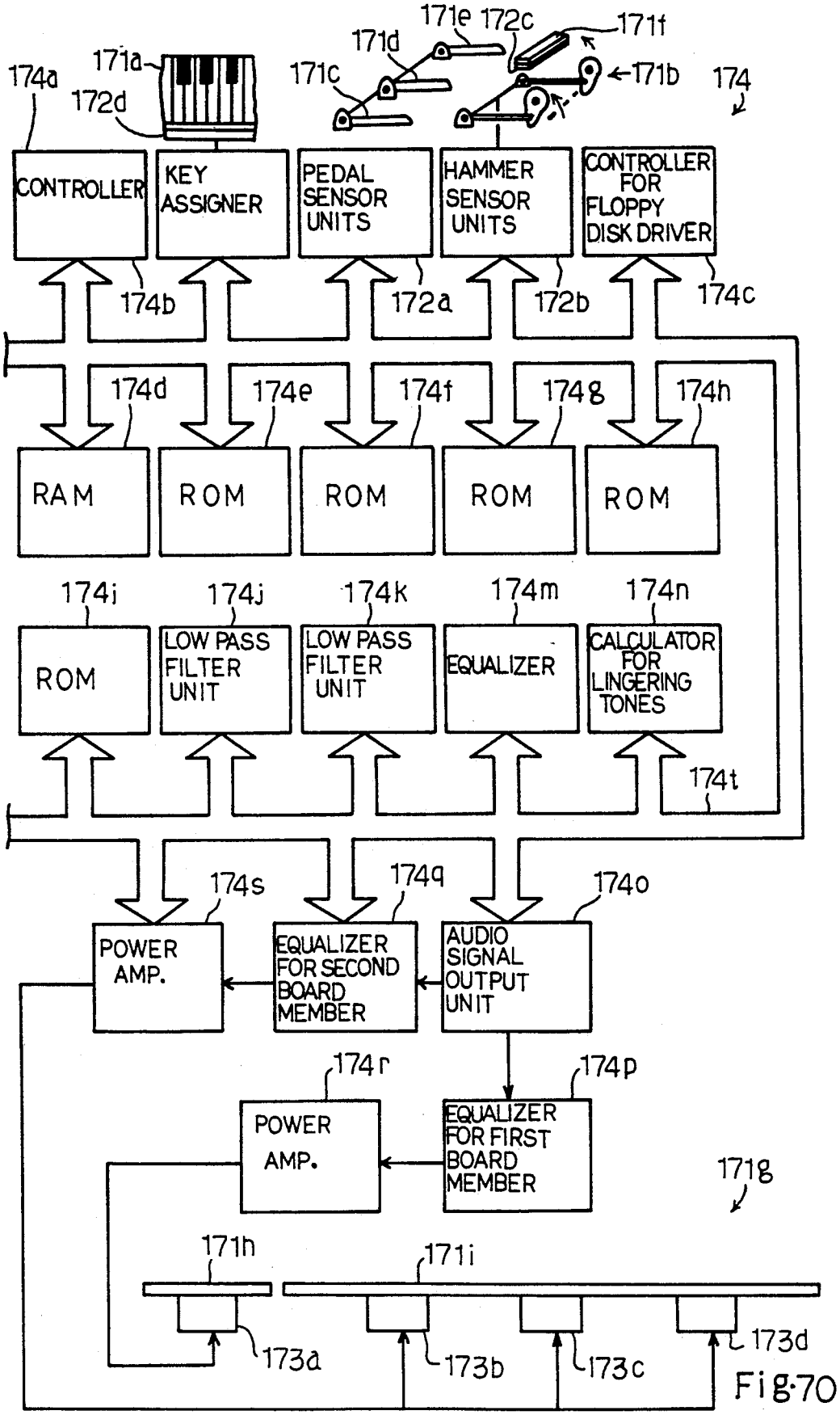
FIG. 70 is a block diagram showing the arrangement of a stringless piano-touch electric sound producer according to the present invention.

Turning to FIG. 70 of the drawings, a stringless piano-touch electric sound producer embodying the present invention largely comprises a piano-like keyboard musical instrument, and an electric system. The piano-like keyboard musical instrument comprises a housing (not shown), a keyboard 171*a* with 88 keys, a plurality of key action mechanisms (not shown) associated with the keys, respectively, a plurality of hammer units 171*b* respectively driven for rotations by the plurality of key action mechanisms upon depressing the associated keys, soft, muffler and damper pedals 171*c*, 171*d* and 171*e* rockablly supported by a pedal box (not shown), a beam unit 171f shared between the hammer units 171b or the hammer shanks, and a sound board 171g split into a first board member 171h and a second board member 171i. The first board member is smaller in area than the second board member 171i. The first board member 171h is suitable for vibrations of high pitch tones, and the second board member 171i is desirable for low pitch tones. However, musical wires, turning pins, a damper head and a frame are deleted from the piano-like keyboard musical instrument.

The electric system largely comprises pedal sensor units 172a for detecting displacements of the pedals 171c to 171e, hammer sensor units 172b implemented by a plurality of reflection type photo couplers for detecting the associated hammer units 171b crossing optical paths radiated therefrom, a pressure sensor array 172c implemented by a plurality of piezo-electric transducers for detecting impact force, a key sensor array 172d implemented by a plurality of reflection type photo couplers for detecting the associated depressed keys crossing optical paths radiated therefrom, electromagnetic actuators 173a, 173b, 173c and 173d, and an electronic data processing system 174.

The electronic data processing system 174 comprises a controller 174a, a key assigner 174b, a controller 174c for a floppy disk driver, a read only memory unit 174d serving as a working memory, read only memory units 174e, 174f, 174g, 174h and 174i, low pass filter units 174j and 174k, an equalizer 174m, a calculator 174n for lingering tones, an audio signal output unit 174o equipped with a digital-to-analog converter, an equalizer for the first board member 174p, an equalizer for the second board member 174q, and power amplifier units 174r and 174s which are electrically coupled through an internal bus system 174t.

The controller 174a is implemented by a microcomputer system, and comprises a microprocessor, an interface unit and so forth. The key assigner 174b is communicable with the key sensor array 172d and operative to identify a key depressed by a player. The key assigner 174b reports the depressed key to the controller 174a.

The electric signals produced by the hammer sensor units 172b are used for calculating hammer velocities of the hammer units 171b driven for rotations. Each of the electromagnetic actuators 173a to 173d comprises a permanent magnet piece, a yoke member and a voice coil, and the voice coil and the casing of the permanent magnet piece are respectively attached to the first or second board member 171h or 171i and a stationary post member (not shown). When the voice coils are energized with current, the first and second board members 171h and 171i respectively vibrate so as to produce piano-like sounds.

The read only memory unit 174e stores pieces of vibratory information broken down into 88 groups respectively corresponding to 88 keys, and the pieces of vibratory information are indicative of line spectrums of vibrations. The pieces of vibratory information are produced through sampling on actual vibrations produced on musical wires of an acoustic piano. Inharmony due to S-shaped curve of an acoustic piano are taken into account. However, the pieces of vibratory information stored in the read only memory unit 174e may be produced through calculation on the basis of fundamental frequencies inherent in the respective musical wires. The pieces of vibratory information are modified depending upon the hammer velocity calculated from the electric signal from the hammer sensor units 172b, because higher harmonic components are increased when musical wires are violently struck. The read only memory unit 174f stores pieces of vibratory information indicative of line spectrums of vibrations, and sounds produced on the basis of the pieces of vibratory information in the read only memory unit 174f are slightly higher in pitch than the sounds produced from the pieces of vibratory information in the read only memory unit 174e. The read only memory unit 174g also stores pieces of vibratory information indicative of line spectrums of vibrations, and sound produced from the pieces of vibratory information in the read only memory unit 174g are slightly lower than the sounds produced from the pieces of vibratory information in the read only memory unit 174e. The pieces of vibratory information in the read only memory units 174f and 174g are used for imparting warmth to sounds. The read only memory unit 174h stores pieces of vibratory information indicative of line spectrums of resonant vibrations on non-struck musical wires, and sounds produced form the pieces of vibratory information in the read only memory unit 174h rise slower than those produced from the pieces of vibratory information stored in the read only memory unit 174e. Namely, a set of three musical wires are provided for each key in an acoustic piano, and only two of the three musical wires are struck with the associated hammer unit upon depressing the soft pedal. However, the third musical wire resonates after a small amount of time interval, and the pieces of vibratory information in the read only memory unit 174h are indicative of the line spectrums of the resonant vibrations. The sounds produced from the pieces of vibratory information in the read only memory unit 174h are of asymmetric sound. The read only memory unit 174i stores pieces of vibratory information indicative of line spectrums of resonant vibrations produced on predetermined musical wires upon depressing the damper pedal 171e. The pieces of vibratory information are produced through sampling on musical wires, and are modified depending upon hammer velocity. Since time delay is introduced in production of sounds due to resonant vibrations, the line spectrums of the resonant vibrations may be calculated by the calculator 174n.

In another implementation, the line spectrums may be calculated from fundamental frequency at the controller 174a.

Figure 71:
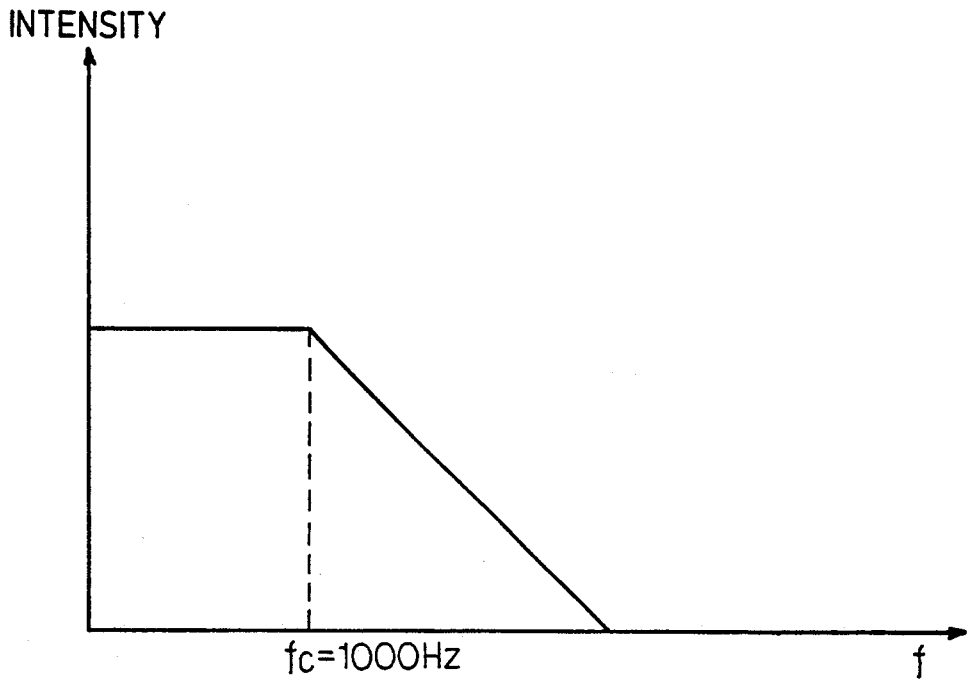
FIG. 71 is a graph showing frequency characteristics of a filter unit incorporated in the stringless piano-touch electric sound producer shown in FIG. 70.
Figure 72:
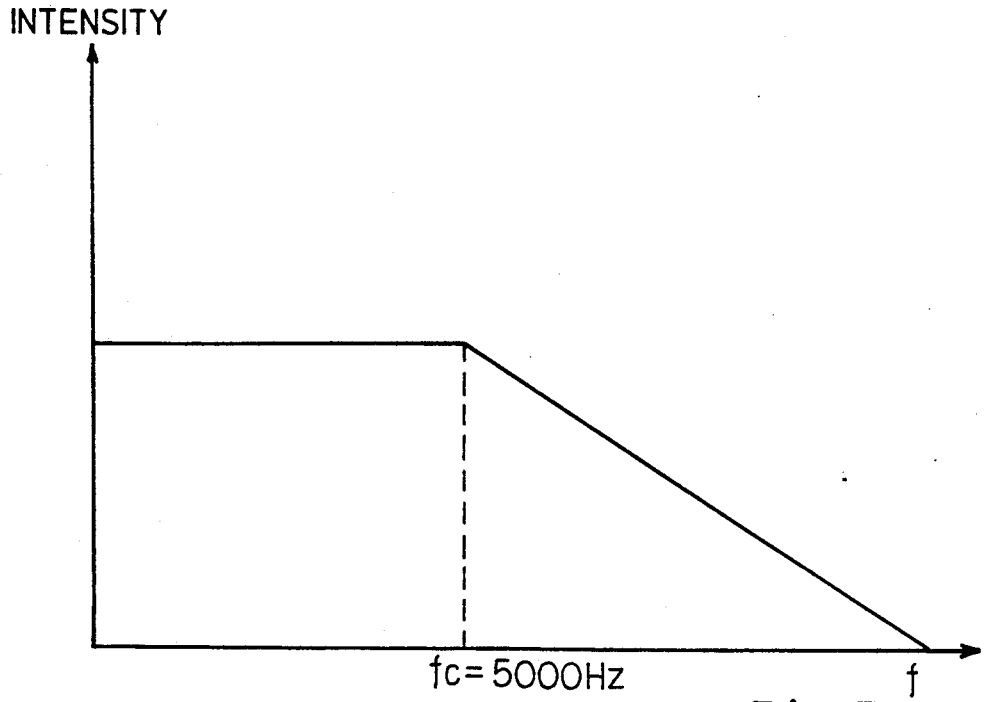
FIG. 72 is a graph showing other frequency characteristics of the filter unit.
Figure 73:
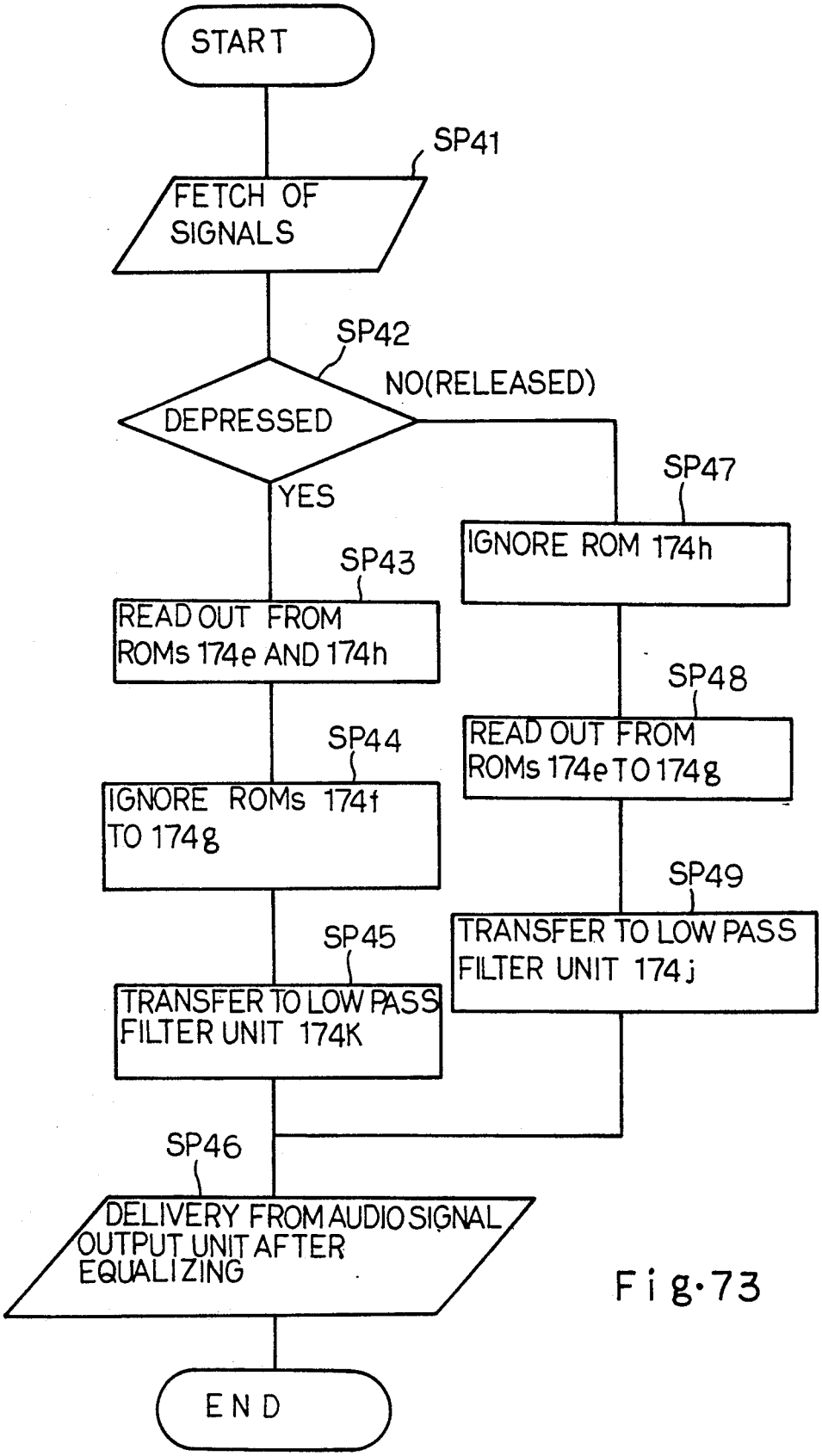
FIG. 73 is a flowchart showing a program sequence of the stringless piano-touch electric sound producer shown in FIG. 70.

The low pass filter unit 174k is used for digital vibration signals produced on the basis of pieces of vibratory information read out from the read only memory units 174e to 174g, and causes the digital vibration signals to modify the timbre of sounds, because relatively fresh and soft portion of a hammer unit strikes the musical wires under manipulation of a soft pedal of an acoustic piano. The low pass filter unit 174k selectively applies frequency characteristics such as, for example, cut-off frequency and decay slope to the modification of timbre depending upon impact force indicated by the electric signal from the pressure sensor array 172d. FIG. 71 shows frequency characteristics in case of relatively week impact, and the decay slope is about 12 dB/ octave FIG. 72 shows frequency characteristics in case of relatively strong impact, and the decay slope is about 6 dB/ octave.

The low pass filter unit 174j is implemented by filter network corresponding to sixteen tones, and each of the filter circuits forming a part of the filter network has a cut-off frequency as well as a decay slop variable with hammer velocity. In general, relatively strong impact causes the cut-off frequency to be higher and the decay slope to be gentle. However, either cut-off frequency or decay slope may be varied depending upon impact force in a simple controlling sequence.

The equalizer 174m modifies digital vibration signals, and frequency characteristics of the sound board 171g is taken into account. Relation between the filtering characteristics and the frequency characteristics of the sound board 171g is analogous to that shown in FIGS. 18 to 20.

The audio signal output unit 174o converts digital vibration signals produced from the pieces of vibratory information read out form the read only memory units 174e to 174h into analog vibration signals after the equalizing operation at the equalizer 174q. The analog vibration signals are separately equalized at the equalizers 174p and 174q, and the frequency characteristics of the first board member 171h and the frequency characteristics of the second board member 171i are taken into account by the equalizers 174p and 174q, respectively. The analog vibration signals are distributed to the electromagnetic actuators 173a to 173d, and cause the first and second board members 171h and 171i to vibrate for producing sounds.

Description is hereinbelow made on operation of the stringless piano-touch electric sound producer implementing the seventh embodiment. The operational sequence starts with fetch of the signals as by step SP41. The key assigner 174b identifies a key depressed by a player, and reports the depressed key to the controller 174a. The pedal sensor units 172a detects the hammer unit 171b associated with the depressed key, and supplies the electric signal indicative of the time period for crossing the optical radiation. The controller 174a calculates the hammer velocity on the basis of the electric signal supplied from the hammer sensor units 172b.

The controller 174a checks the electric signals supplied from the pedal sensor units 172a to see whether or not the soft pedal 171c is depressed by the player as by step SP42. If the answer at step SP42 is affirmative, the controller 174a accesses the read only memory units 174e and 174h, and pieces of vibratory information are read out from the read only memory units 174e and 174h as by step SP43. The piece of vibratory information read out from the read only memory unit 174e is indicative of line spectrums for musical wires struck under manipulation of the soft pedal of an acoustic piano, and the piece of vibratory information read out from the read only memory unit 174h is indicative of line spectrums for non-struck musical wire under the manipulation of the soft pedal. However, the controller 174a ignores the read only memory units 174f and 174g as by step SP44. The controller 174a produces digital vibration signals on the basis of the pieces of vibratory information read out from the read only memory units 174e and 174h, and the digital vibratory signals thus produced are transferred to the low pass filter unit 174k as by step SP45. After the filtering operation, the digital vibration signals are supplied to the equalizer 174m before the digital-to-analog conversion, and analog vibration signals are distributed to the electromagnetic actuators 173a to 173d after the equalization at the equalizers 174p and 174q and the amplification at the amplifier units 174r and 174s.

However, if the answer at step SP42 is given negative, the controller 174a ignores the read only memory unit 174h as by step SP47, and proceeds to step SP48 so that pieces of vibratory information are read out from the read only memory units 174e and 174f or 174g. The pieces of vibratory information read out from the read only memory units 174e and 174f or 174g are indicative of line spectrums for vibrations produced upon striking musical wires with a hammer unit of an acoustic piano and the associated line spectrums for slightly higher or lower pitch. If the depressed key is assigned low pitch tone, the controller 174a selects the read only memory unit 174f. However, the controller 174a accesses the read only memory unit 174g upon depressing a key assigned a high pitch tone. The controller produces digital vibration signals on the basis of the pieces of vibratory information read out from the read only memory units 174e and 174f or 174g, and the digital vibration signals are supplied to the low pass filter unit 174j instead of the low pass filter unit 174k as by step SP49. The low pass filter unit 174j modifies the digital vibration signals so as to optimize the timbre of a sound, and the controller 174a proceeds to step SP46. After the filtering operation on the digital vibration signals, the digital vibration signals are supplied to the equalizer 174m before the digital-to-analog conversion, and analog vibration signals are distributed to the electromagnetic actuators 173a to 173d after the equalization at the equalizers 174p and 174q and the amplification at the amplifier units 174r and 174s. The sounds produced from the pieces of vibratory information read out form the read only memory units 174e and 174f or 174g are very close to sounds produced by an acoustic piano without manipulation of the soft pedal.

Figure 74:
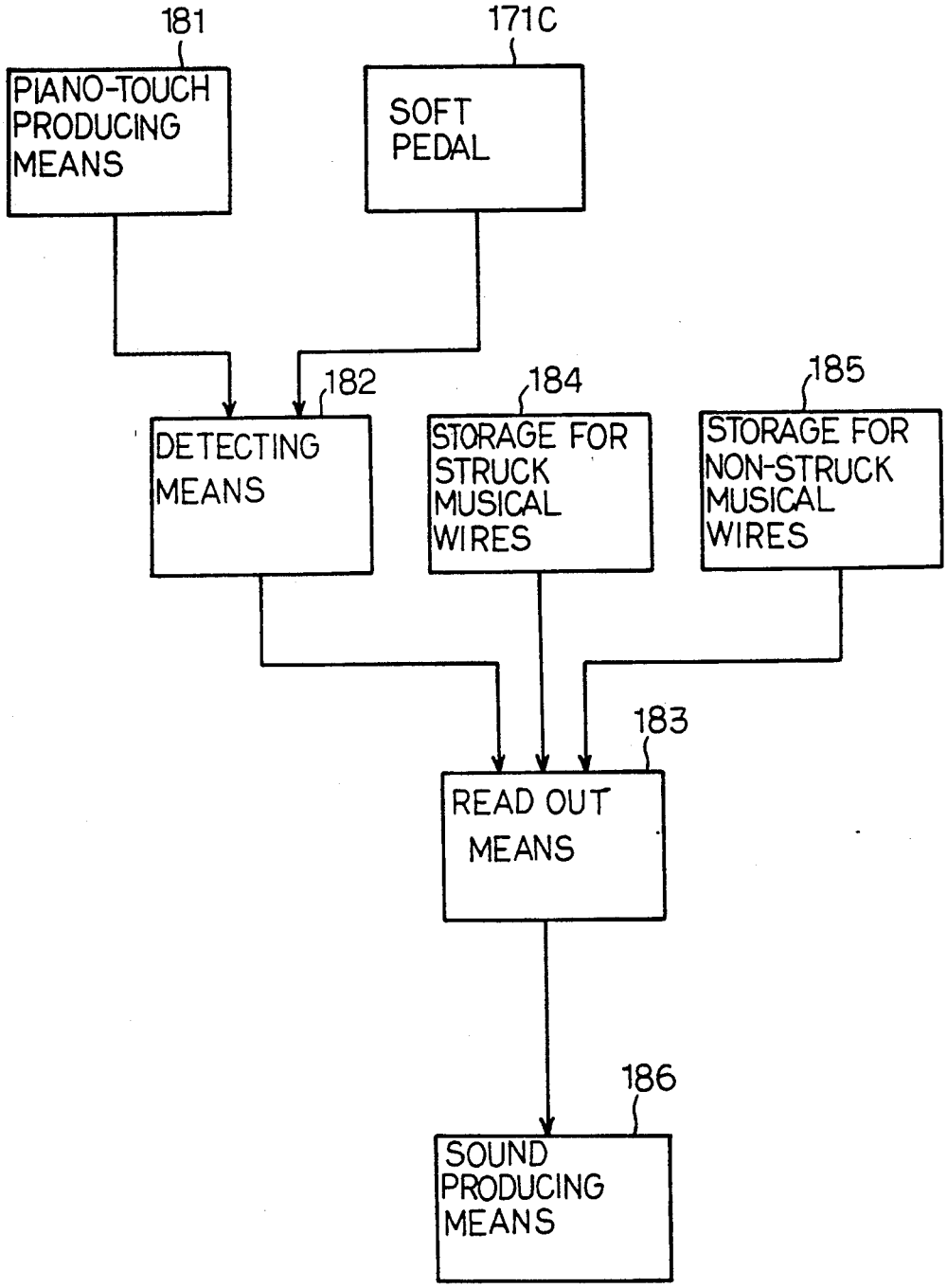
FIG. 74 is a block diagram showing a gist of the stringless piano-touch electric sound producer shown in FIG. 70.

The stringless piano-touch electric sound producer implementing the seventh embodiment can be summarized as shown in FIG. 74. The keyboard 171a, the key action mechanisms and the hammer units 171b as a whole constitute a piano-touch producing means 181, and a detecting means 182 monitors the piano-touch producing means 181 and the soft pedal 171c. The detecting means 182 is implemented by combination of the key sensor array 172d, the pressure sensor array 172c, the hammer sensor units 172b, the pedal sensor units 172a and the key assigner 174b. A read out means 183 selectively fetches pieces of vibratory information stored in a storage for struck musical wires 184 and in a storage for non-struck musical wires 185 depending upon manipulation of the soft pedal 171c, and a sound producing means 186 produces piano-like sounds on the basis of the pieces of vibratory information read out from the storages 184 and 185. The storage 184 is implemented by read only memory units 174e to 174g, and the read only memory unit 174h serves as the storage 185. The read-out means is implemented by the controller 174a, and the controller 174a, the low pass filter units 174j and 174k, the equalizers 174m, 174p and 174q, the audio signal output unit 174o and the power amplifier units 174r and 174s as a whole constitute the sound producing means 186.

Although particular embodiments of the present invention have been shown and described, it will be obvious to those skilled in the art that various changes and modifications may be made without departing from the spirit and scope of the present invention. As described hereinbefore, hammer mechanisms may be arranged in such a manner that the hammer shanks strike a board member instead of the hammer felt members.

What is claimed is:

1. A stringless piano-touch electric sound producer comprising:

a) a keyboard having a plurality of keys independently manipulated by a player;

b) a plurality of hammer units respectively associated with said plurality of keys, and independently driven for rotations;

c) a plurality of key action mechanisms respectively coupled between said plurality of keys and said plurality of hammer units for imparting a piano-touch to said player, and operative to drive the associated hammer units for the rotations upon manipulations of the associated keys, a motion of each key, a motion of the associated key action mechanism and the rotation of the associated hammer unit constituting an impact motion;

d) board means shared between said plurality of hammer units, and allowing said plurality of hammer units to impact while decreasing the volume of sound;

e) a housing unit accommodating said keyboard, said plurality of hammer units, said plurality of key action mechanisms and said board means, and having a plurality of component members including a vibratory board member;

f) sensor means operative to detect said impact motion for producing a detecting signal;

g) a first memory unit storing pieces of vibratory information about vibrations produced on at least musical wires and a component member incorporated in an acoustic piano upon striking said musical wires with hammer units of said acoustic piano;

h) selecting means responsive to said detecting signal for selecting one of said pieces of vibratory information; and i) driving means provided in association with said vibratory board member, and operative to produce vibrations thereon on the basis of said one of said pieces of vibratory information for producing sounds.

2. A stringless piano-touch electric sound producer as set forth in claim 1, in which said board means comprises d-1) a cylinder supported by said housing, d-2) a piston movable into or out of said cylinder, d-3) a plate member attached to the leading end of said piston, and d-4) a spring provided between said cylinder and said plate member for urging said piston in a direction to project from said cylinder.

3. A stringless piano-touch electric sound producer as set forth in claim 1, in which said vibratory board member is a sound board corresponding to a sound board of an acoustic piano.

4. A stringless piano-touch electric sound producer as set forth in claim 1, in which said sensor means comprises f-1) a first sensor used for producing a line spectrum signal indicative of a line spectrum of vibrations actually produced on said board means, f-2) a second sensor used for calculating a hammer velocity, f-3) a third sensor used for calculating a key velocity, f-4) a fourth sensor used for detecting an acceleration of a key, f-5) a fifth sensor used for detecting a manipulation of a damper pedal, f-6) a sixth sensor used for detecting a manipulation of a muffler pedal, and f-7) a seventh sensor used for detecting a manipulation of a soft pedal.

5. A stringless piano-touch electric sound producer as set forth in claim 1, in which said component member is a frame and a post member associated with a key bed both incorporated in said acoustic piano.

6. A stringless piano-touch electric sound producer as set forth in claim 1, in which said driving means is implemented by an electromagnetic actuator unit.

7. A stringless piano-touch electric sound producer as set forth in claim 1, in which said vibratory board member is split into a first vibratory board sub-member for high pitch tones having relatively small amount of area and a second vibratory board sub-member for low pitch tones having relatively large amount of area.

8. A stringless piano-touch electric sound producer as set forth in claim 7, in which said driving means comprises a plurality of actuators selectively attached to said first and second vibratory board sub-members.

9. A stringless piano-touch electric sound producer as set forth in claim 8, in which said one of said pieces of vibratory information is used for producing a first vibration signal for said first and second vibratory board sub-members, said first and second vibration signals being supplied through first and second filter systems to said plurality of actuators, said first and second filter systems being operative to respectively modify said first and second vibration signals in accordance with frequency characteristics of said first and second vibratory board sub-members.

10. A stringless piano-touch electric sound producer as set forth in claim 7, in which said first and second vibratory board sub-members are loosely supported by means of corrugation members.

11. A stringless piano-touch electric sound producer as set forth in claim 7, in which a plurality of elongated holes are formed in a peripheral portion of said second vibratory board sub-member.

12. A stringless piano-touch electric sound producer as set forth in claim 1, in which said selecting means comprises i-1) a MIDI signal generator responsive to said detecting signal for producing a MIDI code signal, i-2) a calculator responsive to said MIDI code signal operative to simulate a line spectrum indicative of vibrations produced on a musical wire of said acoustic piano for producing a line spectrum signal indicative of vibrations produced on said musical wire of said acoustic piano, i-3) an inverted Fourier transformer responsive to said line spectrum signal for producing a digital vibration signal, and i-4) a digital-to-analog converting unit responsive to said digital vibration signal for producing an analog driving signal indicative of said one of said pieces of vibratory information.

13. A stringless piano-touch electric sound producer as set forth in claim 1, in which said selecting means comprises i-1) a MIDI signal generator responsive to said detecting signal for producing a MIDI code signal, i-2) a calculator responsive to said MIDI code signal operative to simulate a line spectrum indicative of vibrations produced on a musical wire of said acoustic piano for producing a line spectrum signal indicative of vibrations produced on said musical wire of said acoustic piano, i-3) an inverted Fourier transformer responsive to said line spectrum signal for producing a digital vibration signal, i-4) a digital-to-analog converting unit responsive to said digital vibration signal for producing an analog driving signal, and i-5) a controller supplied with said analog driving signal, and modifying said analog driving signal in consideration of frequency characteristics of said vibratory board member for producing a plurality of analog driving signals indicative of said one of said pieces of vibratory information.

14. A stringless piano-touch electric sound producer as set forth in claim 1, in which board means comprise d-1) a beam member having a first portion having a first thickness and a second portion having a second thickness, the first thickness being larger than the second thickness, d-2) an elastic sheet member attached to a lower surface of said first portion and to a lower surface of second portion, and d-3) a protective sheet member attached to a lower surface of said elastic sheet member.

15. A stringless piano-touch electric sound producer as set forth in claim 14, in which said beam member is formed of wood, said elastic sheet member is formed of visco-elastic substance, and said protective sheet member is selected from the group consisting of artificial leather and cloth.

16. A stringless piano-touch electric sound producer as set forth in claim 15, in which said beam member has an elongated hollow space exposed to the lower surface thereof so that said elastic sheet member is deformed thereinto upon striking with said plurality of hammer units.

17. A stringless piano-touch electric sound producer as set forth in claim 14, in which said beam member is formed of metal and shaped into a channel configuration, said elastic sheet member is formed of visco-elastic substance, and said protective sheet member is selected from the group consisting of artificial leather and cloth.

18. A stringless piano-touch electric sound producer as set forth in claim 17, in which said beam member has the lower surface bent in such a manner as to form an elongated hollow space so that said elastic sheet member is deformed thereinto upon striking with said plurality of hammer units.

19. A stringless piano-touch electric sound producer as set forth in claim 15, in which said beam member is shaped into a wedge configuration, and said elastic sheet member is shaped into a counter wedge configuration.

20. A stringless piano-touch electric sound producer as set forth in claim 14, in which said elastic sheet member is split into a plurality of elastic units spaced apart from one another and associated with said plurality of hammer units, respectively.

21. A stringless piano-touch electric sound producer as set forth in claim 20, in which each of said elastic units comprises a boss portion attached to the lower surface of said beam member, and two juxtaposed ridges formed on a lower surface of said boss portion, one of said plurality of hammer units being brought into contact with said two juxtaposed ridges.

22. A stringless piano-touch electric sound producer as set forth in claim 21, in which an elongated hollow space in formed in said beam member and exposed to the lower surface thereof.

23. A stringless piano-touch electric sound producer as set forth in claim 14, in which said elastic sheet member comprises a boss portion attached to the lower surface of said beam member, and a plurality of small projections formed on a lower surface of said boss portion, one of said plurality of hammer units being brought into contact with small projections selected from said plurality of small projections.

24. A stringless piano-touch electric sound producer as set forth in claim 1, in which said sensor means has a pressure sensor provided in association with said board means for detecting at least impact force applied with one of said plurality of hammer units, said pressure sensor comprising a reflecting sheet member attached on an upper surface of said elastic sheet member, and a photo coupler faced to said reflecting sheet member.

25. A stringless piano-touch electric sound producer as set forth in claim 1, in which said sensor means has a pressure sensor implemented by a plurality of sensor elements respectively associated with said plurality of hammer units, each of said sensor elements comprising a plurality of photo sensitive patterns formed on a substrate, and a conductive sheet member provided in association with said plurality of photo sensitive patterns, said plurality of hammer units deforming said conductive sheet member upon striking.

26. A stringless piano-touch electric sound producer as set forth in claim 25, in which said conductive sheet member is covered with a protective means to which said plurality of hammer units strike.

27. A stringless piano-touch electric sound producer as set forth in claim 1, in which said sensor means has a pressure sensor implemented by a plurality of sensor elements respectively associated with said plurality of hammer units, each of said sensor elements comprising a pair of electrodes, and a pressure sensitive rubber sheet sandwiched between said pair of electrodes and variable in resistance depending upon impact force applied with one of said plurality of hammer units.

28. A stringless piano-touch electric sound producer as set forth in claim 1, in which said sensor means has a pressure sensor implemented by a plurality of sensor elements respectively associated with said plurality of hammer units, each of said sensor elements being implemented by a switching element comprising a conductive pattern formed on a substrate, and a conductive sheet spaced apart from said conductive pattern, said conductive sheet being brought into contact with said conductive pattern upon striking with one of said plurality of hammer units.

29. A stringless piano-touch electric sound producer as set forth in claim 1, in which said sensor means has a pressure sensor implemented by a plurality of sensor elements respectively associated with said plurality of hammer units, each of said sensor elements comprising a magnet piece, and a coil member spaced apart from said magnet piece, distance between said magnet piece and said coil member being varied upon striking with one of said plurality of hammer units.

30. A stringless piano-touch electric sound producer as set forth in claim 1, in which vibratory board member comprises a baffle plate horizontally supported in said housing, and having at least large, middle and small apertures, a vibratory plate loosely received in said large aperture, a corrugation member coupled between said vibratory plate and said baffle plate for allowing said vibratory member to vibrate with respect to said baffle plate, a first speaker unit snugly received in said middle aperture, and supported by said baffle plate, and a second speaker unit snugly received in said small aperture, and supported by said baffle plate.

31. A stringless piano-touch electric sound producer as set forth in claim 1, in which vibratory board member comprises a baffle plate horizontally supported in said housing, and having at least large, middle and small apertures, a first speaker means received in said large aperture, and supported by said baffle plate, a second speaker means snugly received in said middle aperture, and supported by said baffle plate, and a third speaker unit snugly received in said small aperture, and supported by said baffle plate.

32. A stringless piano-touch electric sound producer comprising:

a) a keyboard having a plurality of keys independently manipulated by a player;

b) a plurality of hammer units respectively associated with said plurality of keys, and independently driven for rotations;

c) a plurality of key action mechanisms respectively coupled between said plurality of keys and said plurality of hammer units for imparting a piano-touch to said player, and operative to drive the associated hammer units for the rotations upon manipulations of the associated keys, a motion of each key, a motion of the associated key action mechanism and the rotation of the associated hammer unit constituting an impact motion;

d) board means shared between said plurality of hammer units, and allowing said plurality of hammer units to impact while decreasing the volume of sound;

e) a housing unit accommodating said keyboard, said plurality of hammer units, said plurality of key action mechanisms and said board means, and having a plurality of component members including a vibratory board member;

f) first sensor means operative to detect said impact motion for producing a first detecting signal;

g) a pedal member rockablly supported by said housing, and manipulated by said player when said player wants to impart an effect corresponding to an effect of a damper pedal of an acoustic piano to sounds produced from said vibratory board member;

h) second sensor means operative to detect a manipulation of said pedal member for producing a second detecting signal;

i) a first memory unit storing pieces of first vibratory information about vibrations originally produced on at least musical wires incorporated in said acoustic piano upon striking said musical wires with hammer units of said acoustic piano;

j) a second memory unit storing pieces of second vibratory information about resonant vibrations produced on other musical wires incorporated in said acoustic piano upon striking said musical wires with said hammer units;

k) selecting means responsive to said first detecting signal for selecting one of said pieces of first vibratory information in the absence of said second detecting signal, said selecting means being further responsive to said first detecting signal for selecting one of said pieces of first vibratory information as well as one of said pieces of second vibratory information in the presence of said second detecting signal; and l) driving means provided in association with said vibratory board member, and operative to produce vibrations thereon on the basis of said one of said pieces of first vibratory information for producing said sounds, said driving means being further produces vibrations on the basis of said one of said pieces of first vibratory information and of said one of said pieces of second vibratory information for imparting said effect to said sounds.

33. A stringless piano-touch electric sound producer as set forth in claim 32, in which said wireless piano-touch electric sound producer further comprises m) modifying means responsive to said second detecting signal, and operative to decay said sounds in one of a rapid decaying course, ordinarily decaying course and gradual decaying course.

34. A stringless piano-touch electric sound producer comprising:

a) a keyboard having a plurlaity of keys independently manipulated by a player;

b) a plurality of hammer units respectively assoicated with said plurality of keys, and independently driven for rorations;

c) a plurality of key action mechanisms respectively coupled between said plurlity of keys and said plurlaity of hammer units for imparting a piano-touch to said player, and operative to drive the associated hammer units for the rorations upon manipulations of the associated keys, a motion of each key, a motion of the assoicated key action mechanism and the roation of the associated hammer unit constituting an impact motion;

d) board means shared between said plurality of hammer units, and allowing said plurality of hammer units to impact while decreasing the volume sound;

e) a housing unit accomodating said keyboard, said plurality of hammer units, said plurality of key action mechanisms and said board means, and having a plurality of component members including a vibrative board member;

f) first sensor means operative to detect said impact motion for producing a first detecting signal;

g) a pedal member rockablly supported by said housing, and manipulated by said player when said player wants to impart an effect corresponding to an effect of a soft pedal of an acoustic piano to sounds produced from said vibrative board member;

h) second sensor means operative of detect a manipulation of said pedal member for producing a second detecting signal;

i) a first memory unit storing pieces of first vibrative information about vibrations originally produced on at least musical wires incorporated in said acoustic piano upon striking said musical wires with hammer units of said acoustic piano without any manipulation of said pedal member;

j) a second memory unit storing pieces of second vibrative information about resonant vibrations produced on other musical wires incorporated in said acoustic piano without striking;

k) selecting means responsive to said first detecting signal for selecting one of said pieces of first vibrative information in the absence of said second detecting signal, said selecting means being further responsive to said first detecting siganl for selecting one of said pieces of first vibrative information as well as one of said pieces of second vibrative information in the presence of said second detecting signal; and l) driving mean provided in association with said vibrative board member, and operative to produce vibrations thereon on the basis of said one of said pieces of first vibrative information for producing said sounds, said driving means be ing further produces vibrations on the basis of said one of said pieces of first vibrative information and of said one of said pieces of second vibrative information for imparting said effect to said sounds.

* * * * *